US009558688B2

(12) United States Patent
Ando et al.

(10) Patent No.: US 9,558,688 B2
(45) Date of Patent: Jan. 31, 2017

(54) IMAGE DISPLAY DEVICE AND CONTROL METHOD THEREOF

(71) Applicant: CANON KABUSHIKI KAISHA, Tokyo (JP)

(72) Inventors: Muneki Ando, Kawasaki (JP); Kousei Sugimoto, Atsugi (JP); Toshiki Nakatani, Kawasaki (JP)

(73) Assignee: Canon Kabushiki Kaisha, Toyko (JP)

( * ) Notice: Subject to any disclaimer, the term of this patent is extended or adjusted under 35 U.S.C. 154(b) by 0 days.

(21) Appl. No.: 14/208,772

(22) Filed: Mar. 13, 2014

(65) Prior Publication Data

US 2014/0267456 A1 Sep. 18, 2014

(30) Foreign Application Priority Data

Mar. 18, 2013 (JP) ..... 2013-055091

(51) Int. Cl.

*G09G 3/00* (2006.01)
*G09G 5/04* (2006.01)
*G09G 3/34* (2006.01)

(52) U.S. Cl.

CPC ..... *G09G 3/001* (2013.01); *G09G 3/3413* (2013.01); *G09G 5/04* (2013.01); *G09G 2310/0235* (2013.01); *G09G 2320/0242* (2013.01); *G09G 2320/0693* (2013.01); *G09G 2340/06* (2013.01)

(58) Field of Classification Search

CPC ..... G09G 3/22; G09G 3/2003; G09G 3/34; G09G 3/3413; G09G 3/3406; G09G 2310/0235;G09G 2320/0666; G09G 2320/0673; G09G 2340/06; G09G 5/04; G09G 3/001; G09G 2320/0693; G09G 2320/0242

See application file for complete search history.

(56) References Cited

U.S. PATENT DOCUMENTS 6,288,891 B1 9/2001 Hasegawa et al.
7,053,888 B2 5/2006 Ando
7,218,316 B2 5/2007 Ando
(Continued)

FOREIGN PATENT DOCUMENTS

JP 2003-141518 A 5/2003
JP 2004-138827 A 5/2004
(Continued)

*Primary Examiner* — Andrew Sasinowski
*Assistant Examiner* — Brent D Castiaux
(74) *Attorney, Agent, or Firm* — Fitzpatrick, Cella, Harper & Scinto

(57) ABSTRACT

An image display device includes: a light transmitting unit having transmission wavelength characteristics corresponding to each of a plurality of colors; an illuminating unit configured to emit light corresponding to each of the plurality of colors, the illuminating unit being configured to emit, with respect to at least one predetermined color, light including first light and second light whose emission peak wavelengths are both within a range of the transmission wavelength characteristics corresponding to the predetermined color and whose emission peak wavelengths differ from one another; and a control unit configured to control an intensity of each of the light of the plurality of emission spectra corresponding to the predetermined color in accordance with a color distribution of the image.

26 Claims, 55 Drawing Sheets

(56) References Cited

U.S. PATENT DOCUMENTS

| | | | | |
|---|---|---|---|---|
| 7,227,521 | B2 | 6/2007 | Yamazaki et al. | |
| 7,227,541 | B2 | 6/2007 | Ando | |
| 7,268,751 | B2 | 9/2007 | Yamazaki et al. | |
| 7,889,168 | B2 | 2/2011 | Yamazaki et al. | |
| 8,300,069 | B2 * | 10/2012 | Langendijk | G09G 3/3413 345/102 |
| 2003/0020698 | A1 | 1/2003 | Ando | |
| 2004/0125046 | A1 | 7/2004 | Yamazaki et al. | |
| 2004/0160406 | A1 | 8/2004 | Yamazaki et al. | |
| 2004/0174353 | A1 | 9/2004 | Ando | |
| 2004/0179031 | A1 | 9/2004 | Ando | |
| 2004/0263638 | A1 | 12/2004 | Ohsawa et al. | |
| 2006/0244712 | A1 * | 11/2006 | Cho | G02B 6/0068 345/102 |
| 2007/0139302 | A1 | 6/2007 | Yamazaki et al. | |
| 2011/0273495 | A1 * | 11/2011 | Ward | G09G 3/3413 345/694 |
| 2012/0050352 | A1 | 3/2012 | Baba et al. | |

FOREIGN PATENT DOCUMENTS

| | | | |
|---|---|---|---|
| JP | 2005-275204 | A | 10/2005 |
| JP | 2012-047827 | A | 3/2012 |
| JP | 2012-515948 | A | 7/2012 |
| WO | 2010/085505 | A1 | 7/2010 |

* cited by examiner

IMAGE DISPLAY DEVICE AND CONTROL METHOD THEREOF

BACKGROUND OF THE INVENTION

Field of the Invention

The present invention relates to an image display device which forms an image using a light source and an optical modulator that modulates transmittance or reflectance of light incident from the light source per pixel according to a drive signal, and a control method of the image display device.

Description of the Related Art

Color matching functions that represent human visual characteristics related to color are known to have individual variability attributable to fluctuations caused by age and the like. CIE170-1 is proposed as a model of such a fluctuation by the International Commission on Illumination (CIE).

The existence of such individual variability sometimes causes color to appear subtly different on an image display device from person to person. As a result, there may be cases where, depending on an observer, a color does not appear to be matched even after performing color calibration for colorimetric matching with printed matter. This phenomenon is particularly prominent among display devices using light sources with a narrow spectrum as a backlight in order to expand a display color gamut.

In order to solve this problem, there is a method of reducing individual variability of the appearance of color by reproducing a color spectrum of the real world as faithfully as possible on the basis that image signals and display devices have six primary colors (Japanese Patent Application Laid-open No. 2003-141518).

Alternatively, a display device is proposed that combines a broad light source which has a broad emission spectrum and which is used when an image to be displayed has low chroma and a narrow light source which has a narrow emission spectrum and which is used when an image to be displayed has high chroma (Japanese Translation of PCT Application No. 2012-515948). The display device is designed to achieve both a reduction of individual variability in appearance of color and an expansion of a display color gamut.

In addition, a method of expanding a color gamut of a display device by simultaneously lighting, in addition to an RGB basic light source, an extended light source of a different color is proposed (Japanese Patent Application Laid-open No. 2012-47827).

Furthermore, a method of expanding a color gamut of a display device by changing an applied current value of an RGB basic light source per factice field to increase the number of colors of the light source is proposed (Japanese Patent Application Laid-open No. 2005-275204).

Moreover, an image display device is proposed which is configured such that two light sources are provided for one color of a color filter, the two light sources belong to a same color category, and two peak wavelengths that differ from each other of the two light sources both fall within a wavelength range of transmission characteristics of the color filter (Japanese Patent Application Laid-open No. 2004-138827).

SUMMARY OF THE INVENTION

However, since the technique according to Japanese Patent Application Laid-open No. 2003-141518 described above requires display pixels of the six primary colors as well as peripheral circuitry and image processing suitable for such display pixels, a system is subjected to considerable load.

In addition, with the technique according to Japanese Translation of PCT Application No. 2012-515948 described above, since the broad light source does not contribute to expanding a color gamut, the effect of expanding a display color gamut is limited.

With the techniques according to Japanese Patent Application Laid-open No. 2003-141518, Japanese Translation of PCT Application No. 2012-515948, and Japanese Patent Application Laid-open No. 2012-47827, the requirement of a light source other than the RGB basic light source increases cost.

Furthermore, with the technique according to Japanese Patent Application Laid-open No. 2005-275204, an increase in the number of factice fields in accordance with the increased number of colors reduces a lighting time of the RGB basic light source and, as a result, brightness declines.

Moreover, with the technique according to Japanese Patent Application Laid-open No. 2004-138827, it is difficult to achieve both a reduction in individual variability in the appearance of color attributable to a variation in color matching functions and an expansion of a display color gamut.

The present invention provides an image display device capable of achieving both a reduction of individual variability in appearance of color and an expansion of a display color gamut.

A first aspect of the present invention is an image display device that displays an image, the image display device including: a light transmitting unit having transmission wavelength characteristics corresponding to each of a plurality of colors;

an illuminating unit configured to emit light corresponding to each of the plurality of colors, the illuminating unit being configured to emit, with respect to at least one predetermined color among the plurality of colors, light of a plurality of emission spectra including first light and second light whose emission peak wavelengths are both within a range of the transmission wavelength characteristics of the light transmitting unit corresponding to the predetermined color and whose emission peak wavelengths differ from one another; and a control unit configured to control an intensity of each of the light of the plurality of emission spectra corresponding to the predetermined color in accordance with a color distribution of the image.

A second aspect of the present invention is an image display device that displays an image, the image display device including: an illuminating unit configured to emit light corresponding to each of a plurality of colors, the illuminating unit being configured to emit, with respect to at least one predetermined color among the plurality of colors, light of a plurality of emission spectra including first light whose emission peak wavelength is shorter than a peak wavelength of a color matching function corresponding to the predetermined color and second light whose emission peak wavelength is longer than the peak wavelength of the color matching function corresponding to the predetermined color; and a control unit configured to control emission of light by the illuminating unit.

A third aspect of the present invention is an image display device that displays an image, the image display device including:

a light transmitting unit having transmission wavelength characteristics corresponding to each of a plurality of colors;

an illuminating unit configured to emit light corresponding to each of the plurality of colors, the illuminating unit being configured to emit, with respect to at least one predetermined color among the plurality of colors, light of a plurality of emission spectra including first light and second light whose emission peak wavelengths are both within a range of the transmission wavelength characteristics of the light transmitting unit corresponding to the predetermined color and whose emission spectra differ from one another with respect to degrees of wideness; and a control unit configured to control an intensity of each of the light of the plurality of emission spectra corresponding to the predetermined color in accordance with a color distribution of the image.

According to the present invention, an image display device that achieves both a reduction of individual variability in appearance of color and an expansion of a display color gamut can be provided.

Further features of the present invention will become apparent from the following description of exemplary embodiments with reference to the attached drawings.

DESCRIPTION OF THE EMBODIMENTS

First Embodiment

Figure 1A:
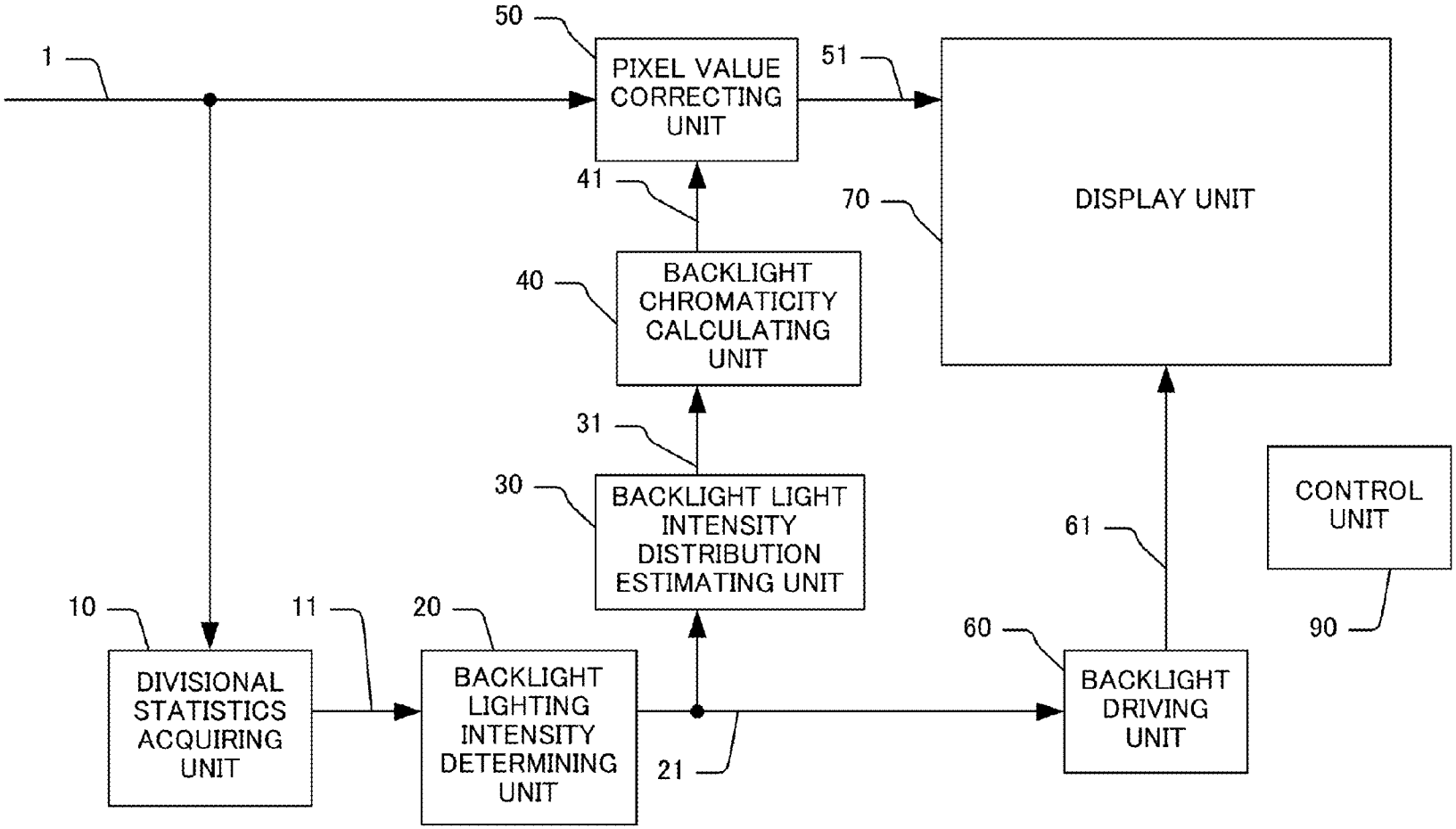
FIGS. 1A to 1C are configuration diagrams of an image display device, a divisional statistics acquiring unit, and a pixel value correcting unit according to a first embodiment.

Configuration diagrams of an image display device according to a first embodiment of the present invention will be described with reference to FIGS. 1, 2, and 3. The image display device according to the first embodiment is a direct-type image display device in which an image formed on a liquid crystal panel is directly observed.

A divisional statistics acquiring unit 10 analyzes an input image 1 inputted to the device by an image inputting unit (not shown) and calculates divisional statistics 11. A method of acquiring the divisional statistics 11 will be described in detail later.

A backlight lighting intensity determining unit 20 calculates a backlight lighting intensity 21 based on the divisional statistics 11. A method of determining the backlight lighting intensity 21 will be described in detail later.

A backlight light intensity distribution estimating unit 30 estimates a backlight light intensity distribution 31 on a display unit 70 based on the backlight lighting intensity 21. A method of estimating the backlight light intensity distribution 31 will be described in detail later.

A backlight chromaticity calculating unit 40 calculates a backlight chromaticity 41 per pixel on the display unit 70 based on the backlight light intensity distribution 31. A method of calculating the backlight chromaticity 41 will be described in detail later.

A pixel value correcting unit 50 calculates a corrected pixel value 51 for reproducing brightness and chromaticity represented by a pixel value (R, G, B) of the input image 1 in a color space set for the input image 1 under the backlight chromaticity 41 corresponding to each pixel. A corrected pixel value is expressed by three primary colors of (R', G', and B'). A method of calculating the corrected pixel value 51 will be described in detail later.

A backlight driving unit 60 outputs a backlight drive signal 61 that drives a backlight of the display unit 70 and controls an amount of light based on the backlight lighting intensity 21. A driving method for controlling the amount of light may involve controlling a current amount or controlling a lighting time ratio.

The display unit 70 is constituted by a liquid crystal panel unit 71 that is made up of liquid crystal elements and a backlight unit 72.

Figure 2:
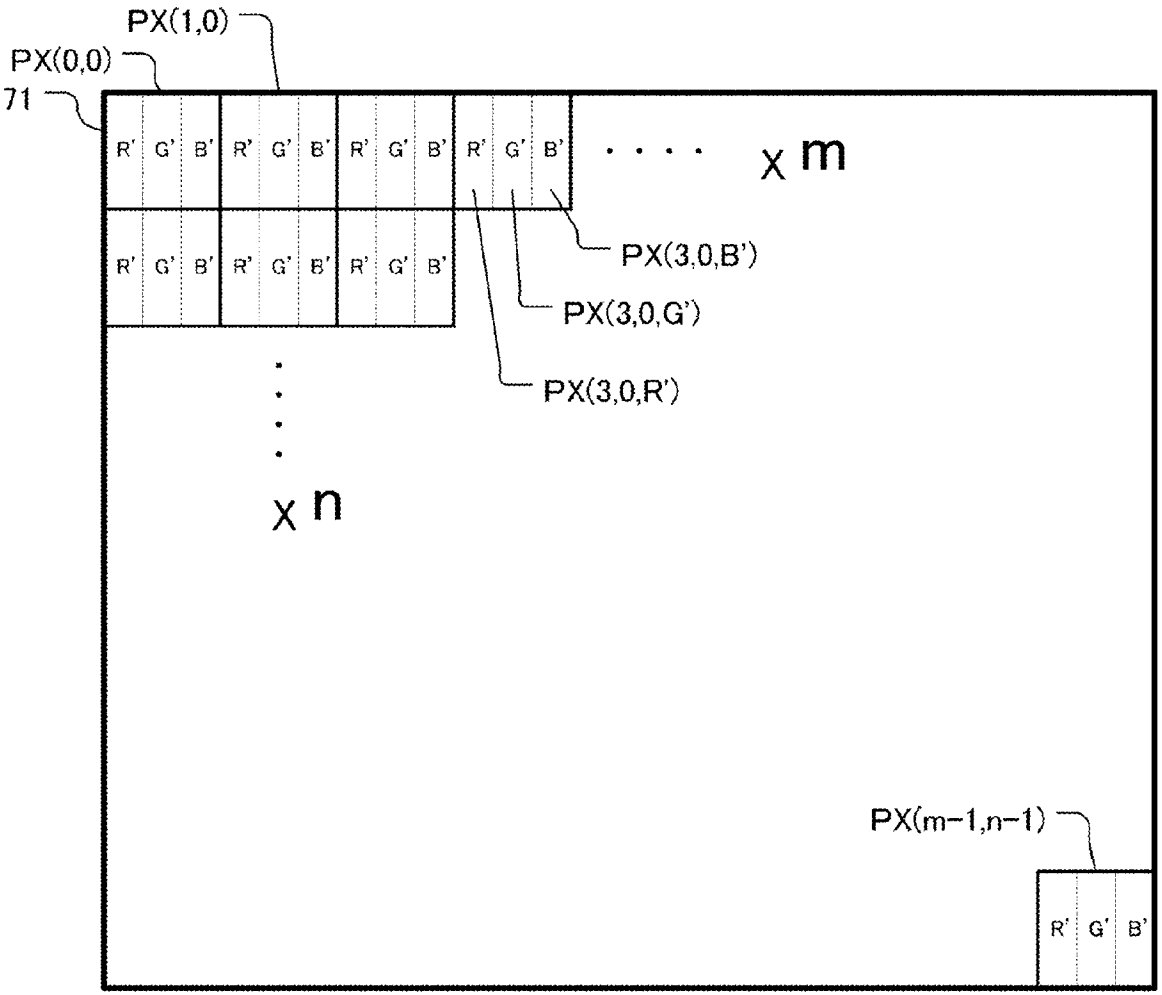
FIG. 2 is a conceptual diagram of a liquid crystal panel unit.

FIG. 2 shows a conceptual diagram of the liquid crystal panel unit 71. In the liquid crystal panel unit 71, m-number of horizontal pixels and n-number of vertical pixels are arranged in a matrix pattern. Each pixel is constituted by an R'G'B' liquid crystal shutter element 711 and a color filter 712 (not shown). An image is formed on the panel due to a change in transmittance of a corresponding liquid crystal shutter element in accordance with an (R'G'B') value of each pixel among the corrected pixel value 51. In the following description, a pixel at a coordinate (x, y) will be denoted as PX (x, y), a subpixel R' thereof will be denoted as PX (x, y, R'), and the corrected pixel value 51 corresponding thereto will be denoted as px (x, y, R') (the same notation system will also apply to G' and B'). In addition, characteristics of the color filter 712 that transmits light according to transmission wavelength characteristics corresponding to R'G'B' will be described later.

Figure 3:
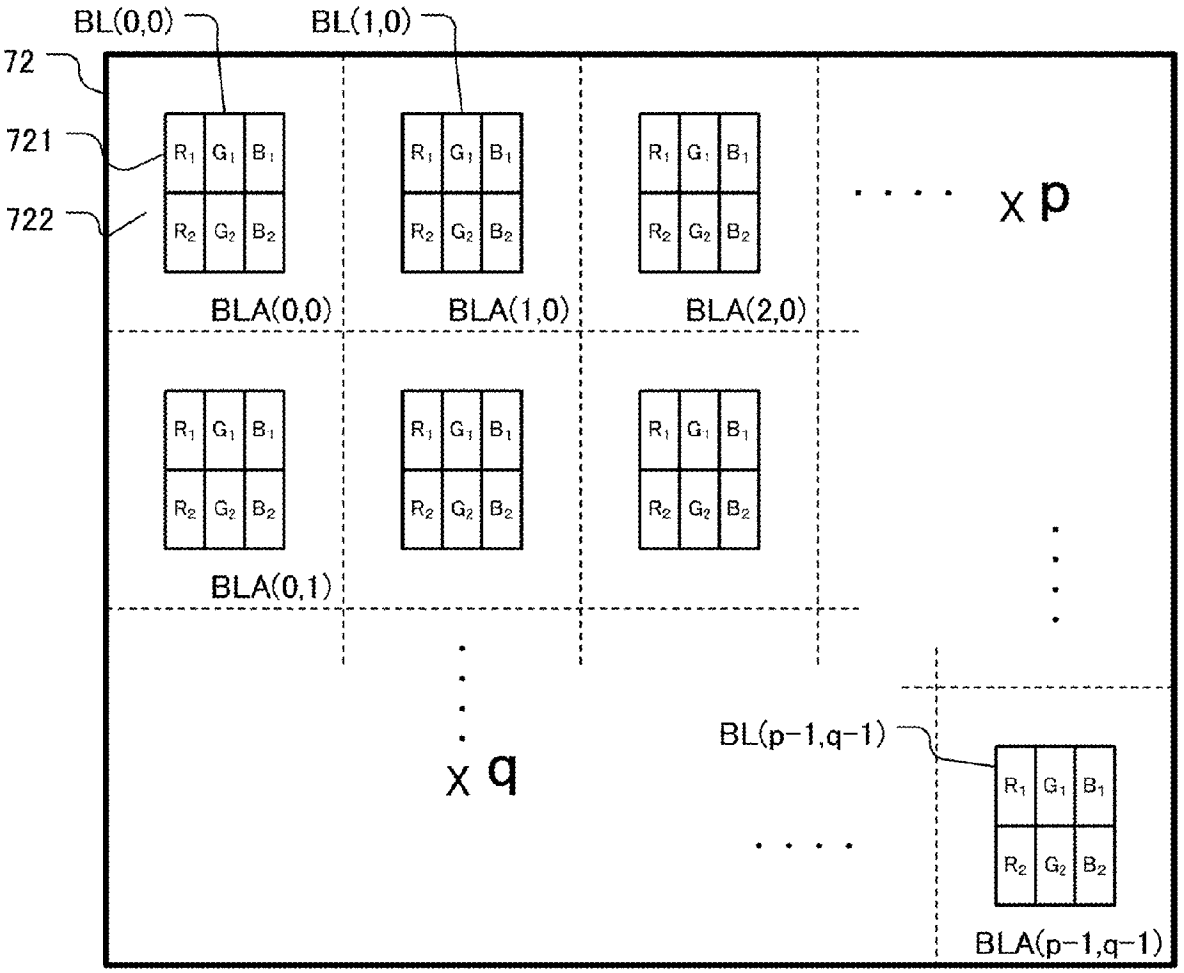
FIG. 3 is a conceptual diagram of a backlight unit.

FIG. 3 shows a conceptual diagram of the backlight unit 72. The backlight unit 72 is an illuminating unit that emits light corresponding to each of the three RGB primary colors. The backlight unit 72 is constituted by a plurality of illuminating regions and emits light corresponding to each of the three RGB primary colors for each of the illuminating regions. Specifically, the backlight unit 72 is constituted by p-number of horizontal and q-number of vertical backlight areas 722, and R1, R2, G1, G2, B1, and B2 light sources 721 are arranged in each backlight area 722. In the first embodiment, light-emitting diodes that are light-emitting elements are used as light sources. In the following description, a j-th (j=0, 1, . . . , p−1) horizontal and k-th (k=0, 1, . . . , q−1) vertical backlight area counting from a top left backlight area will be denoted as BLA (j, k), a light-emitting diode group thereof will be denoted as BL (j, k), and the R1 light-emitting diode thereof will be denoted as BL (j, k). R1. In addition, a value of corresponding backlight lighting intensity 21 will be denoted as bl (j, k). R1 (the same notation system will also apply to R2, G1, G2, B1, and B2). Light emitted from the light sources 721 is diffused in a planar direction by a diffuser plate (not shown) and irradiates the liquid crystal panel unit 71 from the rear as a backlight light having a predetermined spread.

A control unit 90 controls operations of the respective units and timings thereof via control lines (not shown).

Next, emission characteristics of each light source 721, a selection method thereof, and a method of designing a lighting intensity ratio will be described using an example of a blue light source.

Figure 4B:
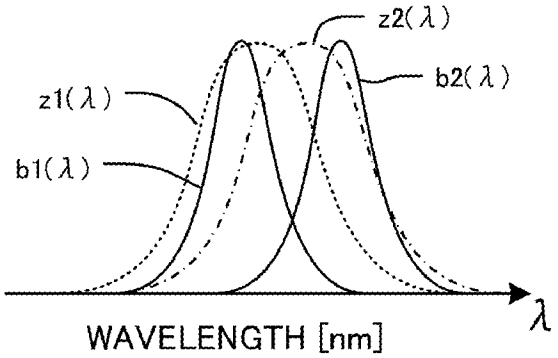
FIGS. 4A and 4B are conceptual diagrams showing relationships between color matching functions and spectra of light sources.
Figure 4A:
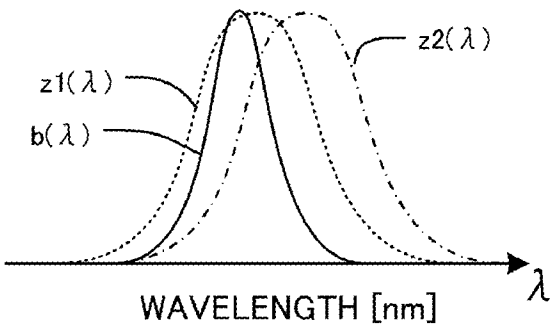

FIG. 4A is a conceptual diagram showing a relationship between color matching functions representing characteristics of a human eye and a spectrum of a light source when only one light source is used in a display device. As described in BACKGROUND OF THE INVENTION, there is individual variability in color matching functions. In the drawing, a spectrum of a light source b is denoted by b (λ), a color matching function of an observer A is denoted by z1 (λ), and a color matching function of another observer B is denoted by z2 (λ). As shown in FIG. 4A, there is individual variability between the color matching functions of the observer A and the observer B.

A stimulus ZA of the light source b as sensed by the observer A is expressed as Expression 1.

$$ZA=\int b(\lambda)z1(\lambda)d\lambda \quad \text{[Expression 1]}$$

A stimulus ZB of the light source b as sensed by the observer B is expressed as Expression 2.

$$ZB=\int b(\lambda)z2(\lambda)d\lambda \quad \text{[Expression 2]}$$

Since peaks of b (λ) and z1 (λ) are relatively closely matched, the observer A substantially senses all of the energy of the light source b. On the other hand, since peaks of b (λ) and z2 (λ) are misaligned, ZB is smaller than ZA. In other words, the observer B only senses a part of the energy of the light source b. Due to such a mechanism, a phenomenon occurs where differences are created in the energy received from a light source among individuals and, as a result, different colors are perceived.

In comparison, in the present invention, two light sources with different peak wavelengths, namely, the light source b1 and the light source b2 are used. FIG. 4B is a conceptual diagram showing a relationship between color matching functions and spectra of the light sources in this case. In the drawing, a spectrum of the light source b1 is denoted by b1 (λ) and a spectrum of the light source b2 is denoted by b2 (λ). In this case, a stimulus ZA' that is sensed by the observer A and a stimulus ZB' that is sensed by the observer B are expressed as Expression 3.

$$ZA'=\int(b1(\lambda)+b2(\lambda))z1(\lambda)d\lambda$$

$$ZB'=\int(b1(\lambda)+b2(\lambda))z2(\lambda)d\lambda \quad \text{[Expression 3]}$$

Let us assume that D1 represents a difference between a stimulus ∫b1 (λ) z1 (λ) dλ received by the observer A from the light source b1 and a stimulus ∫b1 (λ) z2 (λ) dλ received by the observer B from the light source b1. Let us also assume that D2 represents a difference between a stimulus ∫b2 (λ) z1 (λ) dλ received by the observer A from the light source b2 and a stimulus ∫b2 (λ) z2 (λ) dλ received by the observer B from the light source b2. In a spectral relationship such as that shown in FIG. 4B, the differences D1 and D2 have a substantially mutually complementary relationship (D1+D2≅0).

In other words, although not strictly ZA'=ZB', the difference between ZA' and ZB' is significantly smaller than the difference between ZA and ZB. Therefore, the stimulus sensed by the observer A and the stimulus sensed by the observer B can practically be considered sufficiently equivalent. The stimulus sensed by the observer A and the stimulus sensed by the observer B being equivalent means that perceived colors can be made equivalent even when there is individual variability among color matching functions.

Based on the principle described above, a guideline with respect to selection and conditions of use of light-emitting diodes that is applied when designing an actual backlight unit may be presented as follows.

Let an average color matching function be denoted by z (λ), a peak wavelength thereof by λz, a color matching function having a lower limit peak wavelength among color matching functions that fluctuate due to individual variability by za (λ), and a peak wavelength thereof by λza. In addition, let a color matching function having an upper limit peak wavelength be denoted by zb (λ) and a peak wavelength thereof by λzb. Furthermore, let emission characteristics of two light-emitting diodes be denoted by b1 (λ) and b2 (λ), respective emission peak wavelengths thereof by λb1 and λb2, and respective lighting intensities thereof by Pb1 and Pb2.

Most desirably, light source characteristics are selected so that, between the color matching functions z1 (λ) and z2 (λ) which differ from each other due to individual variability, a difference in integrations of a product of the color matching function and the light source spectrum is minimized. In other words, the characteristics and lighting intensity of each light-emitting diode are ideally selected so as to satisfy Expression 4.

$$\int(Pb1\cdot b1(\lambda)+Pb2\cdot b2(\lambda))z1(\lambda)d\lambda=\int(Pb1\cdot b1(\lambda)+Pb2\cdot b2(\lambda))z2(\lambda)d\lambda \quad \text{[Expression 4]}$$

More simply put, light source characteristics may be selected so that integrations of products of the average color matching function z (λ) and emission spectra of the respective light-emitting diodes are equal to each other. In other words, the characteristics and lighting intensity of each light-emitting diode are selected so as to satisfy Expression 5.

$$\int Pb1\cdot b1(\lambda)z(\lambda)d\lambda=\int Pb2\cdot b2(\lambda)z(\lambda)d\lambda \quad \text{[Expression 5]}$$

Alternatively, light source characteristics may be selected so that the emission peak wavelengths λb1 and λb2 of the two light-emitting diodes respectively assume a shorter wavelength (first light) and a longer wavelength (second light) than the peak wavelength λz of an average color matching function. In other words, the characteristics of each light-emitting diode are selected so as to satisfy Expression 6.

$$\lambda b1<\lambda z<\lambda b2 \quad \text{[Expression 6]}$$

Furthermore, light source characteristics may be selected so that the emission peak wavelengths λb1 and λb2 of the two light-emitting diodes respectively assume a shorter wavelength and a longer wavelength than a fluctuation range of the peak wavelength of the color matching function due to individual variability. In other words, the characteristics of each light-emitting diode are selected so as to satisfy Expression 7.

$$\lambda b1\leq\lambda za<\lambda zb\leq\lambda b2 \quad \text{[Expression 7]}$$

Moreover, when selecting peak wavelengths of the two light sources constituting a primary color light source according to Expression 6 or Expression 7, the peak wavelengths of the two light sources need not necessarily equally deviate on the long wavelength side and the short wavelength side from the peak wavelength of an average color matching function. In addition, conceivably, a most simple way to suppress individual variability in the appearance of color is to set the same lighting intensity for the two light sources. However, from the perspective of reducing individual variability in the appearance of color, it is essential that a balance is established between spectral power on a long wavelength side and spectral power on a short wavelength side with respect to a peak wavelength of an average color matching function in consideration of the emission spectra of the two light sources and the lighting intensities of the two light sources. More accurately, it is essential that a power balance is established between products of the emission spectra of the two light sources and an average color matching function.

This also applies to the green and red light sources.

Moreover, the first embodiment assumes that the present invention is to be applied to an image display device that modulates a backlight light based on an image signal in the three RGB primary colors. Accordingly, since the color filter adopts a three RGB color configuration and subpixels per pixel are limited to the three RGB colors, the size of a pixel can be prevented from becoming too fine as compared to multiple primary color image display devices with more than three primary colors. In addition, since signal processing need only be based on the three RGB colors, an increase in processing load can be suppressed.

Figure 6:
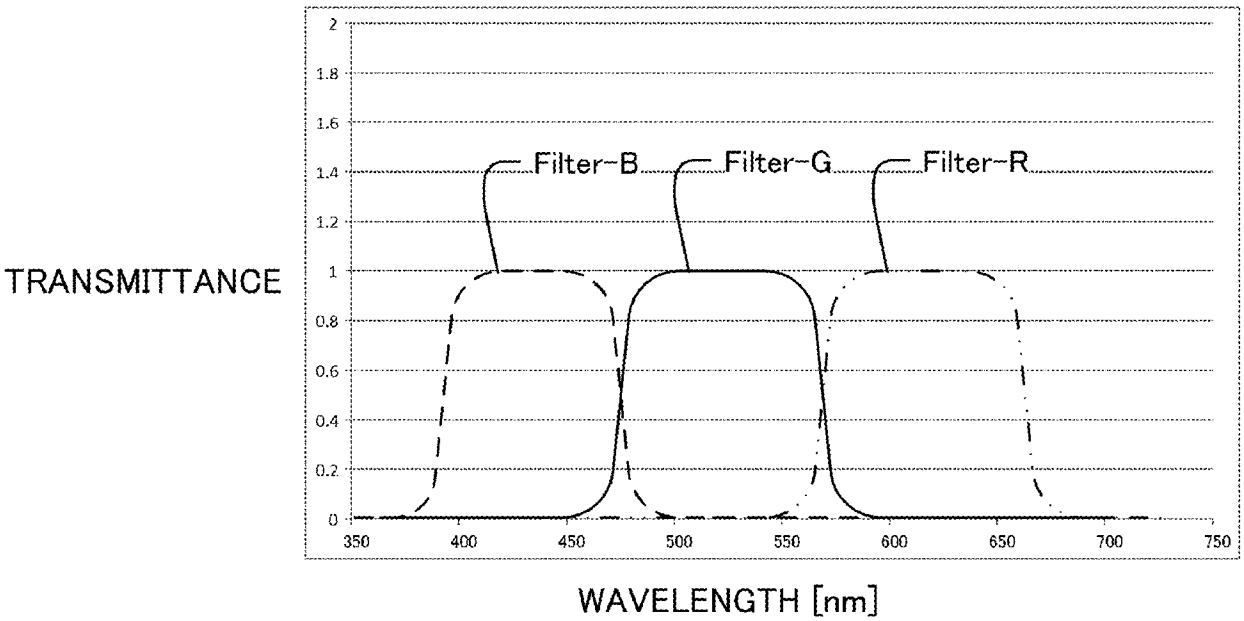
FIG. 6 shows transmission characteristics of a color filter.

When selecting the peak wavelengths of the two light-emitting diodes constituting a given primary color light source, the peak wavelengths are selected from wavelengths within a range that can generally be regarded as the primary color. While methods of determining such a wavelength range is arbitrary, for example, the wavelength range can be determined based on transmission characteristics of a color filter corresponding to the primary color. The transmission characteristics of a color filter are as shown in FIG. 6. For example, the peak wavelengths λr1 and λr2 of the two light sources R1 and R2 constituting the red primary color light source are determined within a wavelength range in which transmittance is equal to or greater than a predetermined threshold such as a range between 590 nm to 650 nm among transmission characteristics of a red filter that corresponds to the red primary color.

Alternatively, a wavelength range that can generally be regarded as a given primary color can be determined based on characteristics of a color matching function. For example, peak wavelengths of an average color matching function are λz=445 nm, λy=555 nm, and λx=600 nm. Wavelengths at equally divided points when a range from λz to λy is divided by three are 482 nm and 518 nm. In addition, wavelengths at equally divided points when a range from λy to λx is divided by three are 570 nm and 585 nm. Based on these wavelengths, the peak wavelengths of the two light sources used to emit light in order to obtain respective primary color backlight light of the three RGB primary colors are determined so as to satisfy $$\lambda b1<\lambda z<\lambda b2\leq 482\text{ nm},$$

$$518\text{ nm}\leq\lambda g1<\lambda y<\lambda g2\leq 570\text{ nm, and}$$

$$585\text{ nm}\leq\lambda r1<\lambda x<\lambda r2.$$

Alternatively, the peak wavelengths of the two light sources used to emit light in order to obtain respective primary color backlight light of the three RGB primary colors may be determined so that $$\lambda b1\leq\lambda za<\lambda zb\lambda b2\leq 482\text{ nm},$$

$$518\text{ nm}\leq\lambda g1\leq\lambda ya<\lambda yb\leq\lambda g2\leq 570\text{ nm, and}$$

$$585\text{ nm}\leq\lambda r1\leq\lambda xa<\lambda xb\leq\lambda r2.$$

By configuring the primary color light source of each color of the three RGB primary colors with two light sources having different characteristics that are selected as described above and generating a primary color light source light by lighting the two light sources, the occurrence of a variation in the appearance of color (color as perceived by each observer) due to individual variability in color matching functions can be suppressed.

Moreover, while an example in which the primary color light source of each color is constituted by two light sources having different emission characteristics has been shown, the primary color light source of each color may be constituted by three or more light sources having different emission characteristics. In addition, by configuring the primary color light source with a plurality of light sources having different emission characteristics for at least one color among the three RGB primary colors, an effect of reducing individual variability with respect to the appearance of color described earlier can be produced.

By using a narrow light source with a relatively narrow emission spectrum as at least one of the two light sources, both an effect of expanding a display color gamut and reducing individual variability in the appearance of color can be achieved.

As a specific example that approximately satisfies the selection criteria for a primary color light source described above, in the first embodiment, emission peak wavelengths of the two light sources B1, B2, G1, G2, R1, and R2 that constitute the respective primary color light sources of the three RGB primary colors are set to λb1=420 nm,
λb2=440 nm,
λg1=530 nm,
λg2=560 nm,
λr1=590 nm, and
λr2=620 nm.

In addition, relative lighting intensities of the respective light sources in a normal state are set to bl.B1=NPb1,
bl.B2=NPb2,
bl.G1=NPg1,
bl.G2=NPg2,
bl.R1=NPr1, and
bl.R2=NPr2.

In the first embodiment, specific values of the relative lighting intensities in a normal state are set to NPb1=1.0,
NPb2=1.0,
NPg1=1.2,
NPg2=1.0,
NPr1=1.0, and
NPr2=1.2.

For the green light source, NPg1 is set slightly higher than NPg2 in order to bring a primary color point in the normal state close to g1. In addition, for the red light source, NPr2 is set slightly higher than NPr1 in order to bring a primary color point in the normal state close to r2.

The lighting intensity in a normal state will be referred to as a "normal lighting intensity". In addition, chromaticity points of the three primary colors that are obtained when lighting the two light sources of the respective RGB primary colors having wavelength characteristics determined as described above at the normal lighting intensity described above will be referred to as "normal primary color points".

Figure 5A:
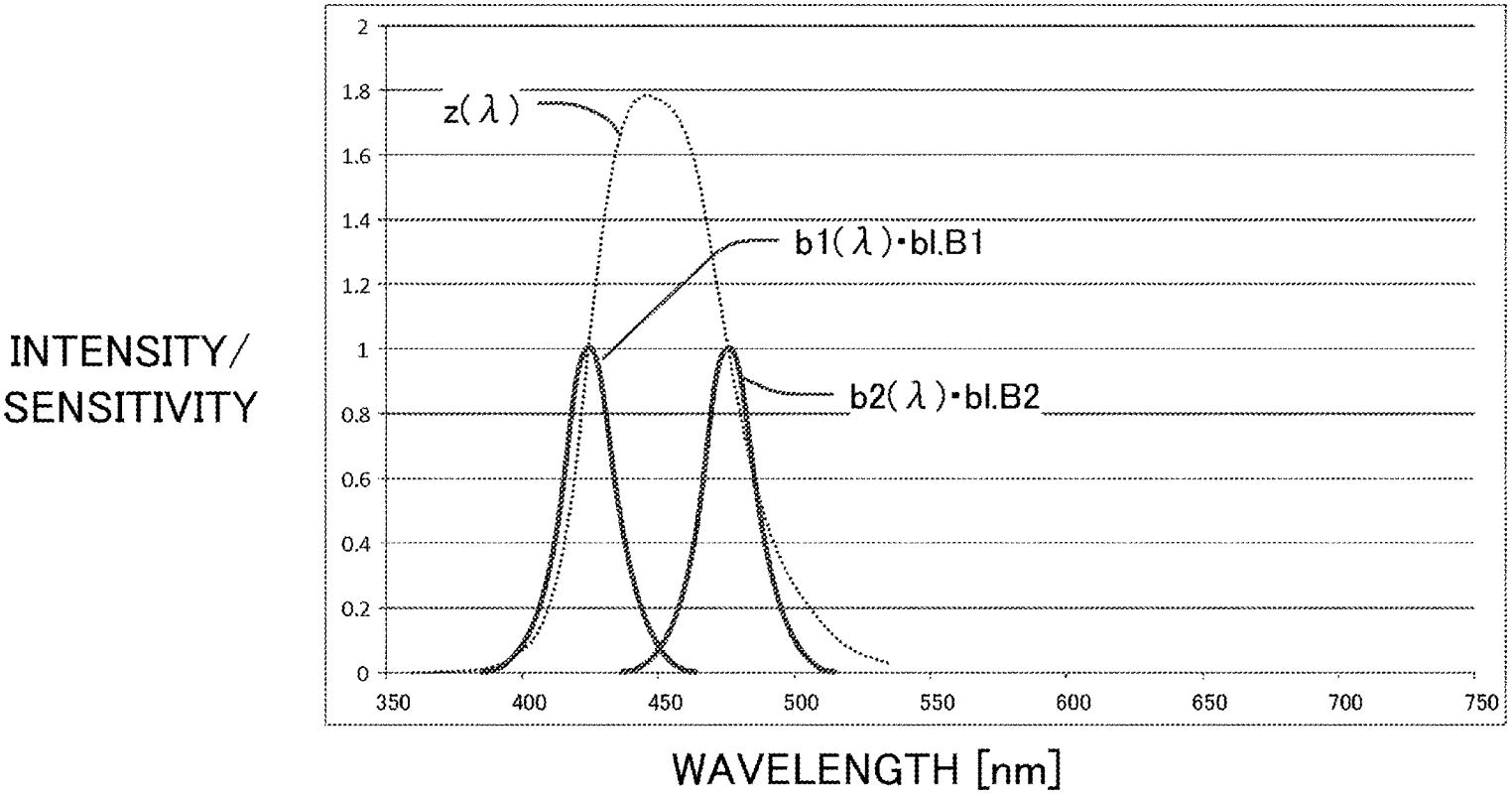
FIGS. 5A to 5C are diagrams showing relationships between characteristics of light sources selected in the first embodiment and color matching functions.
Figure 5B:
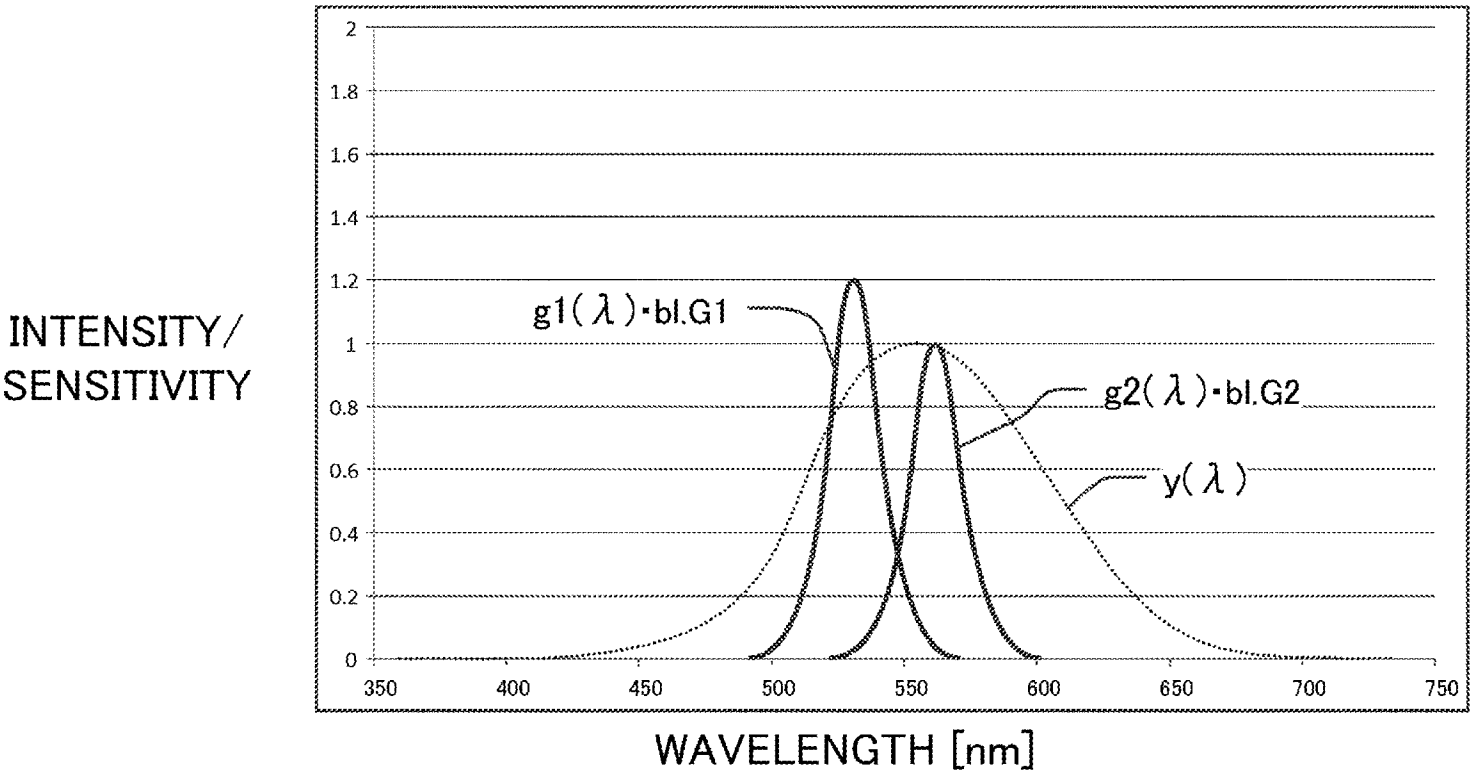
Figure 5C:
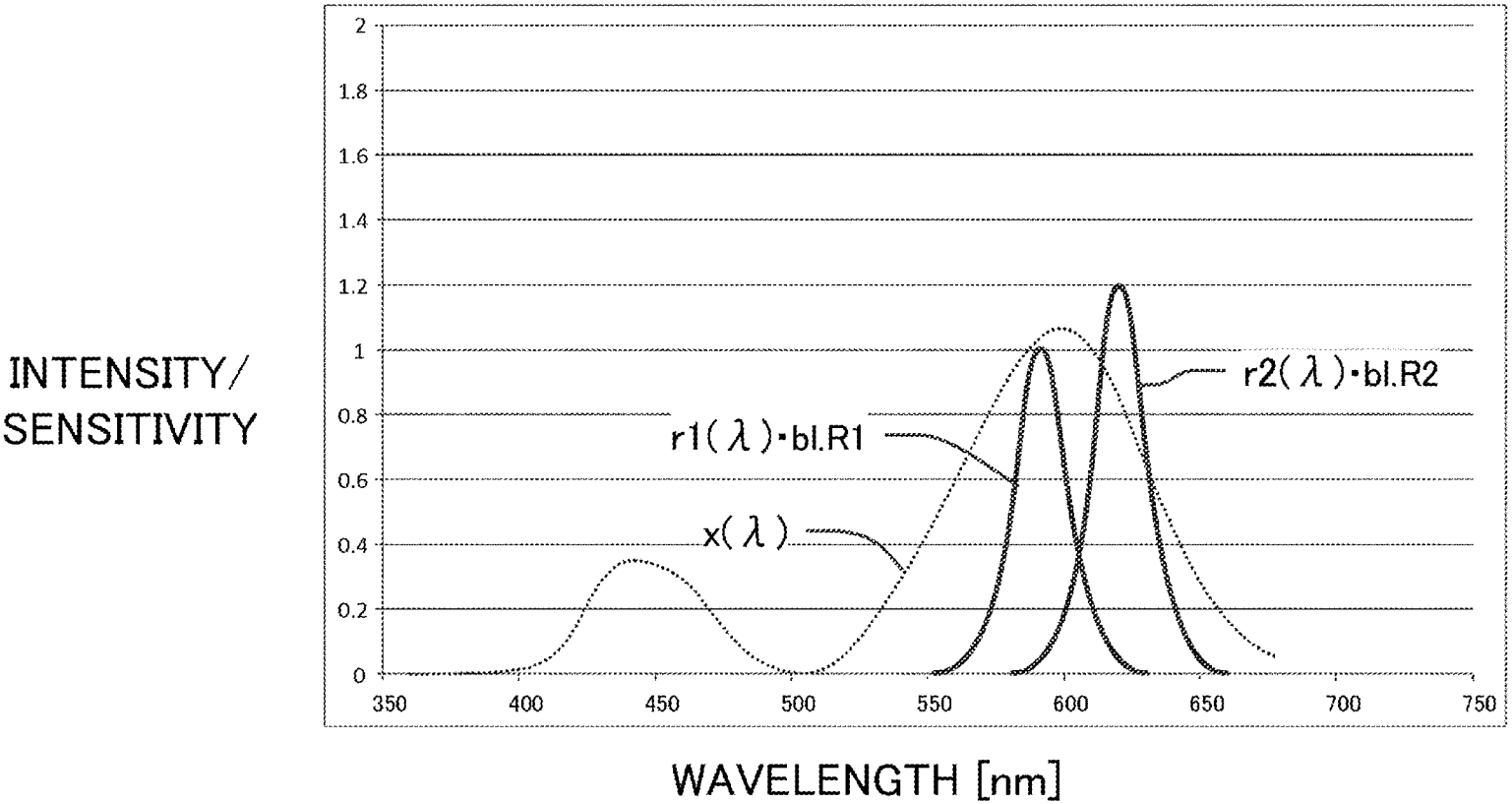

FIG. 5 is a diagram showing a relationship between characteristics of light sources selected in the first embodiment and color matching functions. FIG. 5A is a relationship diagram of light source characteristics of blue and color matching functions, FIG. 5B is a relationship diagram of light source characteristics of green and color matching functions, and FIG. 5C is a relationship diagram of light source characteristics of red and color matching functions. In FIG. 5, y (λ) denotes an average color matching function of green and x (λ) denotes an average color matching function of red.

The color filter 712 separates light source light irradiated from the backlight unit 72 into three respective wavelength bands of RGB which correspond to the three primary colors of the liquid crystal shutter element 711. Transmission characteristics of the color filter used in the first embodiment are shown in FIG. 6. A Filter-B that is the filter of blue (B) performs filtering so as to transmit light emitted from the light source B1 and the light source B2. In a similar manner, a Filter-G that is the filter of green (G) performs filtering so as to transmit light emitted from the light source G1 and the light source G2, and a Filter-R that is the filter of red (R) performs filtering so as to transmit light emitted from the light source R1 and the light source R2.

Figure 1B:
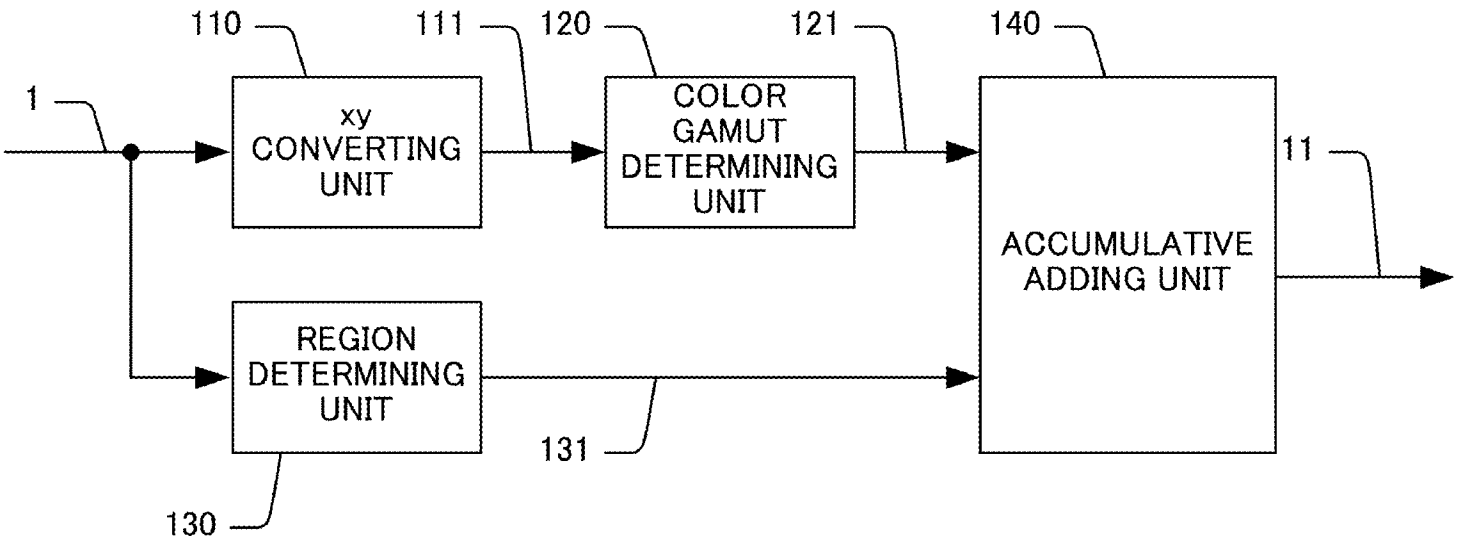

Next, a method of acquiring the divisional statistics 11 by the divisional statistics acquiring unit 10 will be described in detail. FIG. 1B shows a configuration diagram of the divisional statistics acquiring unit 10.

An xy converting unit 110 converts an RGB pixel value of each pixel constituting the input image 1 into a value in a Yxy color system based on a color space of the input image 1 and outputs an xy value 111.

Figure 7:
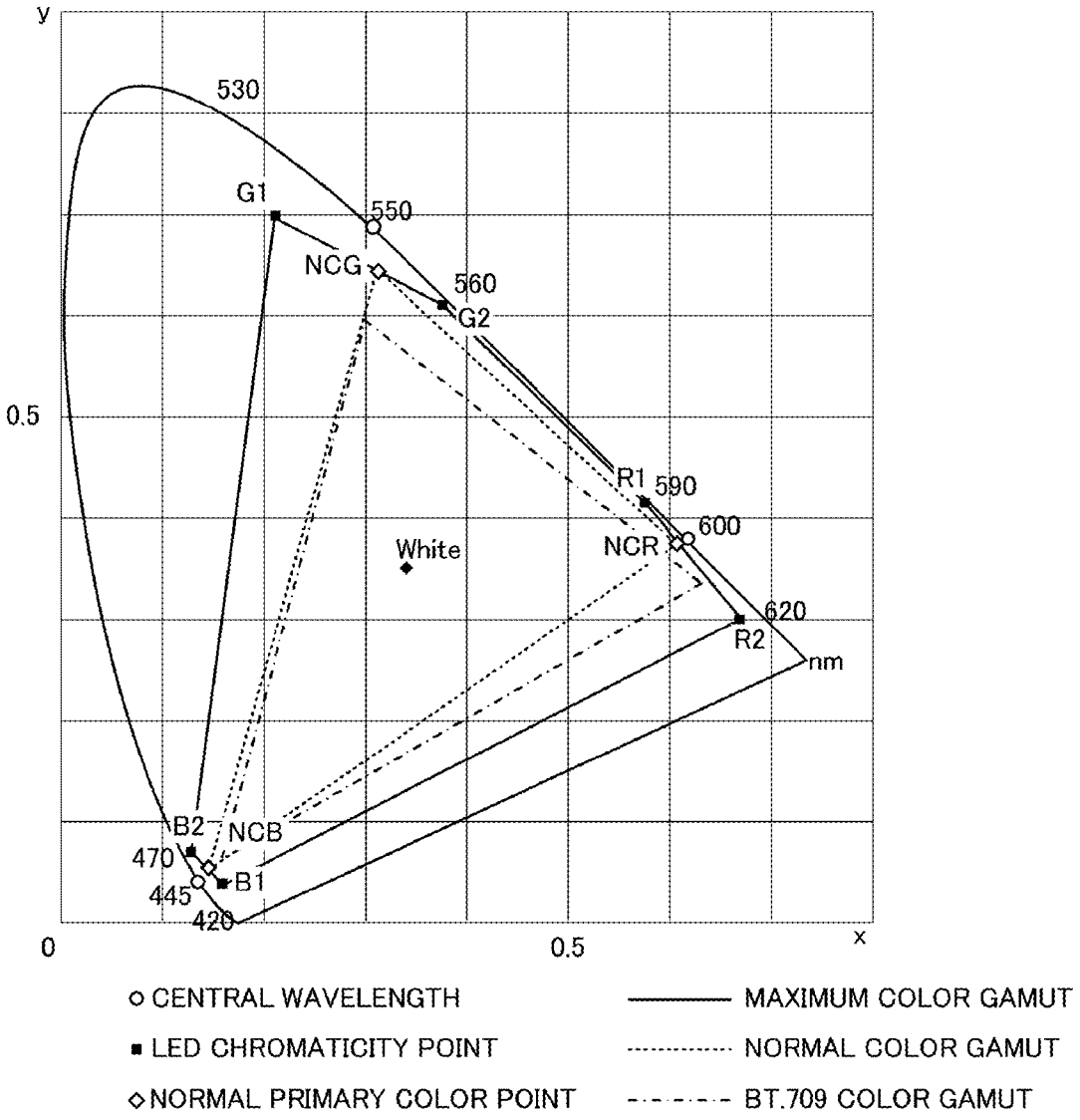
FIG. 7 is a conceptual diagram of a color gamut in a color gamut determining process.

A color gamut determining unit 120 determines which color gamut the xy value 111 of each pixel is to be classified into and outputs a color gamut determination result 121. FIG. 7 shows a conceptual diagram of the color gamut determining process.

If the color space of the input image 1 is BT.709, then the xy value 111 is any of the values in a range of a BT.709 color gamut shown in the drawings. However, when the color gamut is expanded by image processing in a previous stage and the RGB value may be a negative value or a value exceeding 1, the xy value 111 may assume a value outside of a triangular region enclosed by a dashed dotted line representing the BT.709 color gamut in the drawings.

A hexagonal region enclosed by color origins (B1, B2, G1, G2, R1, and R2) of the light source lights of the six colors used in the first embodiment represents a maximum color gamut that can be reproduced by the image display device according to the first embodiment. In addition, chromaticity points (normal primary color points) of the three RGB primary colors which are obtained when the respective RGB color light sources are lighted at normal lighting intensity are respectively denoted as NCR, NCG, and NCB. A color region enclosed by the three points represents a color gamut obtained when the respective RGB color light sources are lighted at normal lighting intensity and is referred to as a "normal color gamut".

Using these chromaticity points, the following color regions enclosed by the three chromaticity points are defined.

CAB1[0]:{NCB, B2, R2}
CAB1[1]:{B1, NCB, R2}
CAB2[0]:{NCB, B1, G1}
CAB2[1]:{B2, NCB, G1}
CAG1[0]:{NCG, G2, B2}
CAG1[1]:{G1, NCG, B2}
CAG2[0]:{NCG, G1, R1}
CAG2[1]:{G2, NCG, R1}
CAR1[0]:{NCR, R2, G2}

CAR1[1]:{R1, NCR, G2}
CAR2[0]:{NCR, R1, B1}
CAR2[1]:{R2, NCR, B1}

Figure 8A:
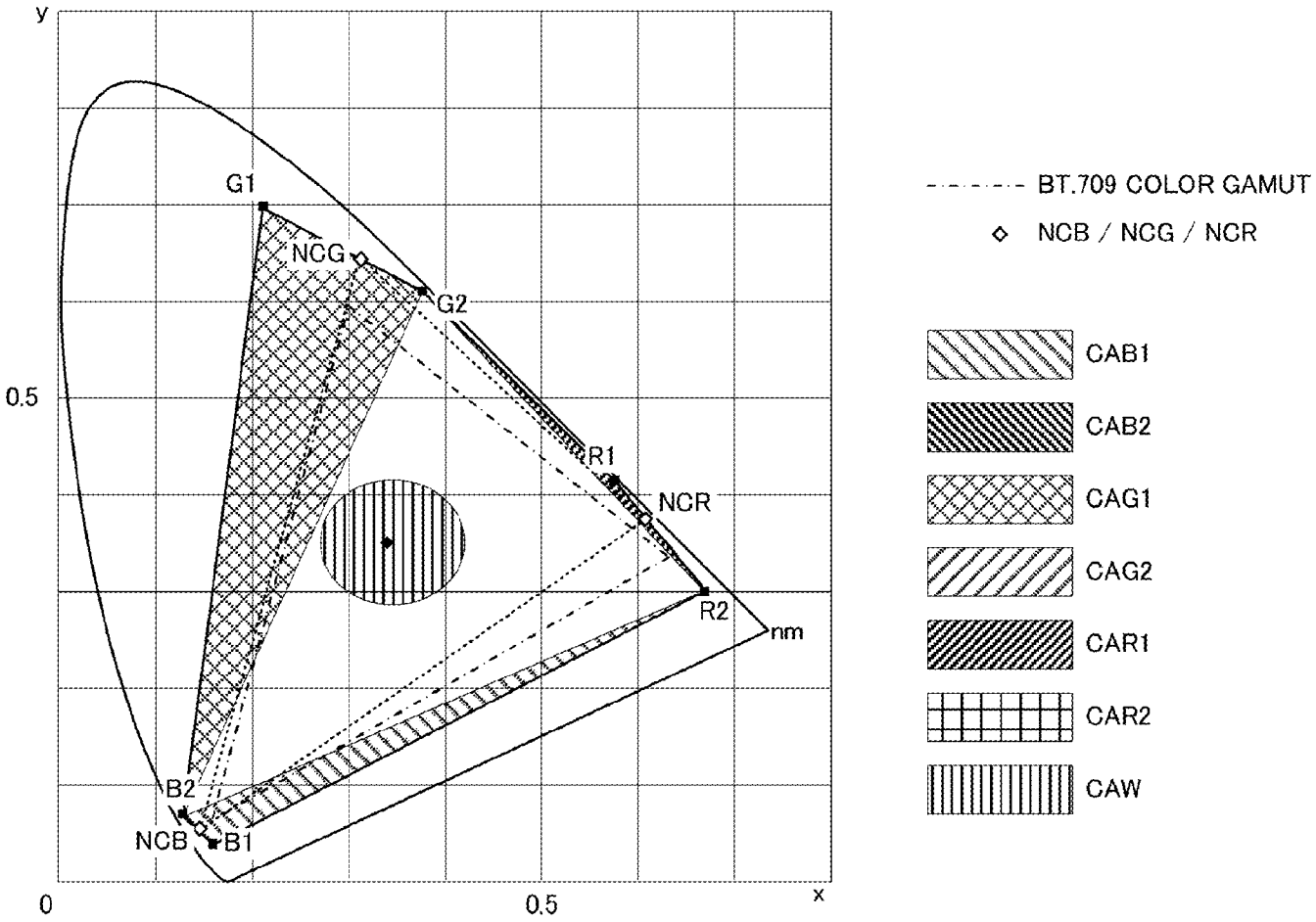
FIGS. 8A to 8D are conceptual diagrams of a color region acquired by a divisional statistics acquiring unit.
Figure 8B:
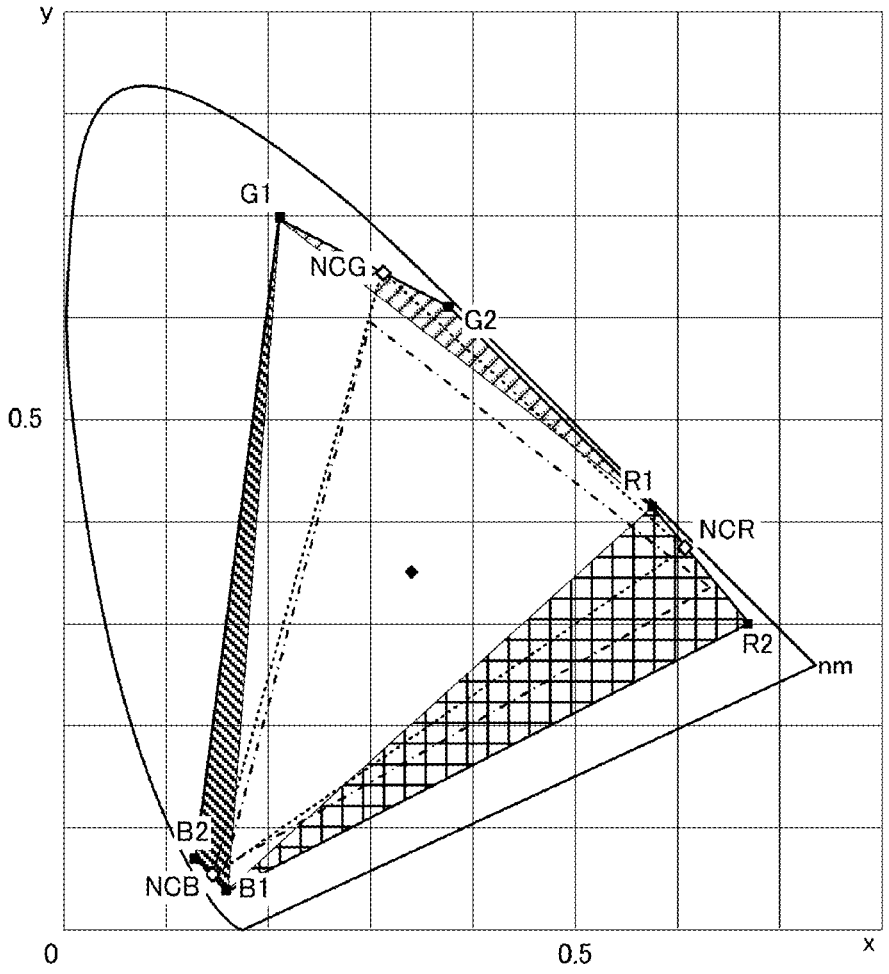
Figures 8C, 8D:
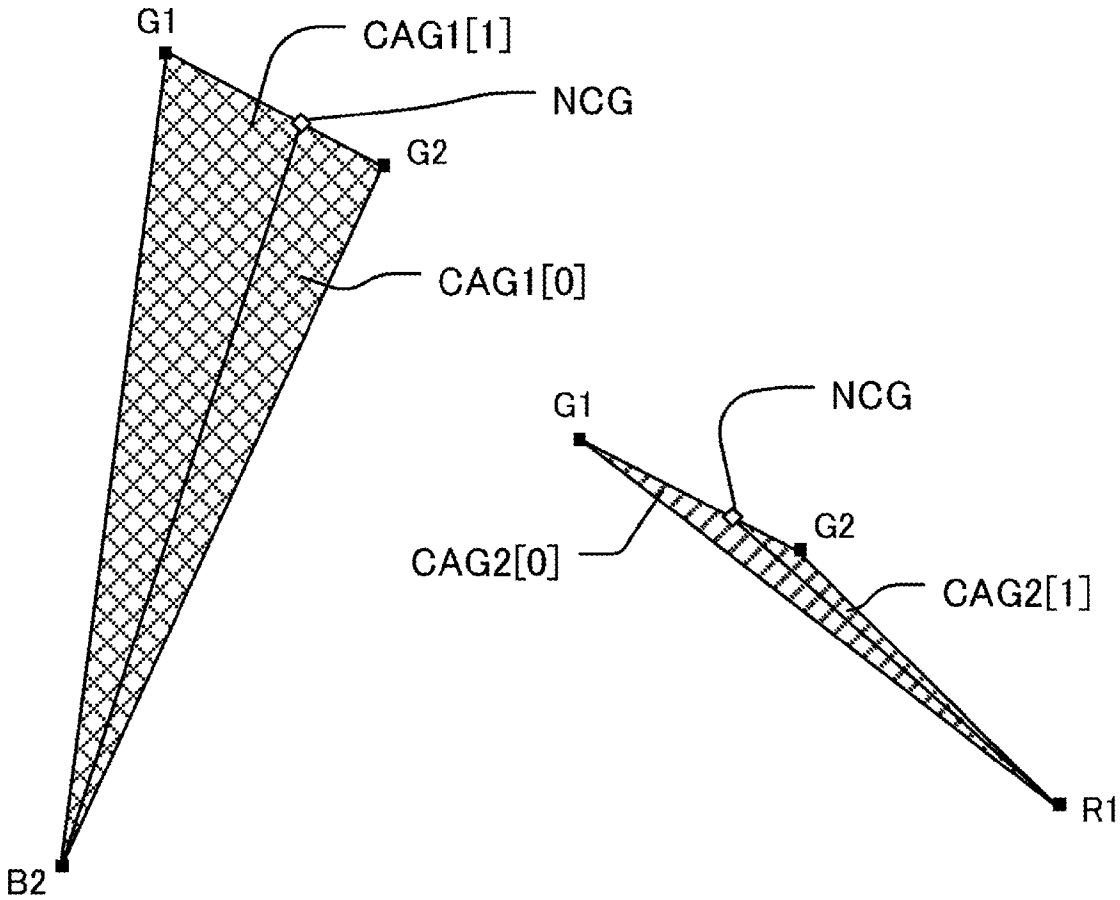

A schematic conceptual diagram of these color regions is shown in FIGS. 8A and 8B, and a detailed conceptual diagram of these color regions is shown in FIGS. 8C and 8D.

In addition, a region near a white point is denoted by CAW.

Setting this region wide promotes a reduction in individual variability in white tinge. Conversely, setting this region narrow enhances an expansion effect of a color gamut that can be displayed.

The color gamut determining unit 120 determines, for each of the color regions defined above, whether or not the xy value 111 is within the color region and sets a corresponding flag in a structure of the color gamut determination result 121. A construction of the structure of the color gamut determination result 121 is shown below.

```
{
BOOL CAB1[2];
BOOL CAB2[2];
BOOL CAG1[2];
BOOL CAG2[2];
BOOL CAR1[2];
BOOL CAR2[2];
BOOL CAW;
}CFLAG;
```

TRUE is set for a flag in a color gamut that includes the xy value 111, and FALSE is set for a flag in a color gamut that does not include the xy value 111. Since the respective regions overlap each other, there may be cases where TRUE is set for a plurality of flags at the same time.

A region determining unit 130 determines which backlight area 722 each pixel constituting the input image 1 belongs to. The input image 1 is constituted by m×n pixels. In addition, the backlight is constituted by p×q backlight areas. The respective backlight areas have equal sizes. Therefore, m/p×n/q number of pixels belong to each backlight area. A backlight area BLA (j, k) to which a pixel PX (x, y) at position (x, y) belongs to may be obtained as follows.

$$j=int(x/(m/p))$$

$$k=int(y/(n/q))$$

For example, a pixel PX (0, 0) belongs to BLA (0, 0). In addition, for example, PX (m−1, n−1) belongs to BLA (p, q). A value of (j, k) is outputted as the region determination result 131.

An accumulative adding unit 140 accumulates the color gamut determination result 121 and the region determination result 131 to calculate the divisional statistics 11. A construction of the structure of the divisional statistics 11 is shown below.

```
{
int CAB1[2];
int CAB2[2];
int CAG1[2];
int CAG2[2];
int CAR1[2];
int CAR2[2];
int CAW;
}CHIST(p, q);
```

A frequency of the color gamut determination result 121 is integrated for each backlight area. For example, when a region determination result 131 of a pixel that is a determination object is (2, 1) and only a flag of a color gamut determination result 121 CFLAG.CAR1[1] is set, 1 is added to a frequency counter CHIST(2, 1).CAR1[1] of a histogram. The divisional statistics 11 is outputted per frame. In addition, all frequencies are cleared per frame after being outputted.

Next, a method of determining the backlight lighting intensity 21 by the backlight lighting intensity determining unit 20 will be described in detail. Regarding individual variability in the appearance of color which is the problem to be solved by the present invention, it is empirically known that the lower the chroma and the greater the closeness to white of a color, the greater the individual variability of the appearance of the color. In consideration of this characteristic, in the present invention, chromaticity points of respective primary color light sources of the three RGB primary colors are set as normal primary color points in a backlight area corresponding to an image region that includes many low chroma colors. In other words, light is emitted from both of the two light-emitting diodes constituting each primary color light source of RGB at normal intensity. As a result, since the emission spectrum of each RGB color light source assumes a spectrum that is a composite of the emission spectra of two light sources having different emission characteristics, there is less fluctuation in stimulus even when color matching functions fluctuate due to individual variability and an occurrence of individual variability in the appearance of color can be suppressed. In this case, a color reproduction area in a backlight area corresponding to an image region that includes many low chroma colors is a color gamut depicted by a triangle (dashed line) in the normal color gamut that is enclosed by the normal primary color points in FIG. 7. When backlight control is performed so as to set the chromaticity points of the three primary colors as normal primary color points, even if there is a variation in color matching functions due to individual variability, perceived color can be approximately equalized and an occurrence of individual variability in color appearance can be suppressed. In the first embodiment, performing backlight control so as to reduce individual variability in the appearance of color in this manner will be referred to as an "individual variability reducing mode". In the first embodiment, in the individual variability reducing mode, since lighting intensities of the two light sources that constitute each primary color light source of the three RGB primary colors are set to the values of normal intensity described earlier, the lighting intensities assume the same lighting intensity or similar lighting intensities.

Figure 9A:
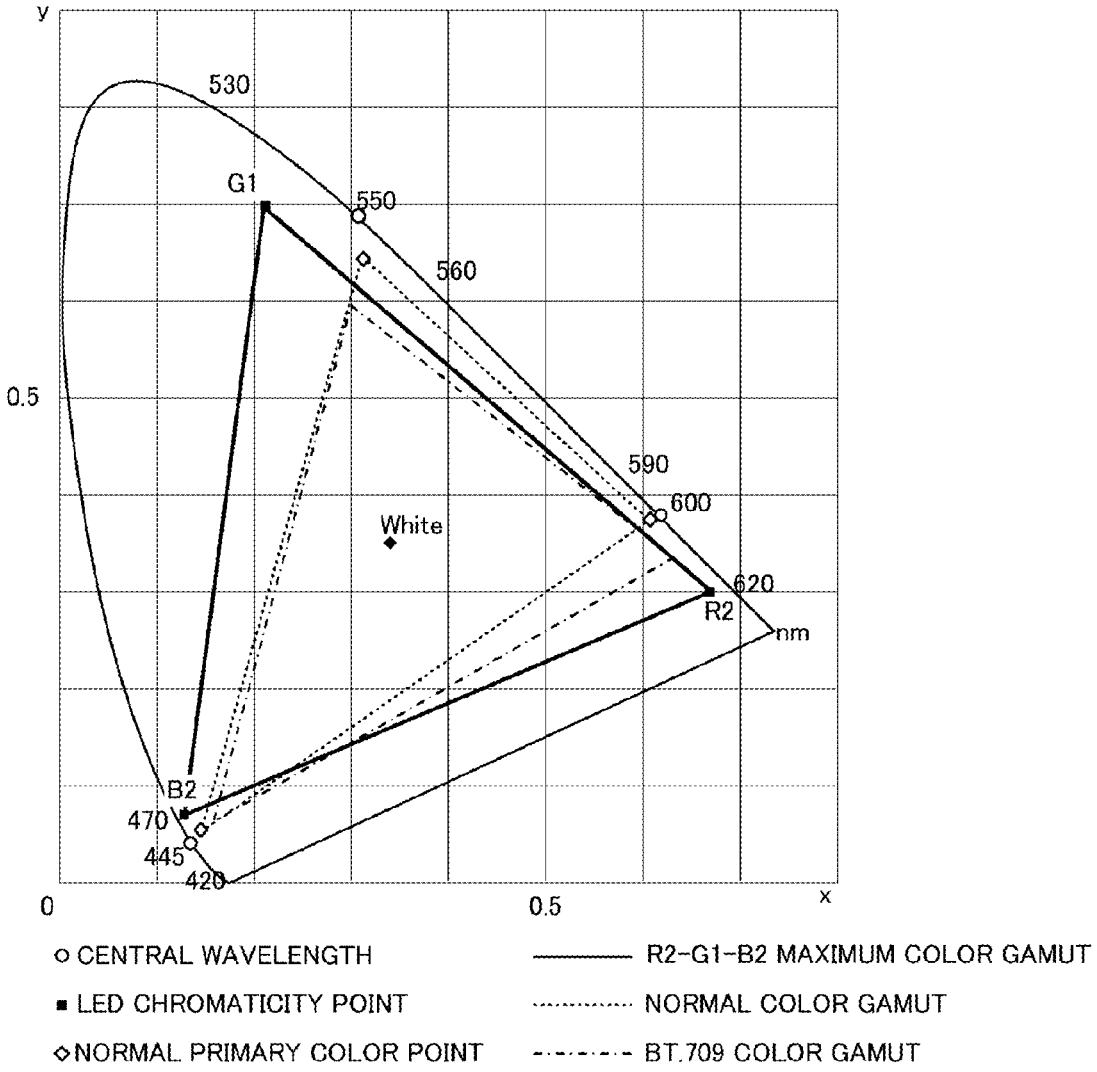
FIGS. 9A and 9B show examples of a reproduction color gamut.

Conversely, it is also known that individual variability in the appearance of a high chroma color is relatively small. In consideration of this characteristic, chromaticity points of the three RGB primary colors are set so as to expand a color gamut in a backlight area corresponding to an image region that includes many high chroma colors. For example, with a backlight area corresponding to an image region that includes many vivid blue-green and red colors, among the two light-emitting diodes constituting the respective RGB color light sources, the lighting intensities of B2, G1, and R2 are set to maximum and the lighting intensities of B1, G2, and R1 are set to 0. Accordingly, a color gamut capable of reproducing vivid blue-green and red colors can be obtained as shown in FIG. 9A.

Figure 9B:
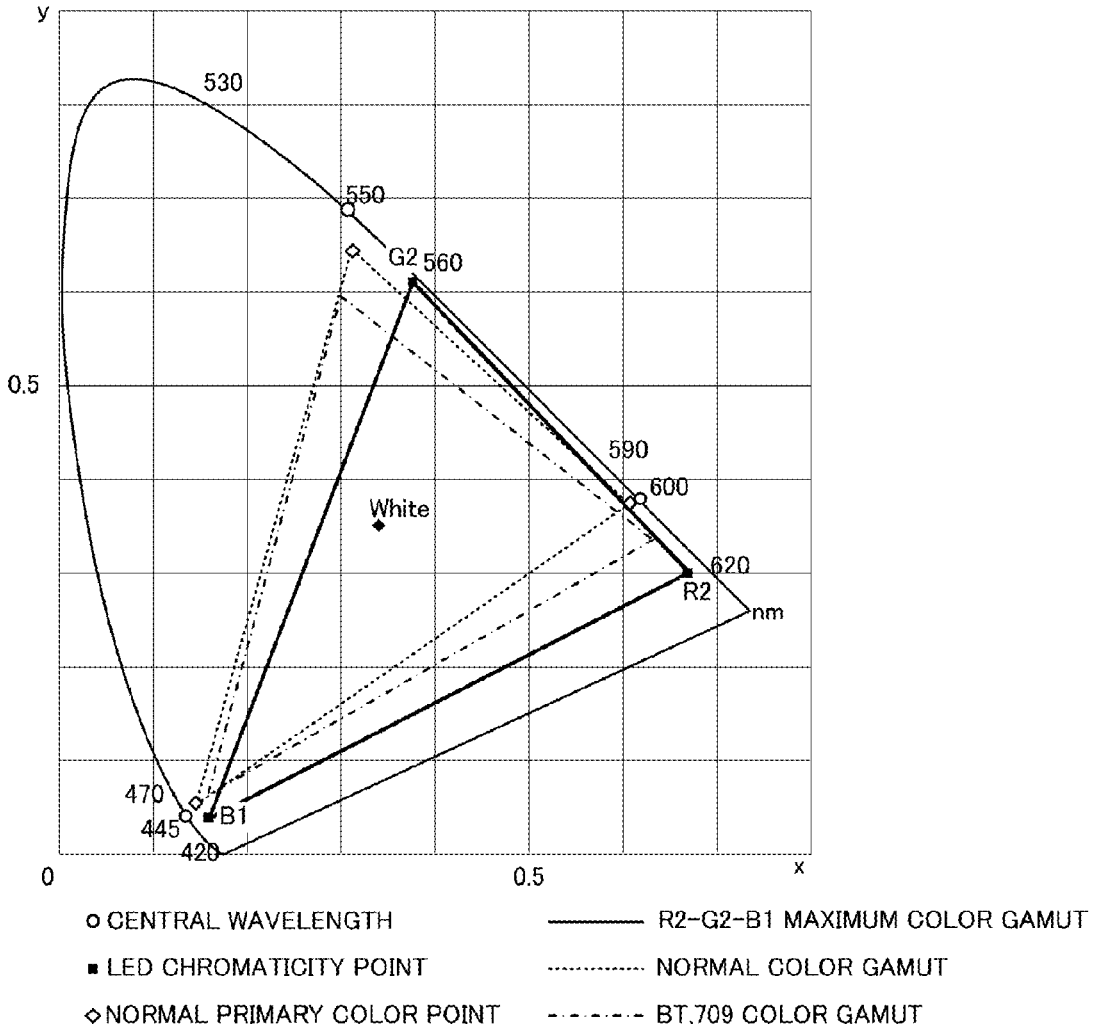

In addition, with a backlight area corresponding to an image region that includes many vivid violet and yellow colors, among the two light-emitting diodes constituting the respective RGB color light sources, the lighting intensities of B1, G2, and R2 are set to maximum and the lighting intensities of B2, G1, and R1 are set to 0. Accordingly, a color gamut capable of reproducing vivid violet and yellow colors can be obtained as shown in FIG. 9B.

In this manner, since an optimum color gamut can be set for each image region, both display in a wide color gamut due to color gamut expansion and a reduction in individual variability in the appearance of white can be achieved for the image as a whole. In the first embodiment, performing backlight control in accordance with a color distribution of an image so as to expand a display color gamut in this manner will be referred to as a "wide color gamut mode". In the first embodiment, in the wide color gamut mode, the lighting intensities of the two light sources that constitute each primary color light source of the three RGB primary colors are modified according to the chroma (color distribution) of an image.

In the first embodiment, a backlight is constituted by a plurality of backlight areas, and which of the individual variability reducing mode and the wide color gamut mode is to be applied when performing backlight control is determined for each backlight area according to statistics (color distribution, chroma, and the like) of an image of a corresponding image region. Since backlight control is performed in the individual variability reducing mode when displaying a low chroma image (an image with many white pixels) in which individual variability in color appearance is more likely to occur, the individual variability in color appearance can be reduced. Since backlight control is performed in the wide color gamut mode when displaying a high chroma image in which individual variability in color appearance is less likely to occur, a display color gamut can be expanded as compared to the individual variability reducing mode. Therefore, both a reduction in individual variability in color appearance and an expansion of a displayable color gamut can be achieved with respect to a display image as a whole. In the first embodiment, since narrow light sources are used as the two light sources that constitute each primary color light source, a high display color gamut expanding effect can be produced.

Moreover, backlight control may be performed so as to adaptively switch between the individual variability reducing mode and the wide color gamut mode depending on a color distribution of a display image, or any of the individual variability reducing mode and the wide color gamut mode may be fixed regardless of the color distribution of a display image by an instruction issued by the user. When the individual variability reducing mode is fixed, backlight control is performed in which a lighting intensity ratio of the two light sources is always fixed to a ratio determined so as to prevent the occurrence of individual variability in color appearance regardless of whether a display image is a high chroma image or a low chroma image. When the wide color gamut mode is fixed, backlight control is performed in which a lighting intensity ratio of the two light sources is changed in accordance with a color distribution of a display image regardless of whether the display image is a high chroma image or a low chroma image. In the first embodiment, an example of performing backlight control that switches between the individual variability reducing mode and the wide color gamut mode in accordance with a color distribution of a display image will be described.

Next, a specific method of determining lighting intensity of a light source will be described.

A color region CAW is a white (low chroma) region. With backlight areas in which the frequency of this region is high, the lighting intensities of light sources of all colors B1, B2, G1, G2, R1, and R2 are set to the normal lighting intensity.

Color regions CAG1 are color regions that cannot be reproduced unless the light source G1 is lighted at an appropriate intensity. Among these color regions, a color region CAG1[0] is a color region that can be reproduced if G1 and G2 emit light at the normal lighting intensity. Meanwhile, a color region CAG1[1] is a color region that cannot be reproduced unless G1 emits light at an appropriate higher intensity than the normal lighting intensity and, at the same time, G2 emits light at an appropriate lower intensity than the normal lighting intensity. In other words, when the frequency of CAG1[1] is high, G1 desirably emits light at an appropriate higher intensity than the normal lighting intensity. Conversely, when frequencies of both CAG1[0] and CAG1[1] are relatively high, it is not desirable to lower the lighting intensity of G1. In addition, the same thinking is applied to control of lighting intensities of the color regions CAG2 corresponding to G2. For example, when the number of pixels included in the color region CAG1[1] is large and the number of pixels included in the color region CAG2[0] and the color region CAG2[1] is small, the backlight lighting intensity determining unit 20 performs control so that lighting intensity of G1 is increased.

Figure 10:
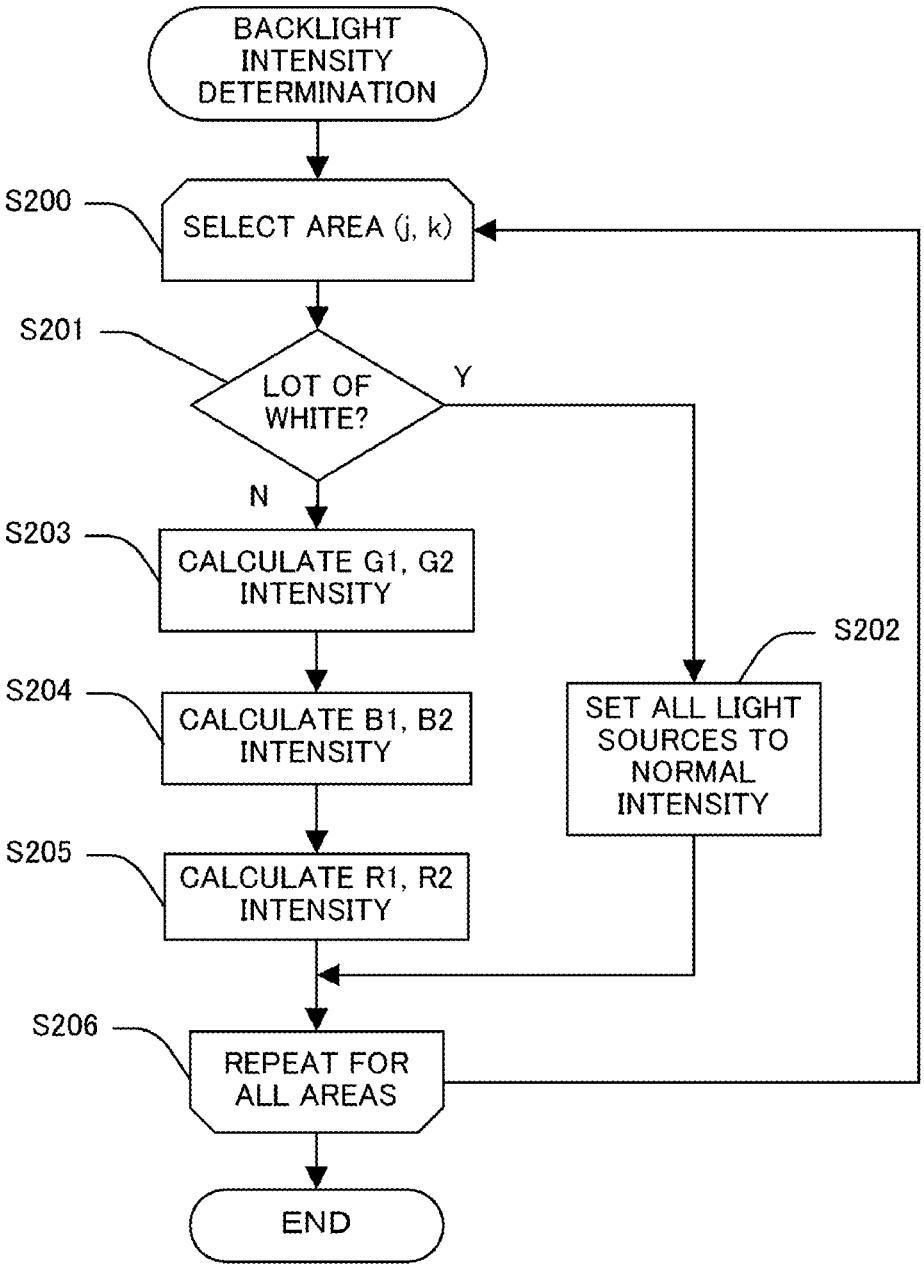
FIG. 10 is a flow chart showing a method of determining backlight lighting intensity.

FIG. 10 shows a flowchart of a method of determining the backlight lighting intensity 21 by the backlight lighting intensity determining unit 20.

Step S200 is a loop end of processing. The backlight lighting intensity determining unit 20 repeats the following steps for all backlight areas BLA (j:0 to p−1, k:0 to q−1) included in the backlight unit 72.

In step S201, the backlight lighting intensity determining unit 20 determines whether or not many white pixels are included in an image region corresponding to a backlight area that is a processing object. The backlight lighting intensity determining unit 20 acquires a frequency of white pixels included in a backlight area BLA (j, k) by referring to CHIST (j, k).CAW that is the divisional statistics 11. The backlight lighting intensity determining unit 20 compares the frequency with a white region determination threshold thW, and if $$\mathrm{CHIST}(j,k).CAW > thW$$

is satisfied, the backlight lighting intensity determining unit 20 determines that many white pixels are included in the image region (S201: Yes) and proceeds to step S202. If not or, in other words, if the frequency of white pixels is equal to or below a white region determination threshold, the backlight lighting intensity determining unit 20 determines that many white pixels are not included in the image region (S201: No) and proceeds to step S203. Inthiscase, the white region determination threshold thW is set to 30% of the number of all pixels NumBLA included in each backlight area 722. Since reducing this value increases the likelihood of being determined as a white region, operations of the image display device are tuned so as to further reduce individual variability in the appearance of color. Conversely, by increasing the value of the white region determination threshold thW, operations of the image display device are tuned so as to further expand the display color gamut.

In step S202, light sources are set so as to minimize individual variability in the appearance of color for backlight areas determined to contain many white pixels. Specifically, based on the lighting intensity in a normal state (normal lighting intensity) used in the description of the light source 721, the backlight lighting intensity determining unit 20 sets the backlight lighting intensity 21 to bl(j, k).R1=NPr1,
bl(j, k).R2=NPr2,
bl(j, k).G1=NPg1,
bl(j, k).G2=NPg2,
bl(j, k).B1=NPb1, and
bl(j, k).B2=NPb2.

In step S203, the backlight lighting intensity determining unit 20 calculates lighting intensities of the light sources G1 and G2. The backlight lighting intensity determining unit 20 performs the calculation by the following procedure using the divisional statistics 11: CHIST (j, k) corresponding to the backlight area (j, k) that is a processing object.

An index NEG1 of the number of pixels having a color coordinate that is highly dependent on the light source G1 is defined as $$NEG1=CAG1[1]-(CAG2[0]+CAG2[1]),$$

where $$NEG1=0 \text{ when } CAG1[1]<CAG2[0]+CAG2[1].$$

In a similar manner, an index NEG2 regarding the light source G2 is defined as $$NEG2=CAG2[1]-(CAG1[0]+CAG1[1]),$$

where $$NEG2=0 \text{ when } CAG2[1]<CAG1[0]+CAG1[1].$$

Using these indexes and the number of all pixels NumBLA included in each backlight area 722, the lighting intensities of G1 and G2 are calculated as $$BpG=ExC\cdot(NEG1-NEG2)/NumBLA, \text{ where}$$

$$BpG=-1 \text{ when } ExC\cdot(NEG1-NEG2)/NumBLA<-1,$$

$$BpG=1 \text{ when } ExC\cdot(NEG1-NEG2)/NumBLA>1,$$

$$bl(j,k).G1=NPg1\cdot(1+BpG), \text{ and}$$

$$bl(j,k).G2=NPg2\cdot(1-BpG),$$

where ExC is a constant for setting sensitivity toward expanding a color gamut and has a standard value of 1. Increasing this value causes operations of the image display device to be tuned so as to further expand the display color gamut.

In step S204, the backlight lighting intensity determining unit 20 calculates lighting intensities of the light sources B1 and B2. The backlight lighting intensity determining unit 20 calculates a lighting intensity bl (j, k).B1 of the light source B1 and a lighting intensity bl (j, k).B2 of the light source B2 by a procedure similar to that of step S203.

In step S205, the backlight lighting intensity determining unit 20 calculates lighting intensities of the light sources R1 and R2. The backlight lighting intensity determining unit 20 calculates a lighting intensity bl (j, k).R1 of the light source R1 and a lighting intensity bl (j, k).R2 of the light source R2 by a procedure similar to that of step S203.

In step S206, the backlight lighting intensity determining unit 20 determines whether or not a light source intensity calculating process has been completed for all backlight areas 722. If so, the backlight lighting intensity determining unit 20 terminates processing for determining backlight lighting intensity. If not, the backlight lighting intensity determining unit 20 returns to step S200.

Figure 11A:
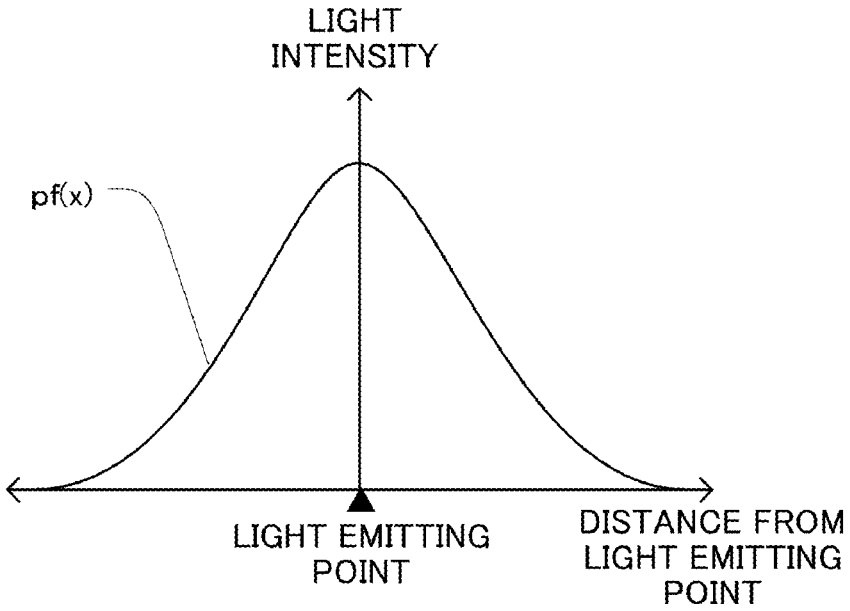
FIGS. 11A and 11B are conceptual diagrams of a backlight light intensity distribution.
Figure 11B:
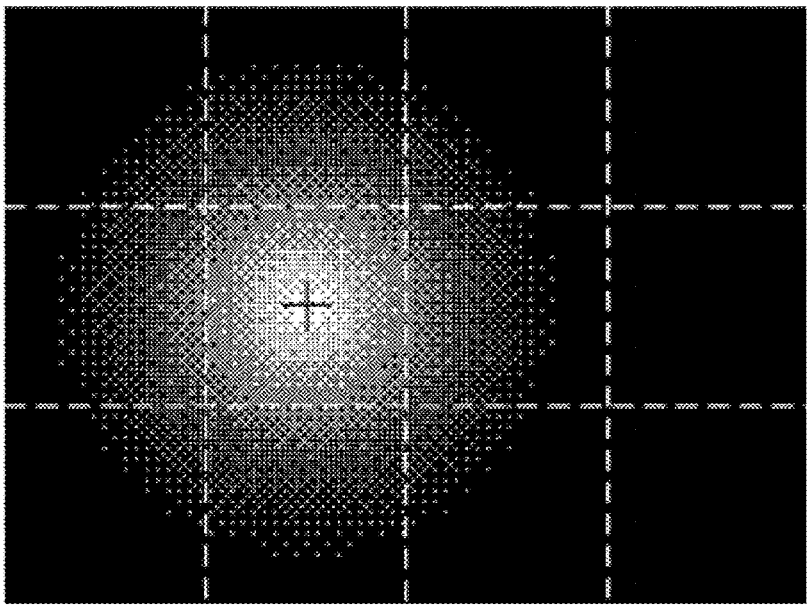

Next, a method of estimating the backlight light intensity distribution 31 by the backlight light intensity distribution estimating unit 30 will be described in detail. A light source which has a predetermined spread arranged on a diffuser plate (not shown) is formed due to light emitted from the light source 721 being spread by the diffuser plate. The backlight light intensity distribution 31 that represents a degree of the spread is determined based on emission characteristics of the light source 721, characteristics of the diffuser plate, a distance between the light source 721 and the diffuser plate, and the like. As desirable spread characteristics, the inside of the backlight area 722 is uniformly irradiated and only a small amount of light leaks to adjacent backlight areas 722. FIG. 11A shows a conceptual diagram of characteristics of the backlight light intensity distribution 31 that is formed on the diffuser plate when the light source 721 is independently lighted. In addition, FIG. 11B shows an imaginary picture of the backlight light intensity distribution that is formed on the diffuser plate in this case. A function pf (x) of characteristics of light intensity decreasing in a concentric manner depending on a distance from a light emitting point is to be obtained in advance by measurement using the backlight unit 72.

Figure 12A:
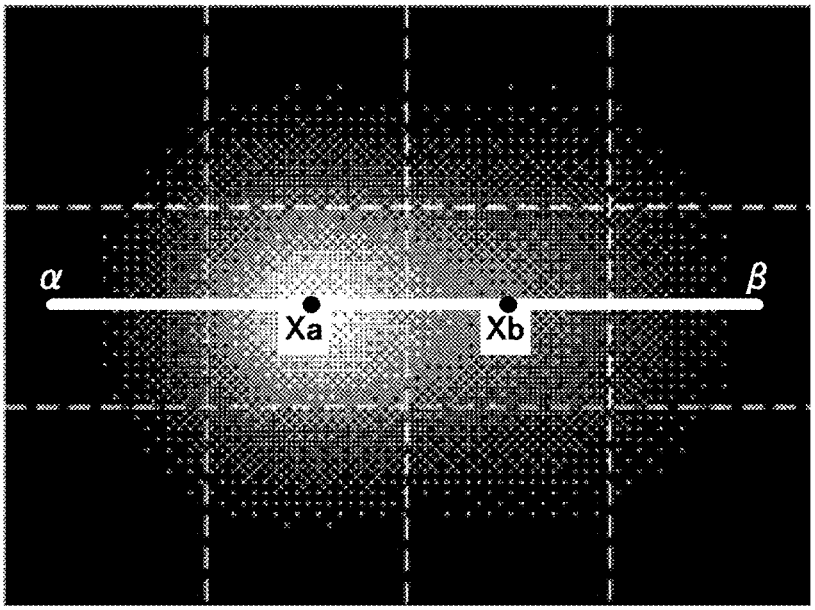
FIGS. 12A and 12B are conceptual diagrams of a backlight light intensity distribution when a plurality of backlights are being lighted.
Figure 12B:
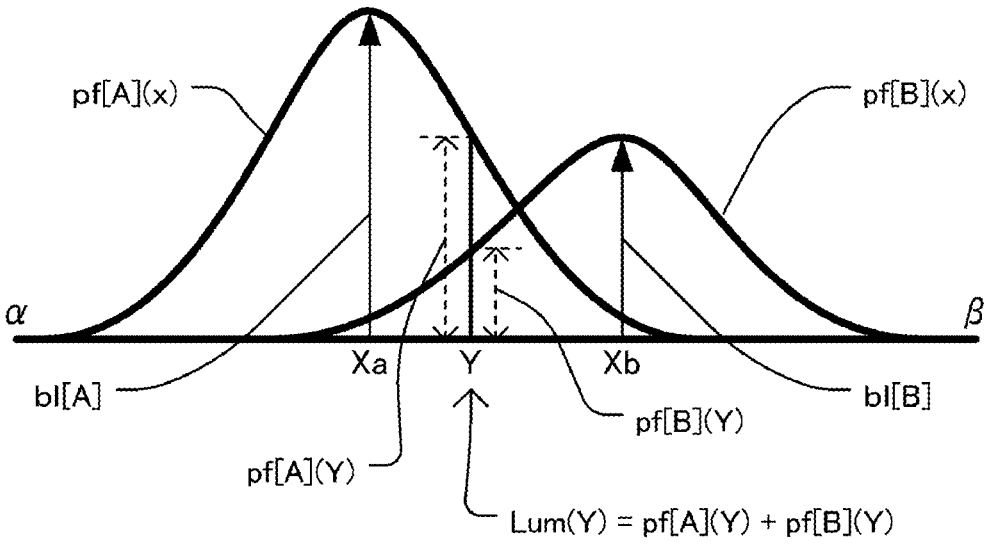

Next, a situation where a plurality of light sources are lighted due to light being respectively emitted by the light sources 721 of adjacent backlight areas 722 will be described. Let us assume that the light sources emitting light are light-emitting diodes A and B. FIG. 12A shows an imaginary picture of this situation. FIG. 12B shows a conceptual diagram of characteristics of the backlight light intensity distribution 31 corresponding to a range between point α and point β shown in FIG. 12A. Points Xa and Xb denote light emitting points of the light-emitting diodes A and B, bl[A] and bl[B] denote respective lighting intensities of the light-emitting diodes A and B, and pf[A](x) and pf[B](x) denote respective light source light intensity distributions of the light-emitting diodes A and B. Since light intensity Lum (Y) at a given point Y conceivably represents an overlap of light intensity to which the light-emitting diode A contributes and light intensity to which the light-emitting diode B contributes, it is estimated that $$Lum(Y)=pf[A](Y)+pf[B](Y)$$

is satisfied. In other words, a backlight light intensity distribution formed on the backlight unit 72 is an overlap of individual light source light intensity distributions of all light sources.

Next, the concept described above will be generalized in conformance with the first embodiment. Let us assume that a pixel coordinate of the liquid crystal panel unit 71 corresponding to a location where the light source 721: BL (j, k) is arranged on the backlight unit 72 is expressed as (BLpX(j, k), BLpY(j, k)). In addition, let pf (x, y) denote a light source light intensity distribution of each individual light source. Using the above, a backlight light intensity distribution 31: BLpf (x, y).R1 with respect to the light source R1 at a point represented by a pixel coordinate (x. y) may be calculated as Expression 8.

$$BLpf(x,y).R1=\Sigma_{j,k}\{bl(j,k).R1\cdot pf(x-BLpX(j,k),y-BLpY(j,k))\} \quad \text{[Expression 8]}$$

The backlight light intensity distributions 31 with respect to the light sources R2, G1, G2, B1, and B2 may be similarly calculated as Expression 9.

$$BLpf(x, y)\cdot R2 = \sum_{j,k}\{bl(j, k)\cdot R2\cdot pf(x - BLpX(j, k), y - BLpY(j, k))\}$$

$$BLpf(x, y)\cdot G1 = \sum_{j,k}\{bl(j, k)\cdot G1\cdot pf(x - BLpX(j, k), y - BLpY(j, k))\}$$

$$BLpf(x, y)\cdot G2 = \sum_{j,k}\{bl(j, k)\cdot G2\cdot pf(x - BLpX(j, k), y - BLpY(j, k))\}$$

$$BLpf(x, y)\cdot B1 = \sum_{j,k}\{bl(j, k)\cdot B1\cdot pf(x - BLpX(j, k), y - BLpY(j, k))\}$$

$$BLpf(x, y)\cdot B2 = \sum_{j,k}\{bl(j, k)\cdot B2\cdot pf(x - BLpX(j, k), y - BLpY(j, k))\}$$

[Expression 9]

Next, a method of calculating the backlight chromaticity 41 by the backlight chromaticity calculating unit 40 will be described in detail.

First, for each light-emitting diode constituting the respective RGB color light sources, an XYZ chromaticity coordinate when lighting intensity (NPr1, NPr2, NPg1, NPg2, NPb1, and NPb2) is set to 1.0 is obtained in advance. The XYZ chromaticity coordinate is obtained in advance by actually measuring the backlight unit 72 or calculated in advance from wavelength light emission characteristics acquired from a data sheet of a component. The XYZ chromaticity coordinate of a light source is retained in the following structure that constitutes arrays of the indexes of R1, R2, G1, G2, B1, and B2.

```
{
double X;
double Y;
double Z;
}OrgXYZ[R1/R2/G1/G2/B1/B2];
```

For example, a Y value of the light source G1 may be referred to by OrgXYZ[G1].Y.

The backlight chromaticity 41 is represented by an XYZ chromaticity coordinate

```
{
double X;
double Y;
double Z;
}B1XYZ(m, n)[R/G/B];
```

of each RGB pixel of the liquid crystal panel unit 71. A backlight chromaticity 41: BlXYZ(x, y)[R] of red R is obtained with respect to the two light sources R1 and R2 that constitute the light source of the color R as an overlap of products of backlight light intensity and an XYZ chromaticity value of the light sources at each pixel position.

$$BlXYZ(x,y)[R].X=BLpf(x,y).R1\cdot OrgXYZ[R1].X+BLpf(x,y).R2\cdot OrgXYZ[R2].X$$

$$BlXYZ(x,y)[R].Y=BLpf(x,y).R1\cdot OrgXYZ[R1].Y+BLpf(x,y).R2\cdot OrgXYZ[R2].Y$$

$$BlXYZ(x,y)[R].Z=BLpf(x,y).R1\cdot OrgXYZ[R1].Z+BLpf(x,y).R2\cdot OrgXYZ[R2].Z$$

(the same applies to G and B).

Figure 1C:
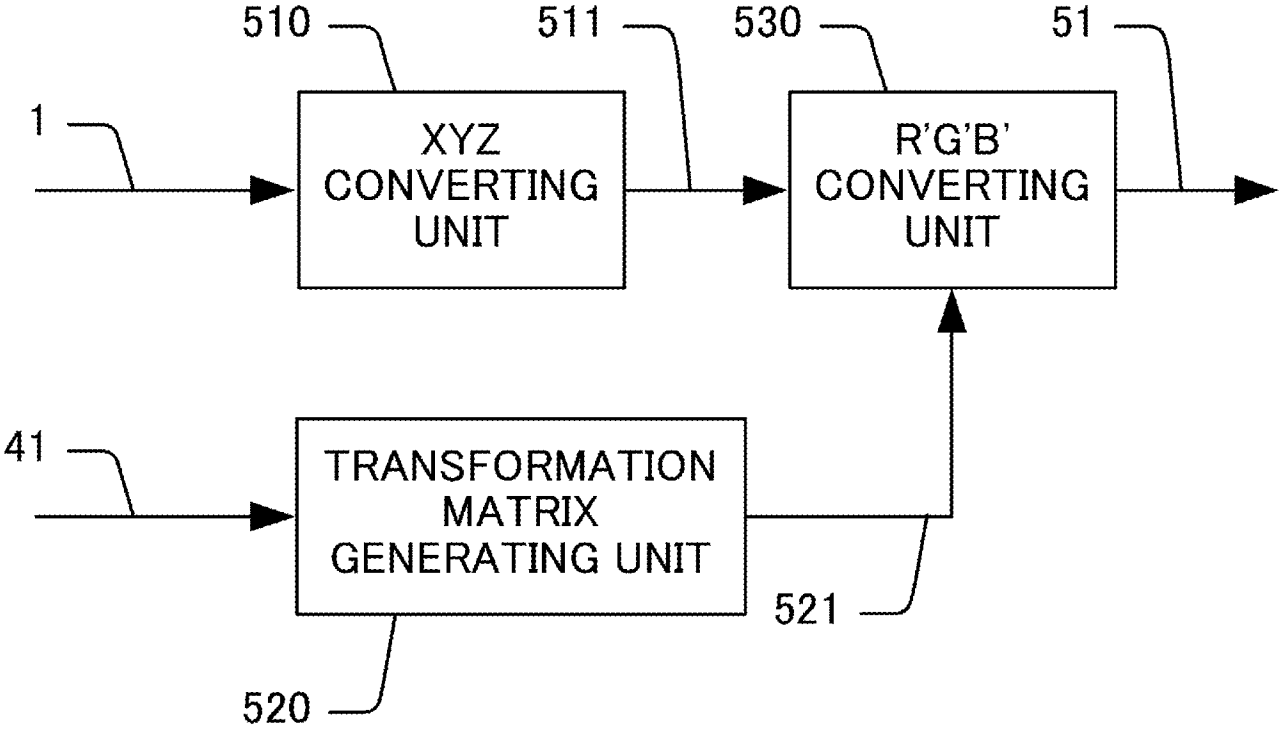

Next, a method of calculating the corrected pixel value 51 by the pixel value correcting unit 50 will be described in detail. FIG. 1C shows a configuration diagram of the pixel value correcting unit 50.

An XYZ converting unit 510 converts an RGB value of each pixel of the input image 1 into a pixel value in an XYZ color system. When a color gamut assumed by the input image 1 is sRGB, based on the definition of the CIE1931 color system, a conversion procedure is as described below.

First, the RGB value of the input image 1 is subjected to inverse γ conversion.

$$LR = \begin{cases} \dfrac{R}{12.92} & R < 0.040450 \\ \left(\dfrac{R + 0.055}{1.055}\right)^{2.4} & R \geqq 0.040450 \end{cases}$$

[Expression 11]

(the same applies to LG and LB).

Next, an sRGB→XYZ transformation matrix is multiplied to obtain an input XYZ value 511: PxXYZ.

$$\begin{pmatrix} PxXYZ\cdot X \\ PxXYZ\cdot Y \\ PxXYZ\cdot Z \end{pmatrix} = \begin{pmatrix} 0.4124 & 0.3576 & 0.1805 \\ 0.2126 & 0.7152 & 0.0722 \\ 0.0193 & 0.1192 & 0.9505 \end{pmatrix}\begin{pmatrix} LR \\ LG \\ LB \end{pmatrix}$$

[Expression 12]

A transformation matrix generating unit 520 generates an inverse transformation matrix 521 that converts the backlight chromaticity 41: BlXYZ of each pixel from XYZ to R'G'B' based on the definition of the CIE1931 color system. Since the inverse transformation matrix 521: iM is an inverse matrix of a matrix of the XYZ value of the RGB light sources, $$iM = \begin{pmatrix} blXYZ[R]\cdot X & blXYZ[G]\cdot X & blXYZ[B]\cdot X \\ blXYZ[R]\cdot Y & blXYZ[G]\cdot Y & blXYZ[B]\cdot Y \\ blXYZ[R]\cdot Z & blXYZ[G]\cdot Z & blXYZ[B]\cdot Z \end{pmatrix}^{-1}$$

[Expression 13]

is obtained.

An R'G'B' converting unit 530 calculates the corrected pixel value 51 from the input XYZ value 511 and the inverse transformation matrix 521. An R'G'B' value of the corrected pixel value 51 may be obtained by Expression 14.

$$\begin{pmatrix} R' \\ G' \\ B' \end{pmatrix} = iM\begin{pmatrix} PxXYZ\cdot X \\ PxXYZ\cdot Y \\ PxXYZ\cdot Z \end{pmatrix}$$

[Expression 14]

According to the configurations and the procedures described above, an image display device that achieves both a reduction in individual variability in the appearance of color and an expansion of a display color gamut using an optical modulator of three primary colors can be constructed.

Second Embodiment

A second embodiment will now be described in which the present invention is applied to an image display device having an enhanced effect of expanding a color gamut due to the use of a laser light source with narrow wavelength characteristics as a light source. In the second embodiment, a description will be given on how configuring only a primary color light source in which individual variability in the appearance of color is likely to occur with a plurality of light sources enables such individual variability in the appearance of color to be suppressed while simplifying system configuration.

A configuration of the image display device according to the second embodiment of the present invention is approximately similar to that of the image display device according to the first embodiment.

In the second embodiment, a laser light source is used as the light source 721. While the laser is preferably a semiconductor laser, a wavelength converting layer such as a diode pumping solid-state laser (DPSS) may be used. In the second embodiment, emission peak wavelengths of the respective light sources are set to $\lambda b=420$ nm, $\lambda g1=510$ nm, $\lambda g2=560$ nm, and $\lambda r=630$ nm.

In addition, relative lighting intensities of the respective light sources in a normal state are set to NPb=1.0, NPg1=1.0, NPg2=1.0, and NPr=1.0.

Figure 13A:
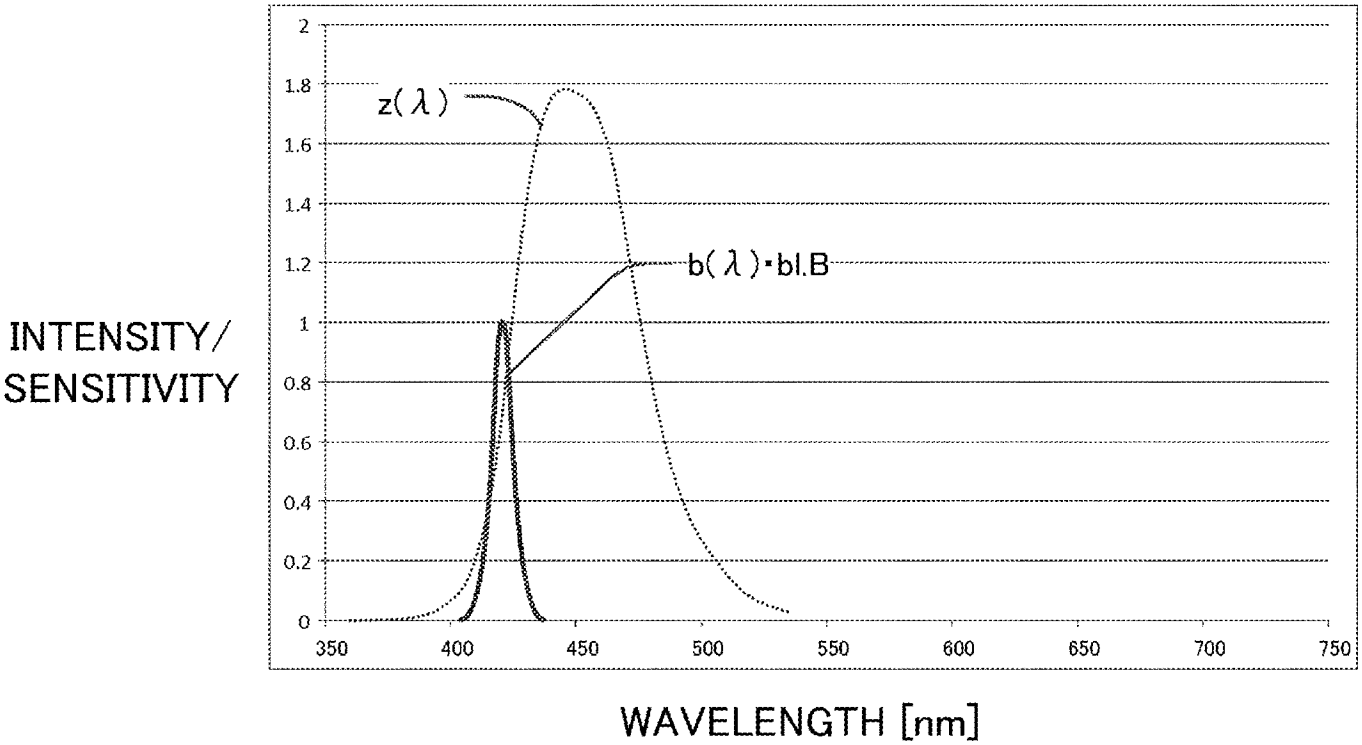
FIGS. 13A to 13C are diagrams showing relationships between characteristics of light sources selected in a second embodiment and color matching functions.
Figure 13B:
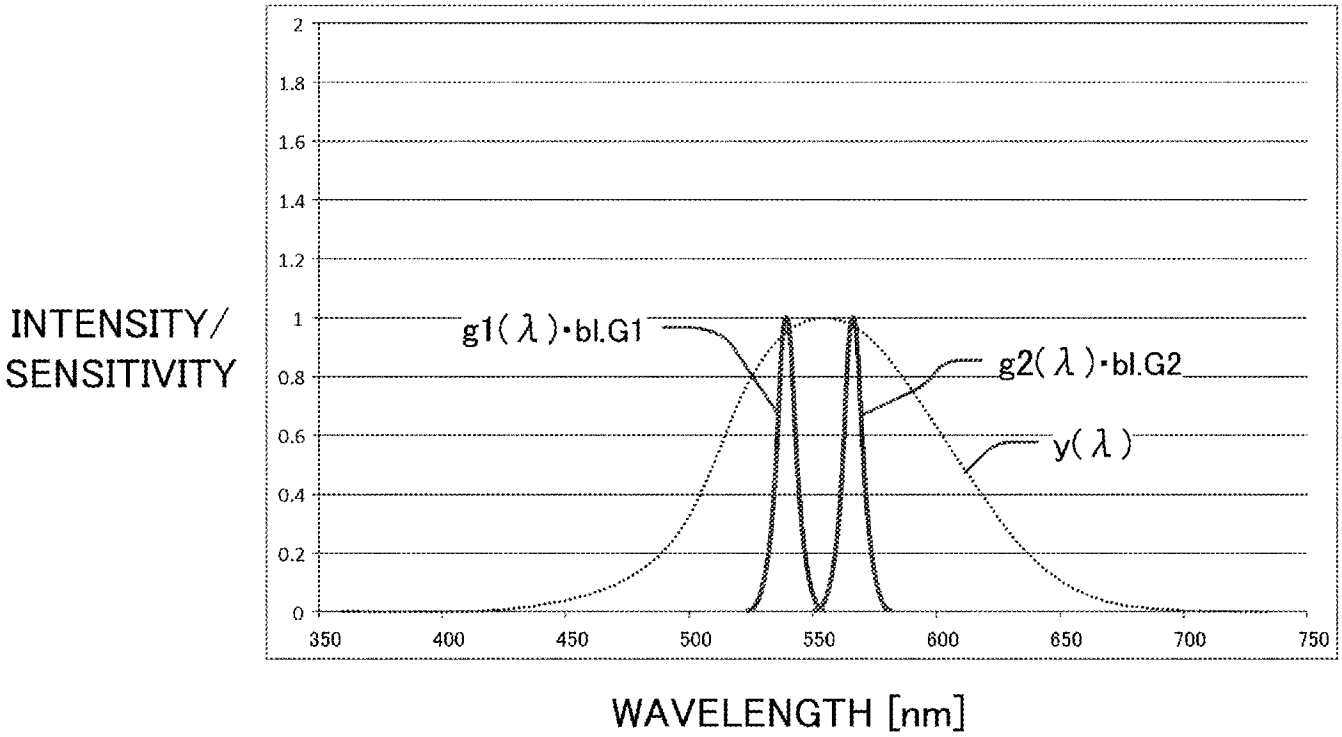
Figure 13C:
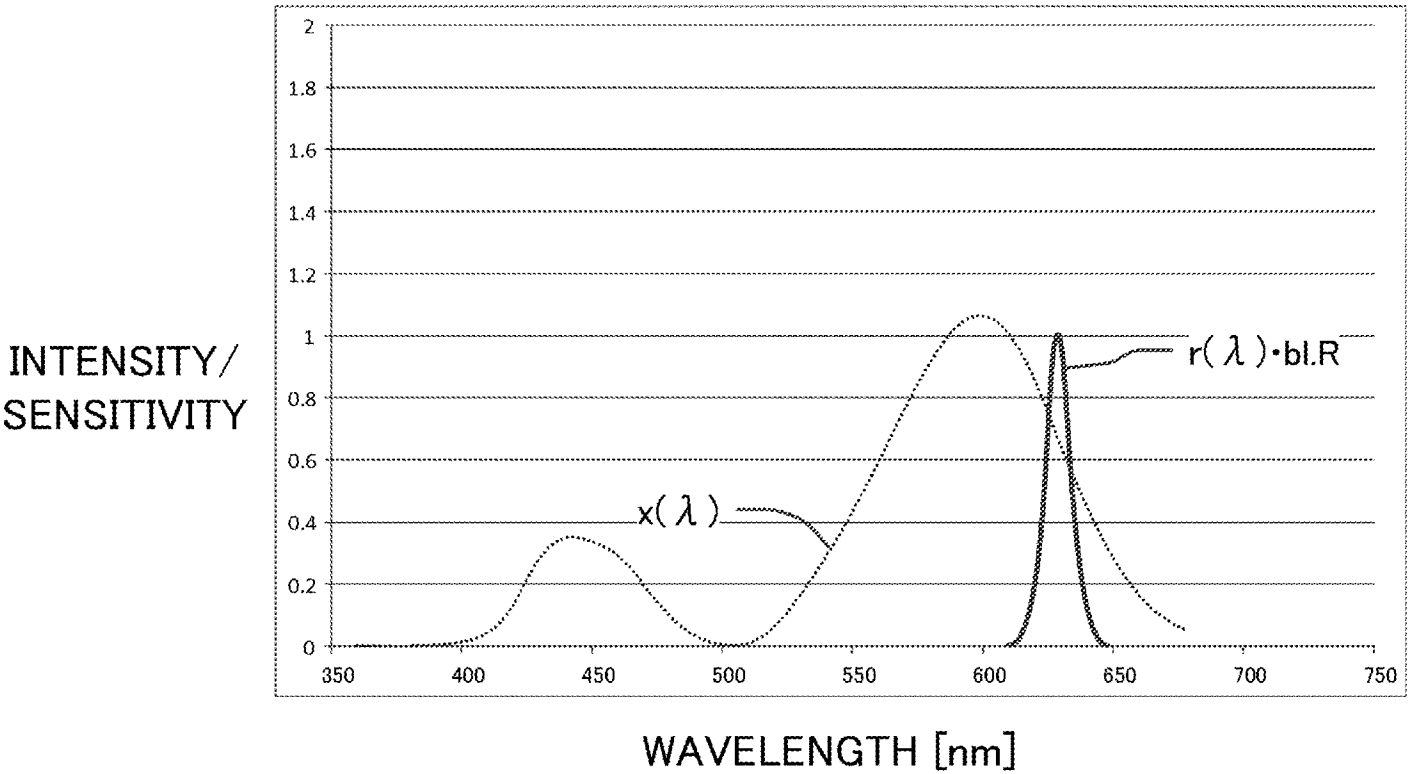
Figure 14A:
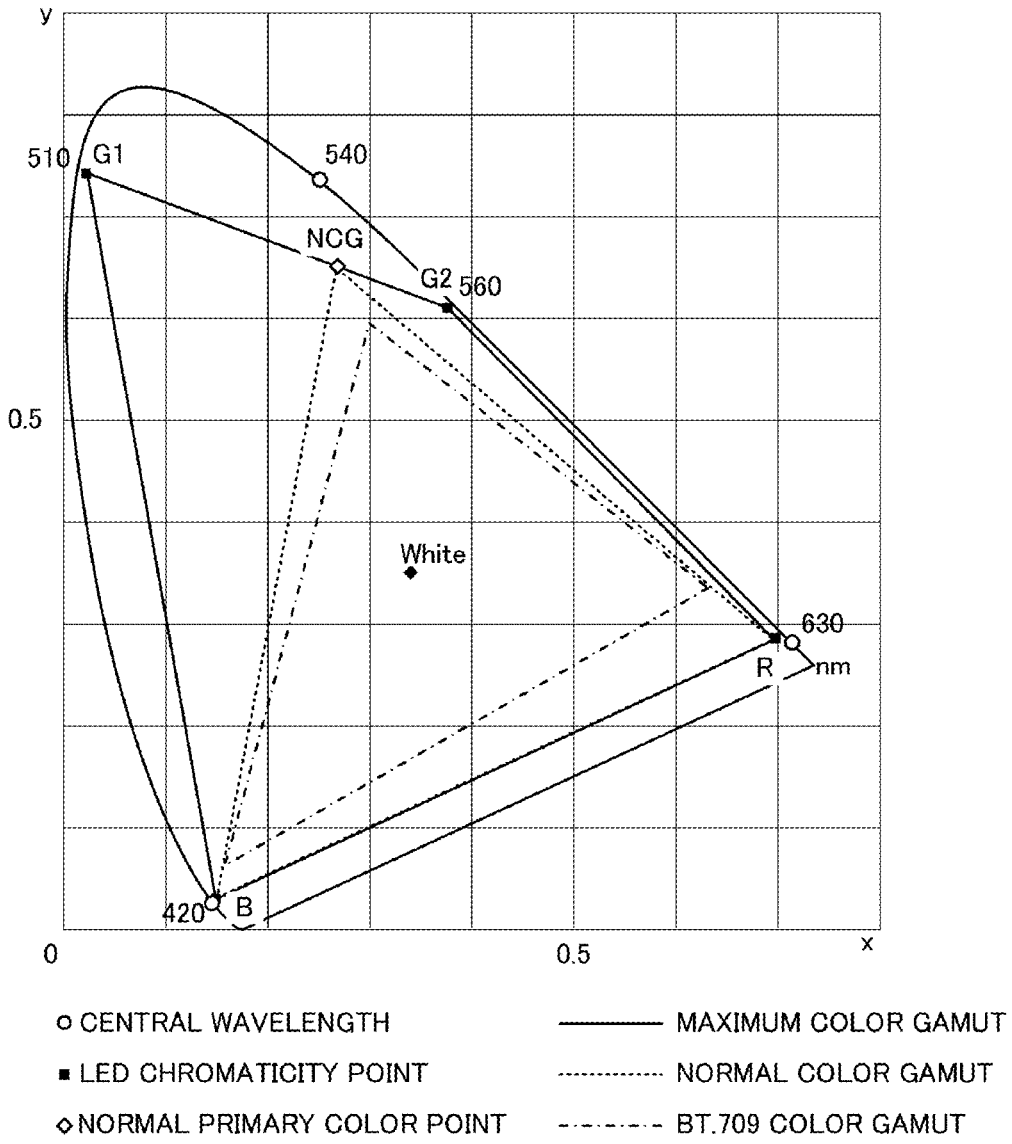
FIGS. 14A and 14B show a displayable color gamut and a color region acquired by a divisional statistics acquiring unit according to the second embodiment.

FIG. 13 is a diagram showing a relationship between characteristics of light sources selected in the second embodiment and color matching functions. In addition, FIG. 14A is a chromaticity diagram showing a color gamut that can be displayed by the image display device according to the second embodiment. Since single light sources are used as the blue and red light sources, four light sources of R, G1, G2, and B are used. A maximum color gamut that can be displayed is a color gamut enclosed by the four color origins. In addition, a color gamut enclosed by R, NCG, and B is a color gamut that is less affected by individual variability in color matching functions.

Figure 14B:
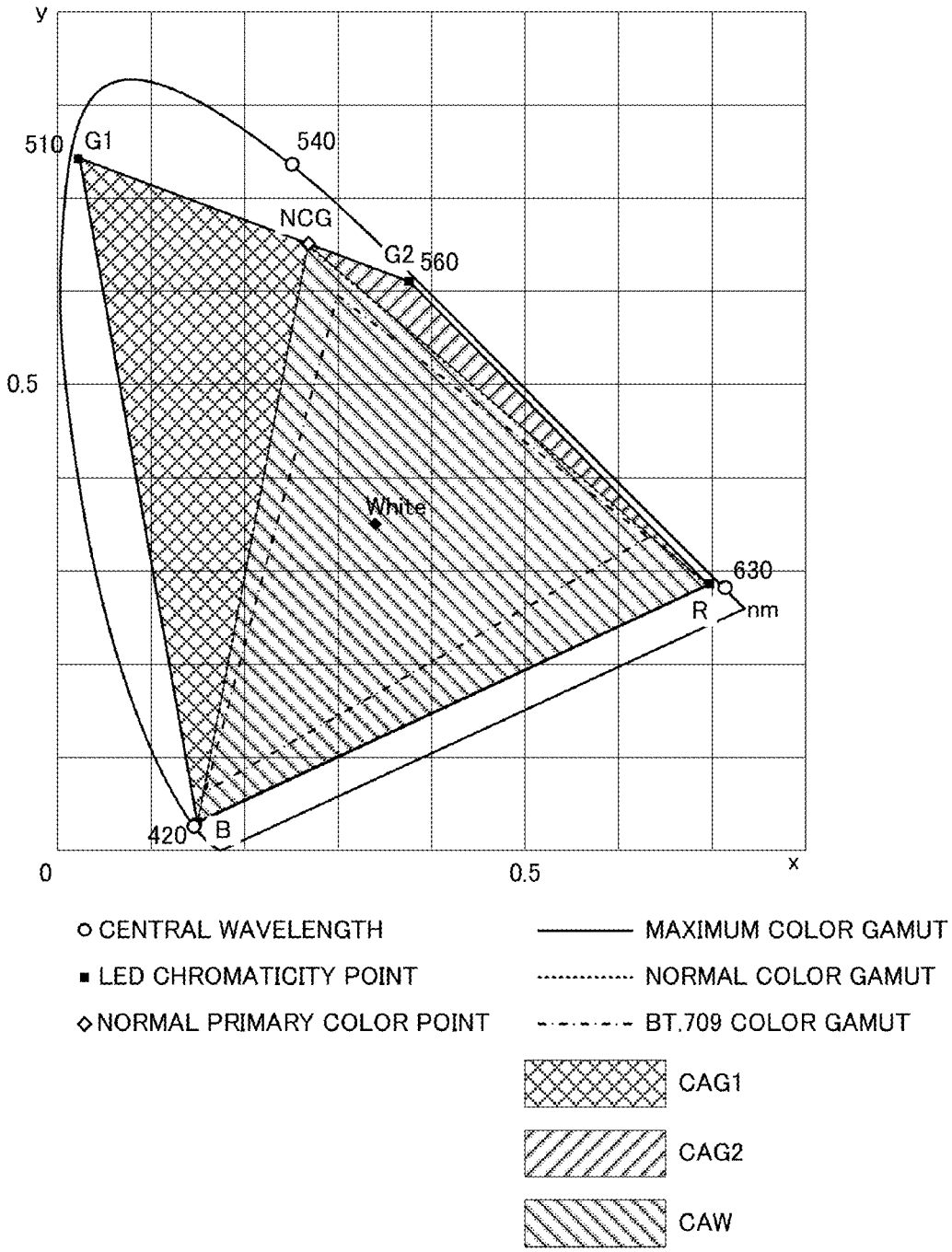

FIG. 14B shows a color region acquired by the divisional statistics acquiring unit 10 according to the second embodiment. A color region enclosed by the respective chromaticity points of {G1, B, and NCG} is denoted by CAG1, a color region enclosed by the respective chromaticity points of {G2, R, and NCG} is denoted by CAG2, and a color region enclosed by the respective chromaticity points of {NCG, B, and R} is denoted by CAW.

In a similar manner to the first embodiment, for each backlight area, the divisional statistics acquiring unit 10 counts pixels with a chromaticity belonging to the respective color regions described above and stores the count as divisional statistics 11 in a histogram structure shown below.

```
{
int CAG1;
int CAG2;
int CAW;
}CHIST(p, q);
```

The backlight lighting intensity determining unit 20 calculates lighting intensities of the light sources G1 and G2 by the following calculation procedure.

$$BpG=ExC\cdot(CAG1-CAG2)/CAW, \text{ where}$$

$$BpG=-1 \text{ when } ExC\cdot(CAG1-CAG2)/CAW<-1,$$

$$BpG=1 \text{ when } ExC\cdot(CAG1-CAG2)/CAW>1,$$

$$bl(j,k).G1=NPg1\cdot(1+BpG), \text{ and}$$

$$bl(j,k).G1=NPg2\cdot(1-BpG).$$

In addition, since the red and blue light sources in the second embodiment are single light sources, $$bl(j,k).R=1.0$$

$$bl(j,k).B=1.0$$

are satisfied. Other configurations and procedures are similar to those of the first embodiment.

According to the configurations and the procedures described above, the present invention can be implemented using a plurality of laser light sources for only a part of the light sources and using a simple calculation method.

According to the second embodiment, the use of laser light sources enables a color gamut that can be displayed on a display device to be significantly widened. In addition, by combining light sources of a plurality of wavelengths for only a part of the primary colors, individual variability in color appearance can be improved to an accuracy that is conceivably required for practical purposes at low cost. Furthermore, the use of a simple calculation method enables the image display device to be configured at low cost.

In addition, by appropriately combining and modifying the configuration described in the first embodiment and the configuration described in the second embodiment, light sources with different emission characteristics and light sources based on different principles can be used. For example, the present invention can also be implemented with a configuration using an organic EL element or the like as a light source.

Furthermore, depending on the intended use of the image display device, the number of divisions of the backlight area can be changed and the method of calculating lighting intensities of the light sources can be modified.

Third Embodiment

A third embodiment will now be described in which the present invention is applied to a projector device that projects an image on a screen.

Figure 15A:
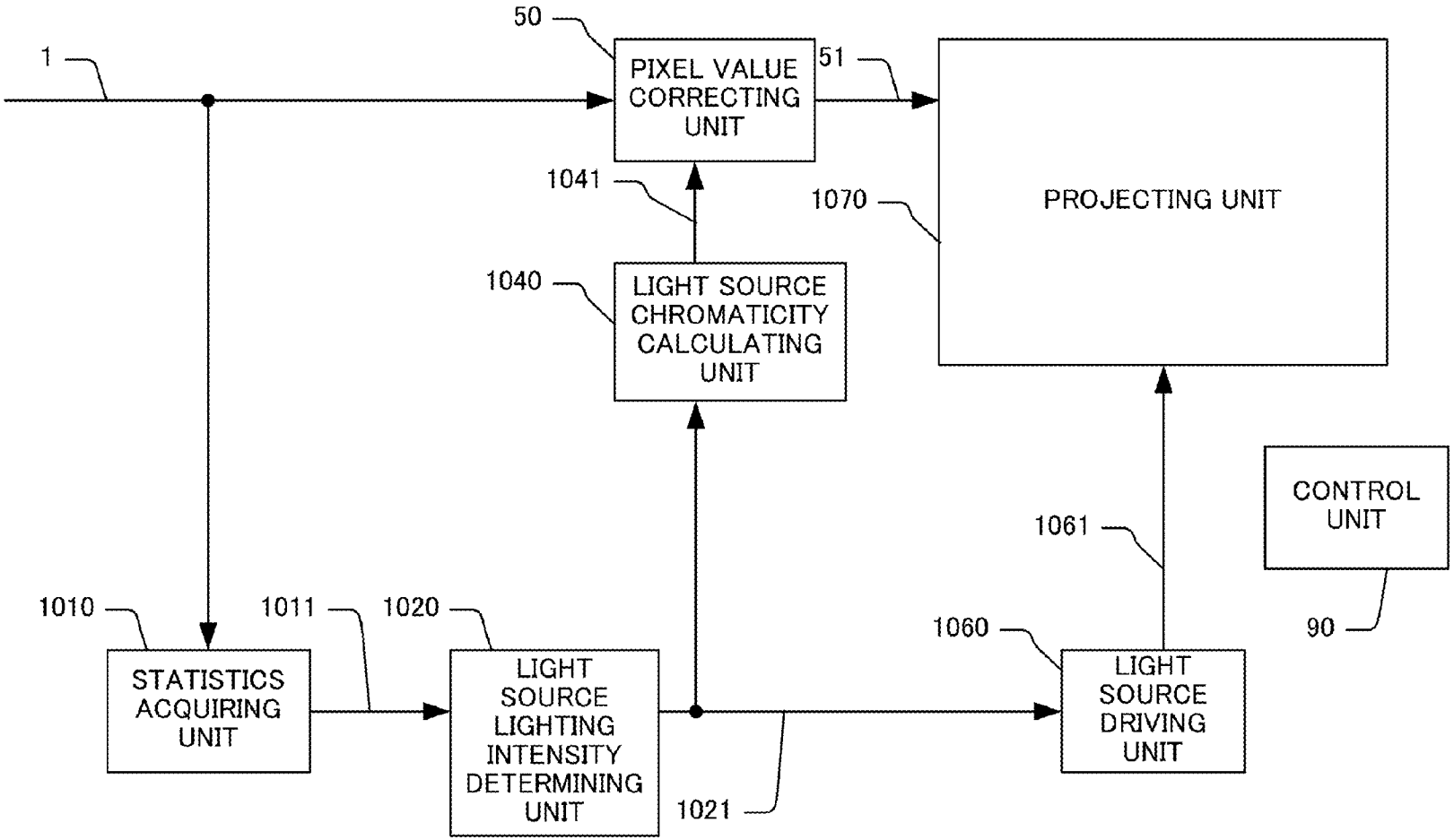
FIGS. 15A and 15B are configuration diagrams of image display devices according to third and fourth embodiments.

FIG. 15A shows a configuration diagram of an image display device according to the third embodiment of the present invention. With the image display device according to the third embodiment, instead of performing region division lighting control of light sources, light sources are controlled in a uniform manner in a screen.

Figure 16:
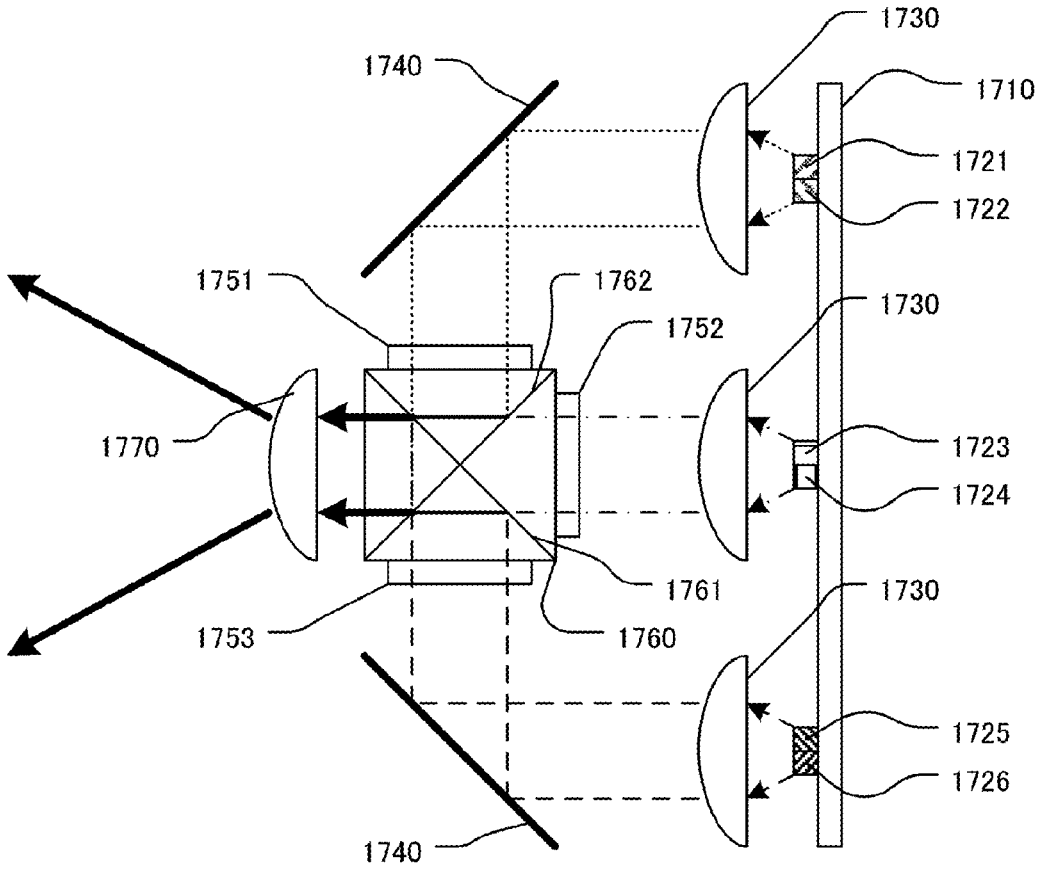
FIG. 16 is a configuration diagram of a projecting unit according to the third embodiment.

A projecting unit 1070 projects an image according to alight source drive signal 1061 and the corrected pixel value 51. FIG. 16 shows a configuration diagram of the projecting unit 1070.

A light source substrate 1710 is a substrate on which light-emitting diodes that are light sources are mounted. Red (R) light-emitting diodes A and B (reference numerals 1721 and 1722), green (G) light-emitting diodes C and D (reference numerals 1723 and 1724), and blue (B) light-emitting diodes E and F (reference numerals 1725 and 1726) are arranged on the light source substrate 1710. It is assumed that the light-emitting diodes A 1721 to F 1726 have characteristics of r1 (λ), r2 (λ), g1 (λ), g2 (λ), b1 (λ), and b2 (λ) shown in FIG. 5.

A condensing lens 1730 is a lens that condenses light emitted from the light-emitting diodes A 1721 to F 1726 to create parallel light.

A reflective mirror 1740 changes an optical path of the condensed light source light and causes the condensed light source light to enter an LCD panel (to be described later).

An LCD panel R 1751 forms a gradation of a red component of the corrected pixel value 51 in a plane and modulates red light source light emitted from the light-emitting diode A 1721 and the light-emitting diode B 1722.

An LCD panel G 1752 and an LCD panel B 1753 modulate green and blue light source light in a similar manner.

A dichroic prism 1760 composites light source light independently modulated for the three RGB primary colors into a single optical path. A B reflective surface 1761 reflects light in the blue wavelength region and transmits light in other wavelength regions. In addition, an R reflective surface 1762 reflects light in the red wavelength region and transmits light in other wavelength regions.

A projecting lens 1770 projects composite light of the respective modulated light of the three RGB primary colors on a screen.

A statistics acquiring unit 1010 analyzes the input image 1 and calculates statistics 1011. With the exception of an image region for which a histogram is accumulated being an entire region of the input image and therefore a single histogram is created, the statistics acquiring unit 1010 calculates the statistics 1011 using a configuration and a method approximately similar to those of the divisional statistics acquiring unit described in the first embodiment. A construction of the structure of the statistics 1011 is shown below. A histogram structure CHIST is a single structure and not a two-dimensional array.

```
{
int CAB1[2];
int CAB2[2];
int CAG1[2];
int CAG2[2];
int CAR1[2];
int CAR2[2];
int CAW;
}CHIST;
```

A light source lighting intensity determining unit 1020 calculates light source lighting intensity 1021 based on the statistics 1011. The light source lighting intensity 1021 according to the third embodiment includes six values of bl.R1, bl.R2, bl.G1, bl.G2, bl.B1, and bl.B2 and has one value for each light source. A calculation method is similar to the method of calculating backlight lighting intensity described in the first embodiment with the exception of treating an entire screen as a single block. In other words, in the third embodiment, the processes of area selection and repetition in steps S200 and S206 in the flow chart shown in FIG. 10 are omitted.

A light source chromaticity calculating unit 1040 calculates a light source chromaticity 1041 based on the light source lighting intensity 1021. Since a chromaticity distribution of the light sources are uniform in the third embodiment, $$BlXYZ[R].X=bl.R1\cdot \mathrm{Org}XYZ[R1].X+bl.R2\cdot \mathrm{Org}XYZ[R2].X$$

$$BlXYZ[R].Y=bl.R1\cdot \mathrm{Org}XYZ[R1].Y+bl.R2\cdot \mathrm{Org}XYZ[R2].Y$$

$$BlXYZ[R].Z=bl.R1\cdot \mathrm{Org}XYZ[R1].Z+bl.R2\cdot \mathrm{Org}XYZ[R2].Z \quad \text{[Expression 15]}$$

(the same applies to G and B)
are obtained.

A method of pixel value correction by the pixel value correcting unit 50 is similar to the procedure according to the first embodiment with the exception of the pixel value correction being based on the light source chromaticity 1041 that is uniform in the screen.

A light source driving unit 1060 outputs a light source drive signal 1061 for driving a light source of the projecting unit 1070 based on the light source lighting intensity 1021.

According to the configurations and the procedures described above, the present invention can be also be implemented with a projecting-type image display device. According to the third embodiment, when a projected image is an image with low chroma (an image in which many pixels belong to the white region CAW) as a whole, the two light sources constituting the light source of each of the three RGB primary colors emit light at more or less the same intensity. Therefore, an occurrence of individual variability in the appearance of color can be suppressed. On the other hand, when a projected image is an image with high chroma as a whole, the lighting intensities of the two light sources constituting the light source of each of the three RGB primary colors are modified in accordance with chroma of each color. As a result, display can be performed in a wide color gamut.

In addition, the present invention can be implemented with approximately the same configuration even using other light sources such as a laser light source and an organic EL light source.

Fourth Embodiment

A fourth embodiment will now be described in which the present invention is applied to a projector device in which light sources are constituted by a plurality of regions and which controls an emission amount per region.

Figure 15B:
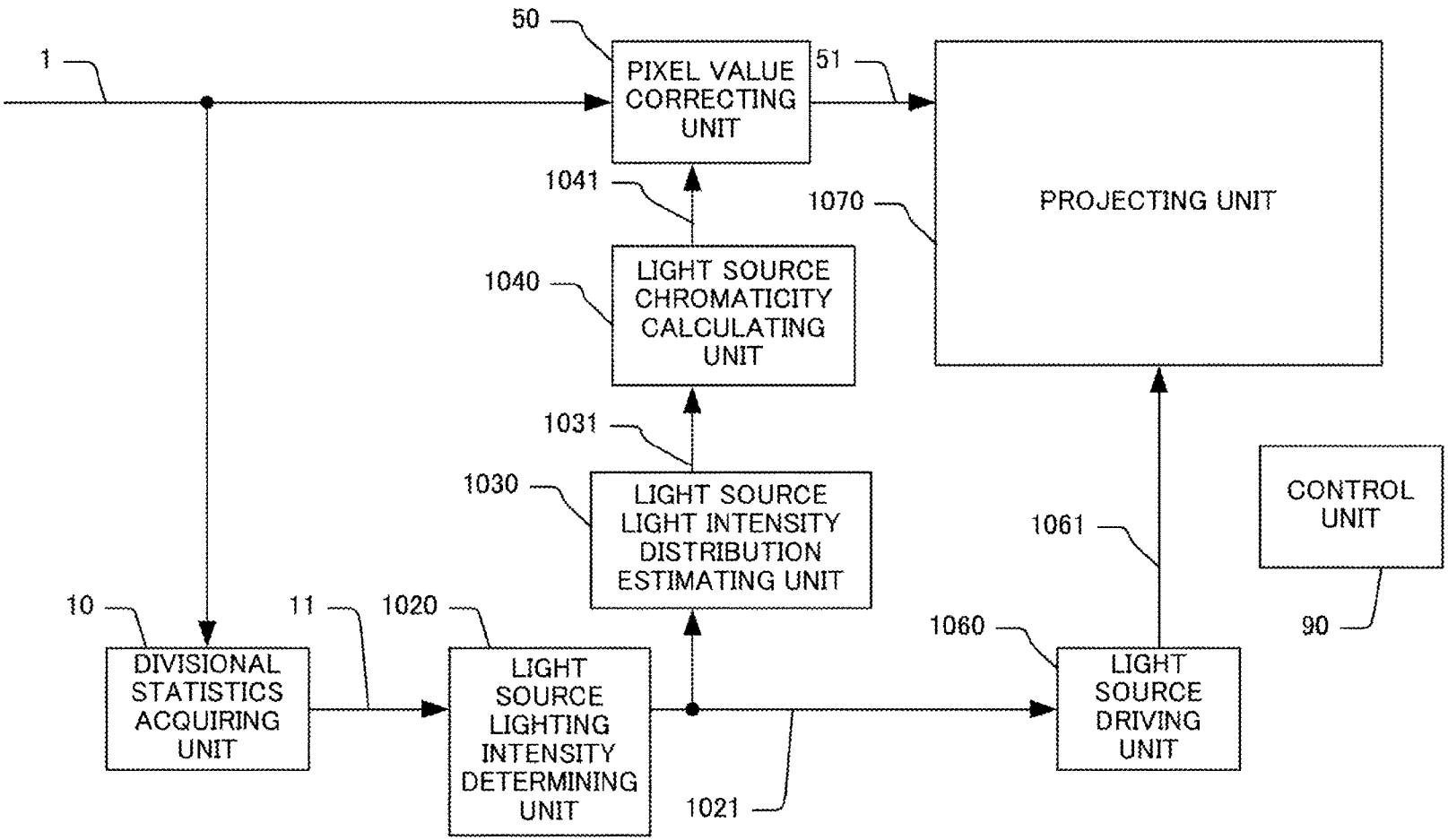
Figure 17:
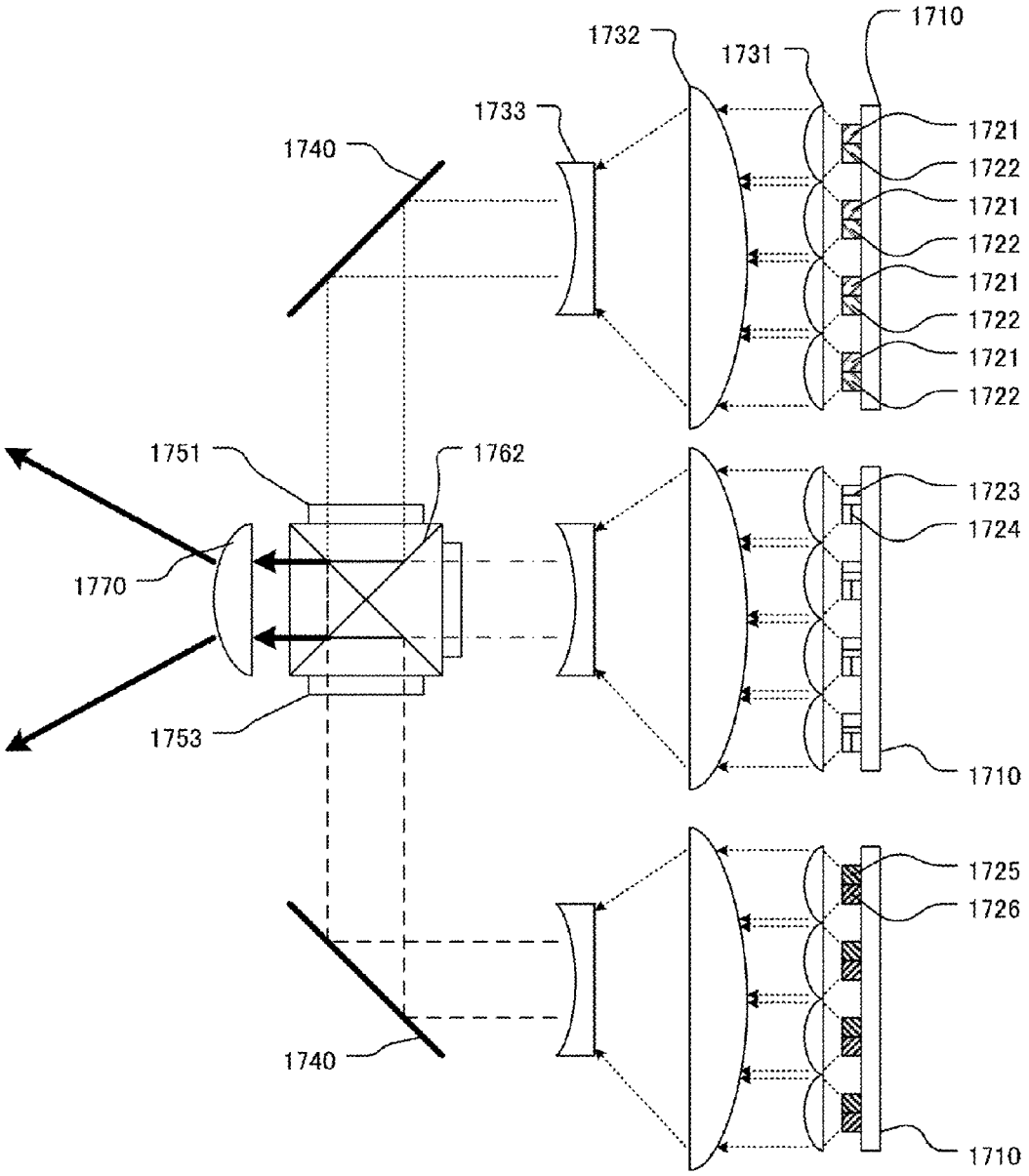
FIG. 17 shows a configuration of a projecting unit according to the fourth embodiment.
Figure 18:
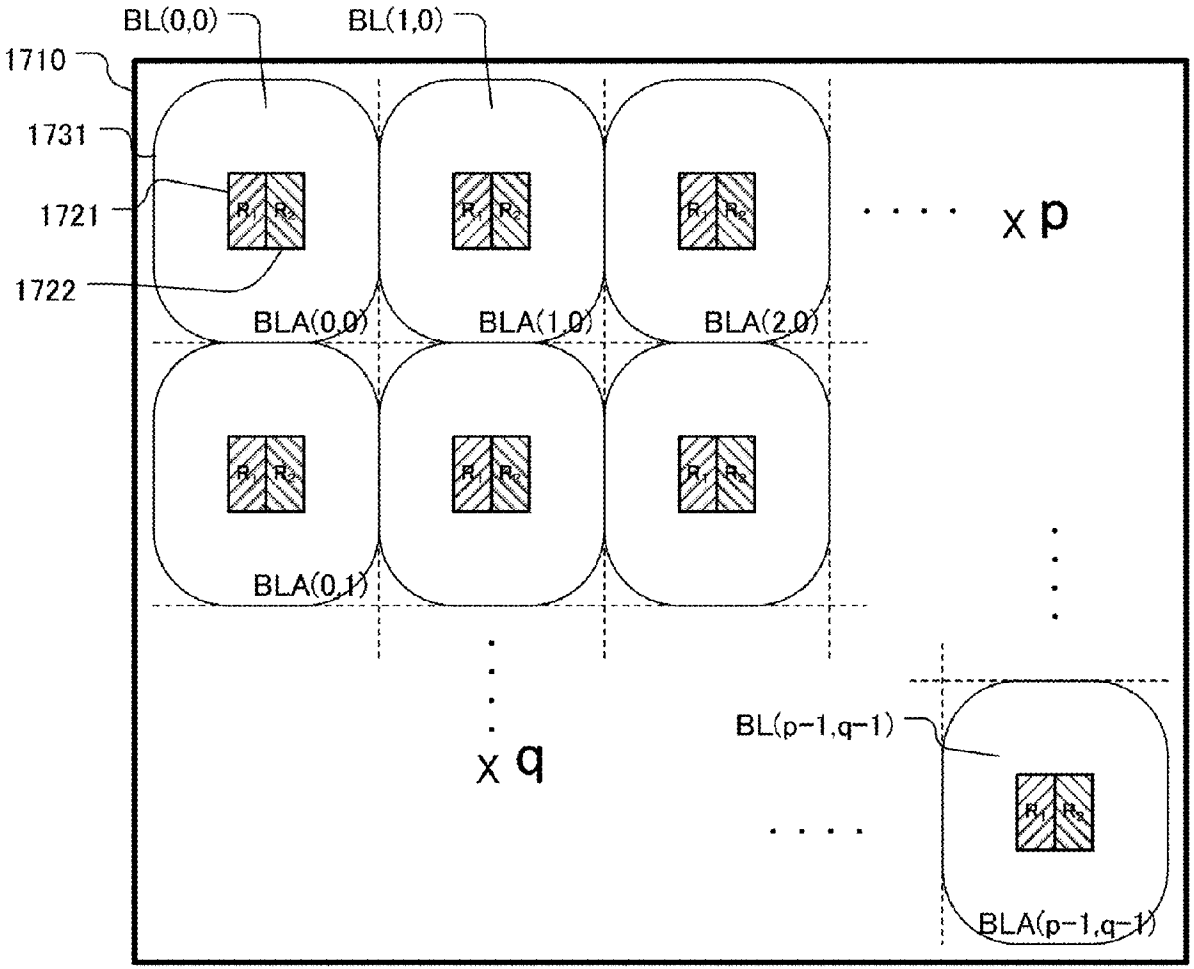
FIG. 18 is a diagram viewing the projecting unit according to the fourth embodiment from the front.

FIG. 15B shows a configuration diagram of an image display device according to the fourth embodiment of the present invention. In addition, FIG. 17 shows a configuration diagram of the projecting unit 1070. Furthermore, FIG. 18 is a diagram showing, from the front, a red light source unit in which a red light-emitting diode element is arranged among the light source substrate 1710 on which light-emitting diode elements that are light sources are arranged.

The red light source unit is divided into p-number of horizontal light source areas and q-number of vertical light source areas, and a red (R1) light-emitting diode A 1721 and a red (R2) light-emitting diode B 1722 are arranged in each light source area. A light source area that is j-th in the horizontal direction and k-th in the vertical direction as counted from a top left light source area will be denoted as BL (j, k) (j=0, . . . , p−1, k=0, . . . , q−1). A value of the light source lighting intensity 1021 corresponding to the light-emitting diode A 1721 arranged in the light source area BL (j, k) is expressed by bl(j, k).R1, and a value of the light source lighting intensity 1021 corresponding to the light-emitting diode B 1722 arranged in the light source area BL (j, k) is expressed by bl(j, k).R2.

Light source light emitted from the light-emitting diode A 1721 and the light-emitting diode B 1722 is condensed per light source area by a condensing lens array 1731.

The condensed light source light is further condensed by an optical path adjusting lens A 1732 and an optical path adjusting lens B 1733 and finally enters the LCD panel R 1751 via the reflective mirror 1740.

Physical and optical configurations of a green light source unit in which a green light-emitting diode element is arranged and a blue light source unit in which a blue light-emitting diode element is arranged among the light source substrate 1710 are similar to those of the red light source unit described above.

By configuring the light sources in this manner, even with a projector device, an amount of light source light can controlled per region of a projected image.

The divisional statistics acquiring unit 10 calculates a histogram per image region of an input image corresponding to each light source area in a similar manner to the configuration according to the first embodiment.

The light source lighting intensity determining unit 1020 determines the light source lighting intensity 1021 by a similar procedure to that of the backlight lighting intensity determining unit 20 described in the first embodiment. Light source lighting intensity according to the fourth embodiment is an array using a light source area (j, k) as an index in a similar manner to bl(j, k).R1 and the like according to the first embodiment.

A light source light intensity distribution estimating unit 1030 estimates a projected light source light intensity distribution 1031 based on the light source lighting intensity 1021.

Respective light source light intensity distributions of light sources of each light source area which are used when estimating the light source light intensity distribution are measured in advance by the following procedure.

First, only one of the light-emitting diodes A 1721 that are light sources such as the light source R1 in a light source area BL (1, 1) is fully lighted and the other light-emitting diodes A 1721 are fully turned off. In addition, the corrected pixel value 51 is set so that the LCD panel R 1751 is fully transmissive. Accordingly, a light source light intensity distribution by a single light source is projected on a screen. The light source light intensity distribution is measured to obtain a two-dimensional brightness distribution, and light emission distribution characteristics pf (x, y) by a single light source is obtained based on the two-dimensional brightness distribution.

A procedure of estimating the light source light intensity distribution 1031 based on the light emission distribution characteristics and the light source lighting intensity 1021 is similar to the procedure of estimating the backlight light intensity distribution 31 described in the first embodiment.

The light source chromaticity calculating unit 1040 calculates the light source chromaticity 1041 represented by an XYZ chromaticity coordinate for each pixel position. A procedure of calculation is similar to the procedure of calculating backlight chromaticity 41 described in the first embodiment.

By applying the present invention to a projector device which controls an emission amount of a light source per light source area according to the configurations and the procedures described above, lighting intensities of the two light-emitting diodes of each color light source can be controlled for each image region of a projected image. Accordingly, for a light source area corresponding to an image region with low chroma, individual variability in color appearance can be suppressed by setting the lighting intensities of the two light-emitting diodes approximately the same. In addition, for a light source area corresponding to an image region with high chroma, display in a wide color gamut can be performed by changing the lighting intensities of the two light-emitting diodes in accordance with a high chroma color. Therefore, both a suppression of individual variability in the appearance of color and an expansion of a color gamut can be achieved for the projected image as a whole.

Fifth Embodiment

A fifth embodiment will now be described in which the present invention is applied to a projector device including a light source, a color wheel, an optical modulator, and a projecting lens.

Figure 19:
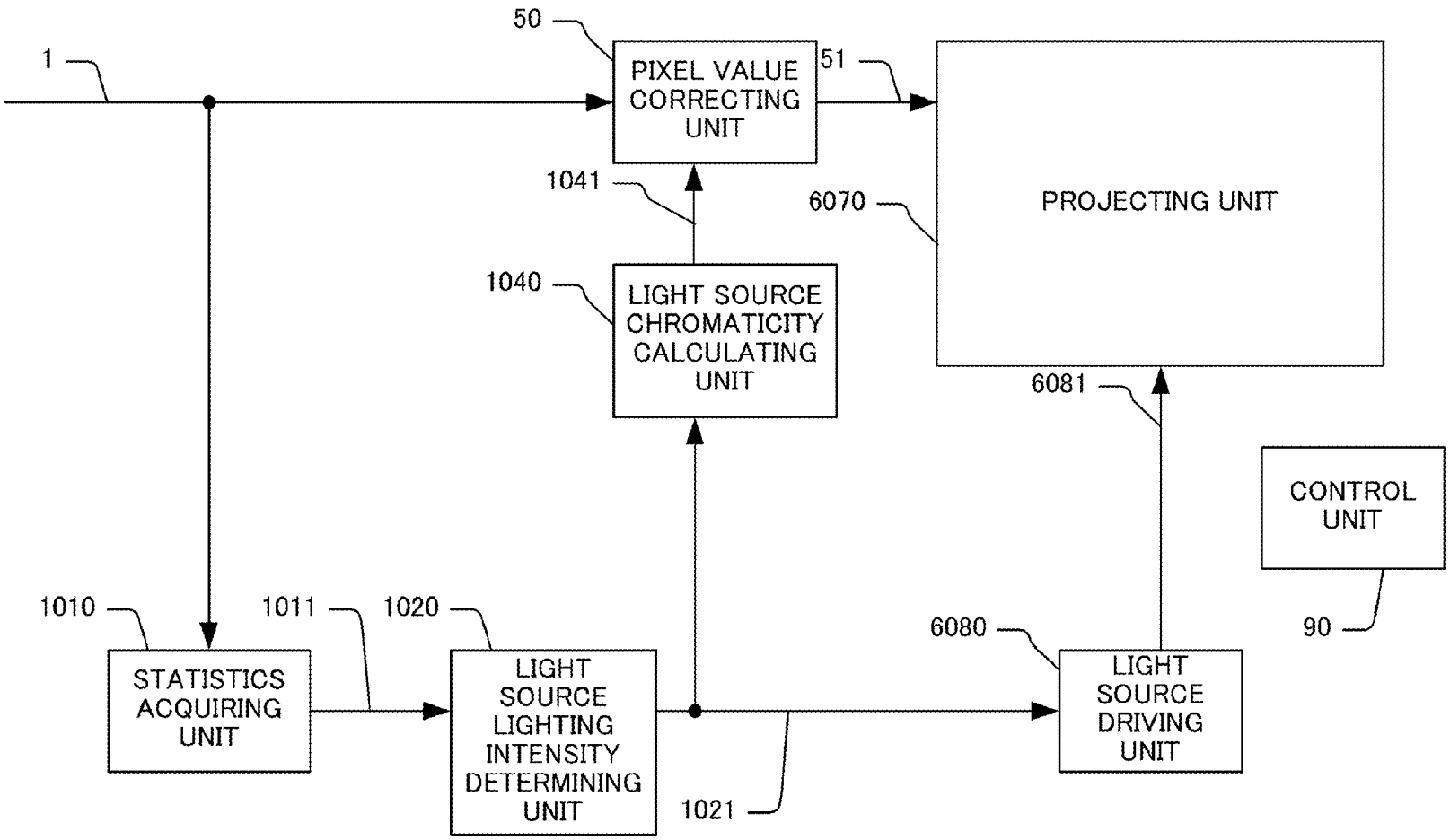
FIG. 19 is a configuration diagram of an image display device according to fifth, sixth, and seventh embodiments.

FIG. 19 shows a configuration of an image display device according to the fifth embodiment. The configuration of the image display device according to the fifth embodiment differs from that of the image display device according to the third embodiment in a light source driving unit 6080 and a projecting unit 6070, and other configurations are similar to those of the third embodiment. Since a description of the respective processing units other than the projecting unit 6070 and the light source driving unit 6080 is similar to that of the third embodiment, the description will be omitted.

The projecting unit 6070 projects an image according to alight source drive signal 6081 and the corrected pixel value 51. A configuration of the projecting unit 6070 will be described later.

The light source driving unit 6080 outputs a light source drive signal 6081 for driving a light source based on the light source lighting intensity 1021. Operations of the light source driving unit 6080 will be described in detail later.

Figure 20:
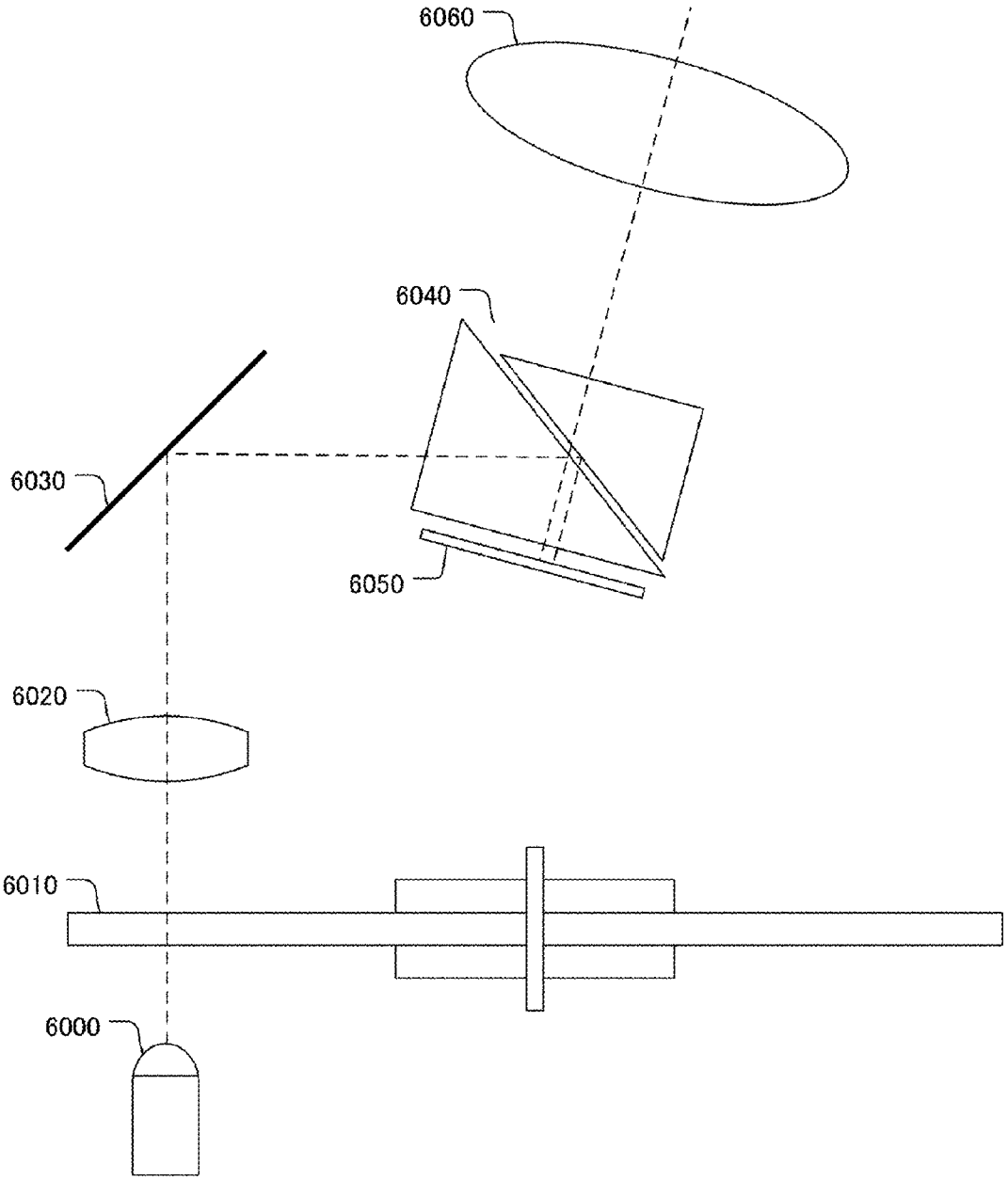
FIG. 20 is a configuration diagram of a projecting unit according to the fifth, sixth, and seventh embodiments.

FIG. 20 is a configuration diagram of the projecting unit 6070 according to the fifth embodiment. Dashed lines in the drawing depict an optical path of light irradiated from a light source 6000.

The projecting unit 6070 according to the fifth embodiment is constituted by the light source 6000, a color wheel 6010, a condensing lens 6020, a reflective mirror 6030, a prism 6040, an optical modulator 6050, and a projecting lens 6060.

The light source 6000 is a light source that causes red (R), blue (B), and green (G) necessary for color display to be emitted from the color wheel 6010. The light source 6000 uses a light-emitting diode which is made of an InGaN based material and which emits ultraviolet light with an emission wavelength of approximately 380 nm. The light source 6000 emits light as a current is applied to the light source 6000.

The color wheel 6010 is a wavelength converting member that converts ultraviolet light irradiated by the light source 6000 into visible light having wavelength characteristics suitable for configuring a light source of each RGB color with two narrow light sources. A phosphor layer is formed in the color wheel 6010 as a wavelength converting layer that converts inputted ultraviolet light into visible light. Ultraviolet light is wavelength-converted into visible light by the phosphor layer. Details of the color wheel 6010 will be described later.

The condensing lens 6020 is a lens that condenses visible light emitted from the color wheel 6010 to create parallel light.

The reflective mirror 6030 is a reflective mirror which is positioned on an optical path of the light emitted from the condensing lens 6020 and which converts an optical axis toward the prism 6040.

Figure 21A:
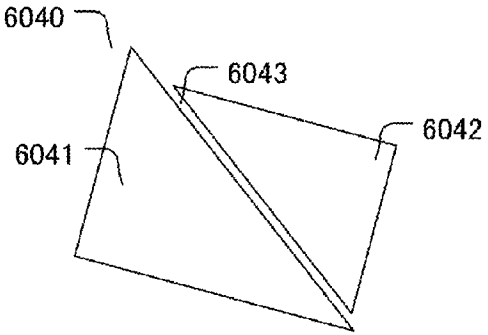
FIGS. 21A to 21C are diagrams showing a prism, a color wheel, and a visible light reflecting film according to the fifth, sixth, and seventh embodiments.

The prism 6040 is used as a polarizing splitter. As shown in FIG. 21A, the prism 6040 is structured such that a glass base material 6041 and a glass base material 6042, which are both triangular, are bonded together so as to sandwich a layer 6043 constituted by a polarized light separating film and a bonding layer.

The optical modulator 6050 modulates light emitted from the color wheel 6010 by changing, in accordance with an (R'G'B') value of each pixel in the corrected pixel value 51, a transmittance of a reflective liquid crystal display element corresponding to each pixel.

The projecting lens 6060 is a lens that enlarges and projects light that is optically modulated by the optical modulator 6050 on a screen.

Details of the color wheel 6010 will now be described.

Figure 21B:
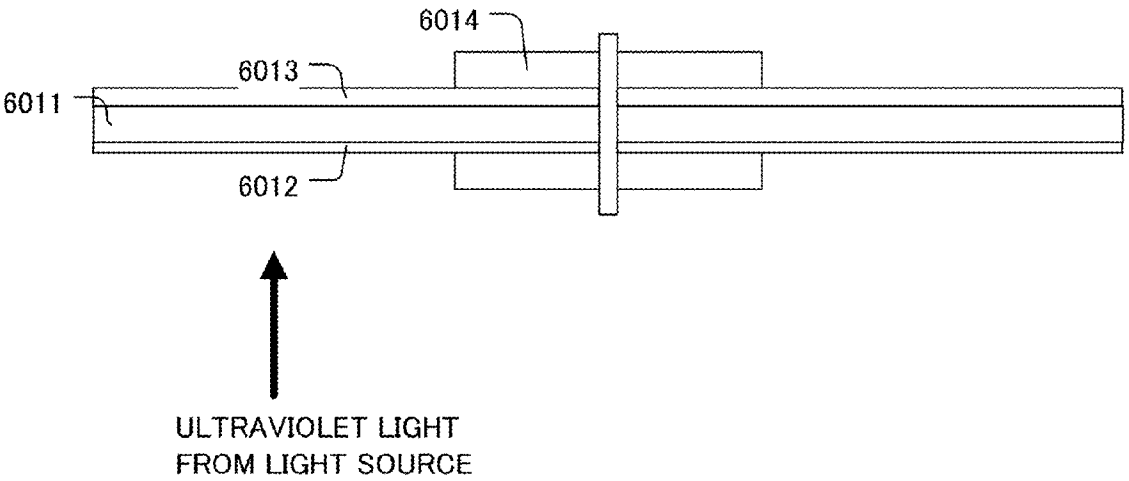

FIG. 21B is a sectional view of the color wheel 6010.

The color wheel 6010 is constituted by a transparent substrate 6011 which can be rotated by a motor 6014, a visible light reflecting film 6012, and a phosphor layer 6013.

Quartz glass that transmits, without modification, ultraviolet light irradiated from the light source 6000 is used as the transparent substrate 6011.

Figure 21C:
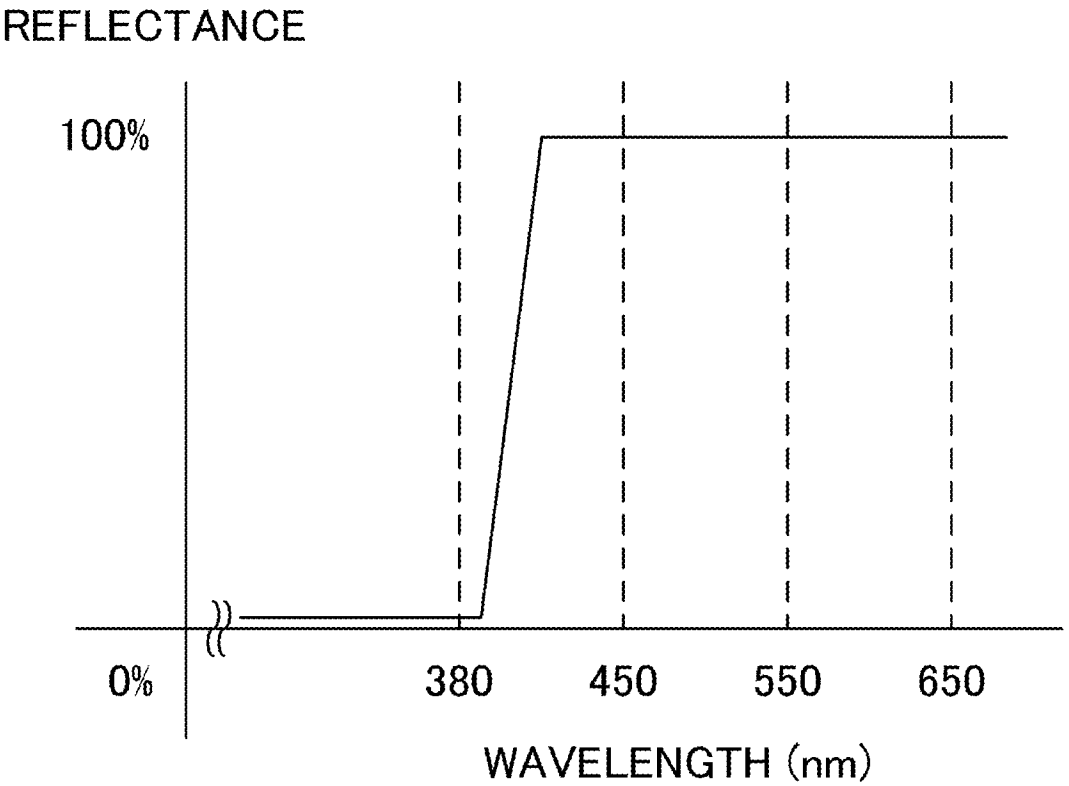

The visible light reflecting film 6012 has characteristics of transmitting ultraviolet light irradiated by the light source 6000 and reflecting visible light. Therefore, the ultraviolet light irradiated by the light source 6000 can reach the phosphor layer 6013 in an efficient manner. FIG. 21C is a diagram showing reflection characteristics of the visible light reflecting film 6012 that reflects light with wavelengths equal to or more than approximately 400 nm.

The phosphor layer 6013 on the emitting side of the transparent substrate 6011 has characteristics of being excited by ultraviolet light with a wavelength of approximately 380 nm. Emission characteristics of the phosphor layer 6013 can be changed by varying a composition of a compound.

The motor 6014 is controlled by the control unit 90 so as to cause one rotation of the color wheel 6010 in one frame period.

FIG. 22 is a plan view of the color wheel 6010.

Figure 22B:
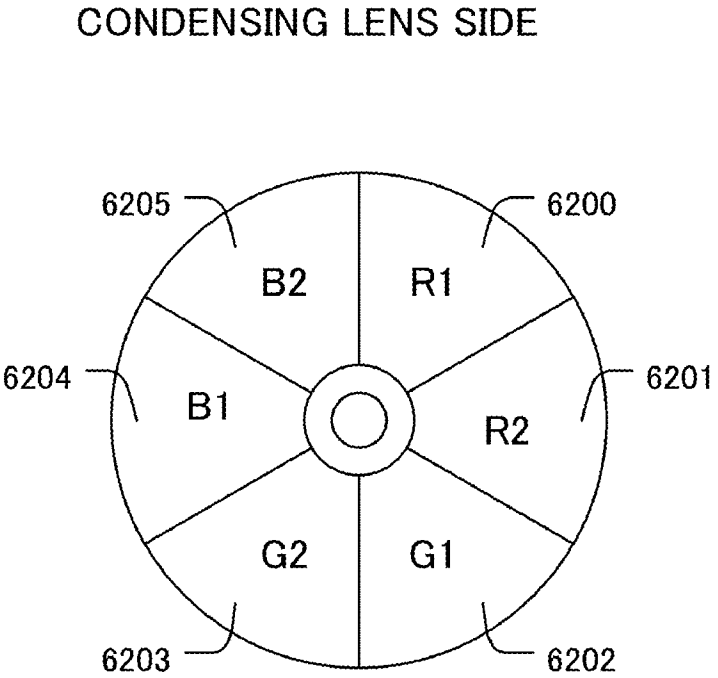
FIGS. 22A and 22B are plan views of the color wheel according to the fifth, sixth, and seventh embodiments.
Figure 22A:
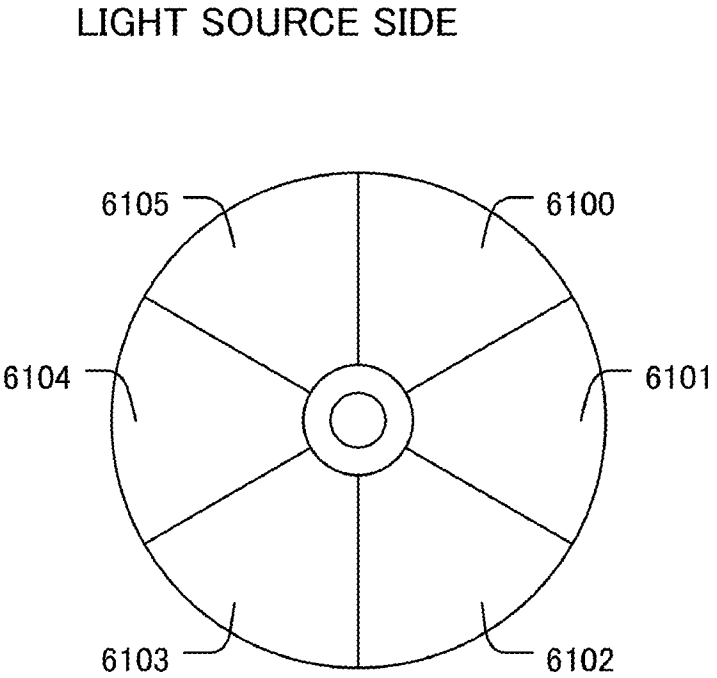

The color wheel 6010 has a disk shape and a side of the color wheel 6010 that receives the ultraviolet light of the light source 6000 is constituted by six regions 6100, 6101, 6102, 6103, 6104, and 6105 as shown in FIG. 22A. The visible light reflecting film 6012 is formed in each of these regions.

The condensing lens 6020 side of the color wheel 6010 is constituted by six regions 6200, 6201, 6202, 6203, 6204, and 6205 as shown in FIG. 22B. Each of these regions is coated with a phosphor that wavelength-converts the ultraviolet light into visible light of the respective colors of R1, R2, G1, G2, B1, and B2 to form a phosphor layer. Respective positions of the regions 6200 to 6205 correspond to respective positions of the regions 6100 to 6105 on the rear side. A phosphor layer that emits light with the characteristics of r1 (λ) shown in FIG. 5 is applied and formed in the R1 region 6200. In a similar manner, phosphor layers that emit light with the characteristics of r2 (λ), g1 (λ), g2 (λ), b1 (λ), and br2 (λ) shown in FIG. 5 are applied and formed in the regions 6201 to 6205.

As the color wheel 6010 rotates, the ultraviolet light from the light source 6000 sequentially irradiates regions 6100→6101→ . . . →6105, and light of R1→R2→ . . . →B2 is sequentially emitted from the regions 6200 to 6205.

Operations of the light source driving unit 6080 will be described.

The light source driving unit 6080 according to the fifth embodiment controls a light amount of the light source 6000 by modulating a current that is applied to the light source 6000 according to the pulse width modulation (PWM) system. In the fifth embodiment, an amount of current to be applied to the light source 6000 when lighting the light source 6000 is set constant.

The light source driving unit 6080 outputs a PWM-modulated light source drive signal 6081 in accordance with the six values of the light source lighting intensity 1021 (bl.R1, bl.R2, bl.G1, bl.G2, bl.B1, and bl.B2) outputted from the light source lighting intensity determining unit 1020. It is assumed that a current flows into the light source 6000 only for a pulse width of the outputted light source drive signal 6081 or, in other words, only during a period where the pulse signal is high (hereinafter, referred to as alight source driving time).

A procedure of calculating a light source driving time from the light source lighting intensity 1021 will now be described.

First, the light source lighting intensity 1021: bl.R1, bl.R2, bl.G1, bl.G2, bl.B1, bl.B2 is limited so as to assume values within the following ranges.

$0.0 \le bl.R1 \le 2.0$ $0.0 \le bl.R2 \le 2.0$ $0.0 \le bl.G1 \le 2.0$ $0.0 \le bl.G2 \le 2.0$ $0.0 \le bl.G1 \le 2.0$ $0.0 \le bl.G2 \le 2.0$

From the light source lighting intensity 1021 of each color, light source driving times (T_R1, T_R2, T_G1, T_G2, T_B1, and T_B2) are calculated according to the following relational formulas.

$$T_R1 = bl.R1/12$$

$$T_R2 = bl.R2/12$$

$$T_G1 = bl.G1/12$$

$$T_G2 = bl.G2/12$$

$$T_B1 = bl.B1/12$$

$$T_B2 = bl.B2/12 \quad \text{(Formula 1)}$$

Since the color wheel 6010 makes one rotation in one frame period (hereinafter, denoted as 1 V), a maximum light source driving time of each region can be denoted as ⅙ V. When a calculated light source driving time of a region is ⅙, a light source driving time of the region is ⅙ V.

When the light source lighting intensity 1021 assumes a maximum value (2.0), the light source driving time is maximized and the light amount of the light source 6000 is 100%. When the light source lighting intensity 1021 assumes a minimum value (0), the light source driving time is minimized and the light amount of the light source 6000 is 0%. When the light source lighting intensity 1021 assumes a value that is half of the upper limit (2.0) or, in other words, a median value (1.0), the light source driving time is half of the maximum light source driving time and the light amount of the light source 6000 is 50% of the maximum light amount. As described above, the light source driving unit 6080 controls the light amount of the light source 6000 by causing a current to flow into the light source 6000 only for a pulse width of the light source drive signal 6081 or, in other words, only during a light source driving time.

Figures 23A, 23B:
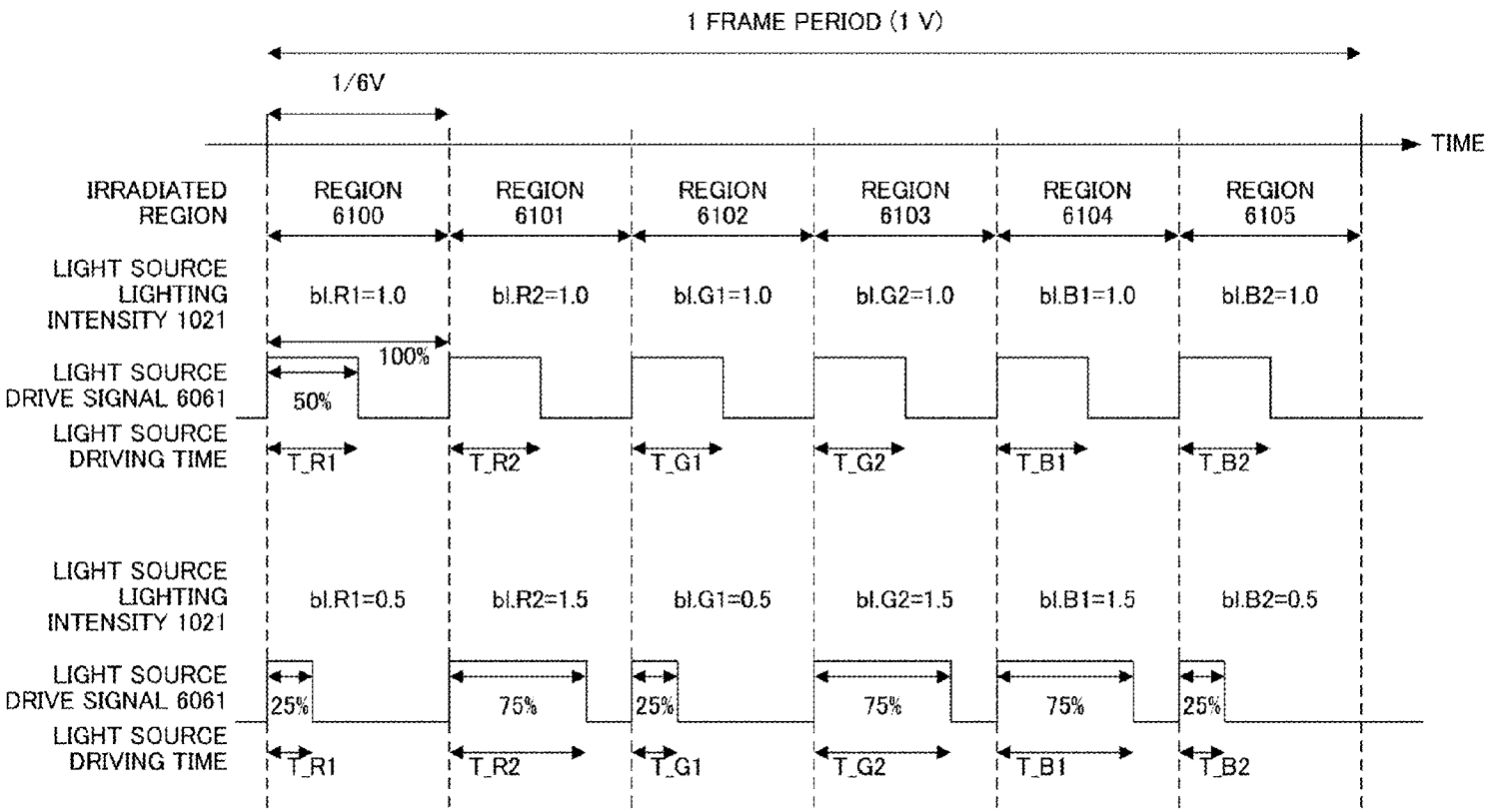
FIGS. 23A and 23B are diagrams showing relationships between light source lighting intensity and light source driving time according to the fifth embodiment.

FIG. 23 is a diagram showing a relationship between the light source lighting intensity 1021 and a light source driving time of each region. FIG. 23A shows an example of light source drive control in a case where the input image 1 is an image including many low chroma colors. In the case of an image with low chroma, the light source lighting intensity 1021 is set to a value in the vicinity of 1.0 for the light source of each color in order to have chromaticity points of the three RGB primary colors assume values close to normal primary color points. For example, when the light source lighting intensity 1021 of each color assumes the median value (1.0), a pulse width of the light source drive signal 6081 is 50% of a maximum pulse width for the light source of each color. Therefore, as shown in FIG. 23A, the time that the light source 6000 irradiates each of the regions 6100 to 6105 is represented by a period of 1/12 V from the start of an irradiation-possible period of each region.

FIG. 23B shows an example of light source drive control in a case where the input image 1 is an image including many high chroma colors. When an image that includes many vivid blue-green and red colors is inputted, bl.R2, bl.G2, and bl.B1 among the light source lighting intensity 1021 assume values that are larger than normal lighting intensity and bl.R1, bl.G1, and bl.B2 assume values that are smaller than normal lighting intensity. For example, the light source lighting intensity 1021 is set to the following values.

bl.R1=0.5
bl.R2=1.5
bl.G1=0.5
bl.G2=1.5
bl.B1=1.5
bl.B2=0.5

In this case, pulse widths of the light source drive signals 6081 of the regions 6101, 6103, and 6104 are 75% of a maximum pulse width, and pulse widths of the light source drive signals 6081 of the regions 6100, 6102, and 6105 are 25% of a maximum pulse width. Therefore, as shown in FIG. 23B, the period over which the light source 6000 irradiates the regions 6101, 6103, and 6104 is 1/8 V and the period over which the light source 6000 irradiates the regions 6100, 6102, and 6105 is 1/24 V.

As described above, according to the fifth embodiment, with a projector using an ultraviolet light source and a color wheel constituted by a phosphor layer, an occurrence of individual variability in the appearance of color can be suppressed when projecting an image with low chroma and a display color gamut can be expanded when projecting an image with high chroma.

In the fifth embodiment, a projector which includes a light-emitting diode that emits ultraviolet light as the light source 6000 and the color wheel 6010 which wavelength-converts ultraviolet light into visible light having wavelength characteristics suitable for constituting light sources of each RGB color by two narrow light sources has been shown. However, a configuration may also be adopted which includes a discharge lamp that emits white light as the light source 6000 and in which transmitted light having wavelength characteristics necessary for two narrow light sources constituting light sources of each RGB color is obtained by causing white light to be transmitted through a light transmitting member. In other words, a color wheel in which a plurality of color filters are arranged in a disk shape may be used.

While a reflective liquid crystal display element is used as the optical modulator 6050 according to the fifth embodiment, a digital mirror device (DMD) over which micro mirrors are spread may be used instead.

The light source 6000 according to the fifth embodiment is not limited to a light-emitting diode and need only be a light source that emits ultraviolet light. Therefore, a semiconductor laser or the like can also be used as the light source 6000.

In the fifth embodiment, while an example of controlling a color wheel so as to make one rotation in one frame period has been shown, this is not restrictive and the color wheel may be controlled so as to make a plurality of rotations in one frame period. In this case, a light source driving time may be controlled so that a total time over which the respective regions are irradiated in one frame period is equal to the fifth embodiment.

Sixth Embodiment

An example in which an amount of light of the light source 6000 is controlled by modulating a current to be applied to the light source 6000 according to the PWM system has been described in the fifth embodiment.

A sixth embodiment is an embodiment in which the present invention is applied to a projector device that modulates an amount of current to be applied to the light source 6000 according to a pulse amplitude modulation (PAM) system.

A configuration of an image display device according to the sixth embodiment is similar to the configuration of the image display device according to the fifth embodiment with the exception of operations of the light source driving unit 6080. Since a description of the respective processing units other than the light source driving unit 6080 is similar to that of the fifth embodiment, the description will be omitted.

Operations of the light source driving unit 6080 according to the sixth embodiment will be described.

The light source driving unit 6080 according to the sixth embodiment controls a light amount of the light source 6000 by modulating an amount of current that is applied to the light source 6000 according to the PAM system. In the sixth embodiment, for example, a maximum amount of light is obtained when causing a current of maximum 1 [A] to flow into the light source 6000.

The light source driving unit 6080 outputs a PAM-modulated light source drive signal 6081 in accordance with the six values of the light source lighting intensity 1021 (bl.R1, bl.R2, bl.G1, bl.G2, bl.B1, and bl.B2) outputted from the light source lighting intensity determining unit 1020. It is assumed that an amount of current (hereinafter referred to as alight source driving current amount) in accordance with a pulse width of the light source drive signal 6081 flows into the light source 6000.

A procedure of calculating a light source driving current amount from the light source lighting intensity 1021 will now be described.

First, the light source lighting intensity 1021: bl.R1, bl.R2, bl.G1, bl.G2, bl.B1, bl.B2 is limited so as to assume values within the following ranges.

$0.0 \leq bl.R1 \leq 2.0$
$0.0 \leq bl.R2 \leq 2.0$
$0.0 \leq bl.G1 \leq 2.0$ $0.0 \leq bl.G2 \leq 2.0$
$0.0 \leq bl.G1 \leq 2.0$
$0.0 \leq bl.G2 \leq 2.0$ From the light source lighting intensity 1021 of each color, light source driving current amounts (E_R1, E_R2, E_G1, E_G2, E_B1, and E_B2) are calculated according to the following relational formulas.

$$E_R1 = bl.R1/2[A]$$

$$E_R2 = bl.R2/2[A]$$

$$E_G1 = bl.G1/2[A]$$

$$E_G2 = bl.G2/2[A]$$

$$E_B1 = bl.B1/2[A]$$

$$E_B2 = bl.B2/2[A] \quad \text{(Formula 2)}$$

When the light source lighting intensity 1021 assumes a maximum value (2.0), the pulse amplitude is maximized, a current of 1 [A] flows into the light source 6000, and the light amount of the light source 6000 is 100%. When the light source lighting intensity 1021 assumes a minimum value (0.0), the pulse amplitude is minimized, a current of 0 [A] flows into the light source 6000, and the light amount of the light source 6000 is 0% of the maximum light amount. When the light source lighting intensity 1021 assumes a value that is half of the upper limit (2.0) or, in other words, a median value (1.0), the pulse amplitude is half of the maximum pulse amplitude, a current of 0.5 [A] flows into the light source 6000, and the light amount is 50% of the maximum light amount. As described above, the light source driving unit 6080 controls the light amount of the light source 6000 by causing a current to flow into the light source 6000 only for a pulse amplitude of the light source drive signal 6081 or, in other words, by only causing a current corresponding to a light source driving current amount to flow into the light source 6000.

FIG. 24 is a diagram showing a relationship between the light source lighting intensity 1021 and a light source driving current amount.

Figures 24A, 24B:
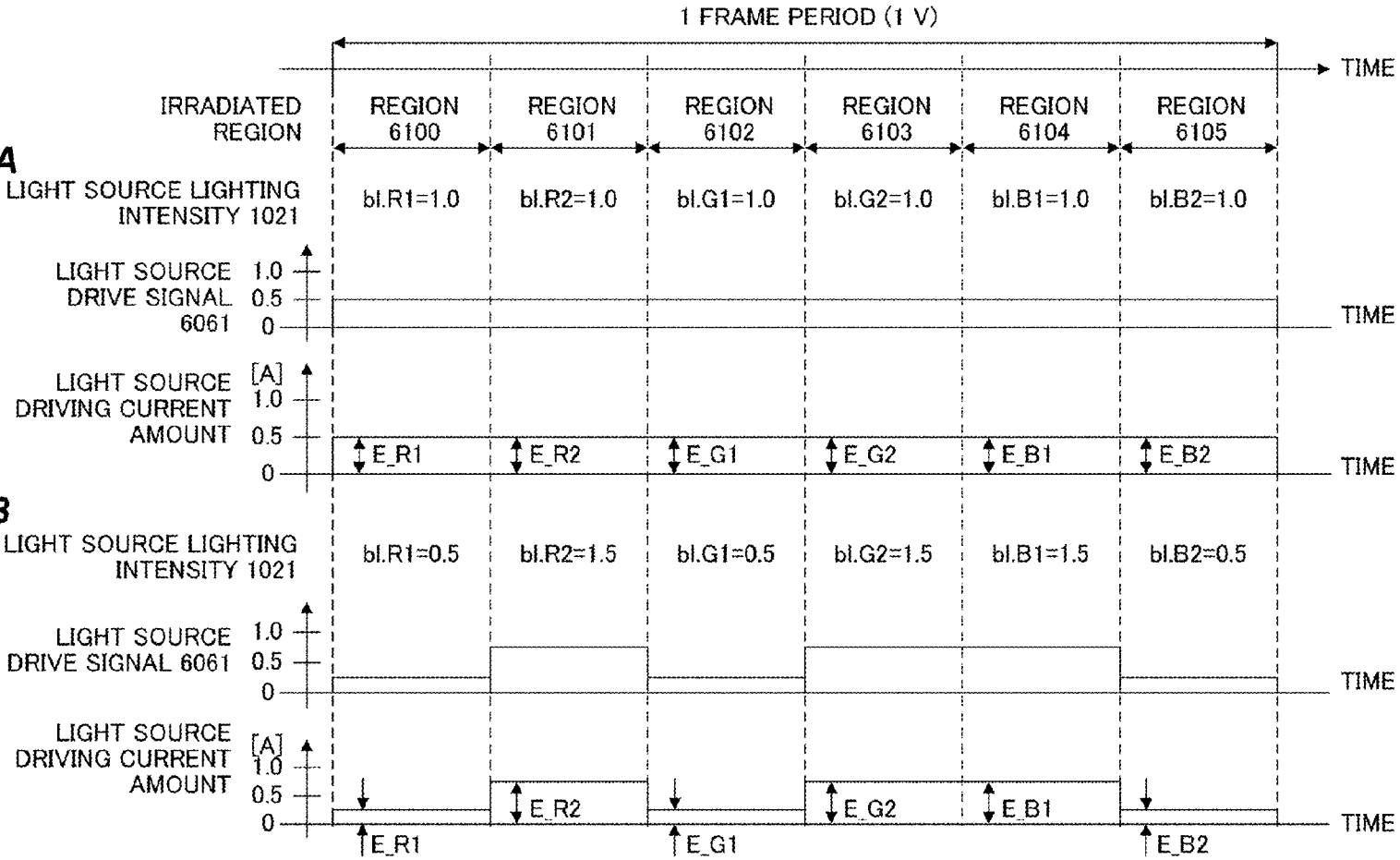
FIGS. 24A and 24B are diagrams showing relationships between light source lighting intensity and light source driving current amount according to the sixth embodiment.

FIG. 24A shows an example of light source drive control in a case where the input image 1 is an image including many low chroma colors. In the case of an image with low chroma, the light source lighting intensity 1021 is set to a value in the vicinity of 1.0 for the light source of each color in order to have chromaticity points of the three RGB primary colors assume values close to normal primary color points. For example, when the light source lighting intensity 1021 of each color assumes the median value (1.0), a pulse amplitude of the light source drive signal 6081 is 50% of a maximum pulse amplitude for the light source of each color. Therefore, as shown in FIG. 24A, the amount of current into the light source 6000 when the light source 6000 irradiates each of the regions 6100 to 6105 is 0.5 [A].

FIG. 24B shows an example of light source drive control in a case where the input image 1 is an image including many high chroma colors. When an image that includes many vivid blue-green and red colors is inputted, bl.R2, bl.G2, and bl.B1 among the light source lighting intensity 1021 assume values that are larger than normal lighting intensity and bl.R1, bl.G1, and bl.B2 assume values that are smaller than normal lighting intensity. For example, the light source lighting intensity 1021 is set to the following values.

bl.R1=0.5
bl.R2=1.5
bl.G1=0.5
bl.G2=1.5
bl.B1=1.5
bl.B2=0.5

In this case, pulse amplitudes of the light source drive signals 6081 of the regions 6101, 6103, and 6104 are 75% of a maximum pulse amplitude, and pulse amplitudes of the light source drive signals 6081 of the regions 6100, 6102, and 6105 are 25% of a maximum pulse amplitude. Therefore, as shown in FIG. 24B, the amount of current into the light source 6000 when irradiating the regions 6101, 6103, and 6104 is 0.75 [A], and the amount of current into the light source 6000 when irradiating the regions 6100, 6102, and 6105 is 0.25 [A].

As described above, according to the sixth embodiment, the present invention can be applied to a projector configured so as to modulate an amount of current to be applied to the light source 6000 according to the PAM system in order to control an amount of light of the light source 6000.

Seventh Embodiment

In the fifth embodiment, an example of configuring a phosphor layer of the color wheel 6010 so that the light source of each of the three RGB primary colors is constituted by two narrow light sources with narrow emission spectra has been described. In a seventh embodiment, an example will be described in which a phosphor layer of the color wheel 6010 is configured so that the light source of each of the three RGB primary colors is constituted by a combination of a narrow light source with a narrow emission spectrum and a broad light source with a broad emission spectrum.

A configuration of an image display device according to the seventh embodiment is similar to the configuration of the image display device according to the fifth embodiment with the exception of the configuration of the color wheel 6010 of the projecting unit 6070. Since a description of the respective processing units other than the color wheel 6010 is similar to that of the fifth embodiment, the description will be omitted.

A phosphor layer applied to each region of the color wheel 6010 according to the seventh embodiment will be described.

In the seventh embodiment, emission peak wavelengths of light emitted from the phosphor layer 6013 are set to $\lambda b1=450$ nm,
$\lambda b2=450$ nm,
$\lambda g1=550$ nm,
$\lambda g2=550$ nm,
$\lambda r1=600$ nm, and
$\lambda r2=600$ nm.

Figure 25A:
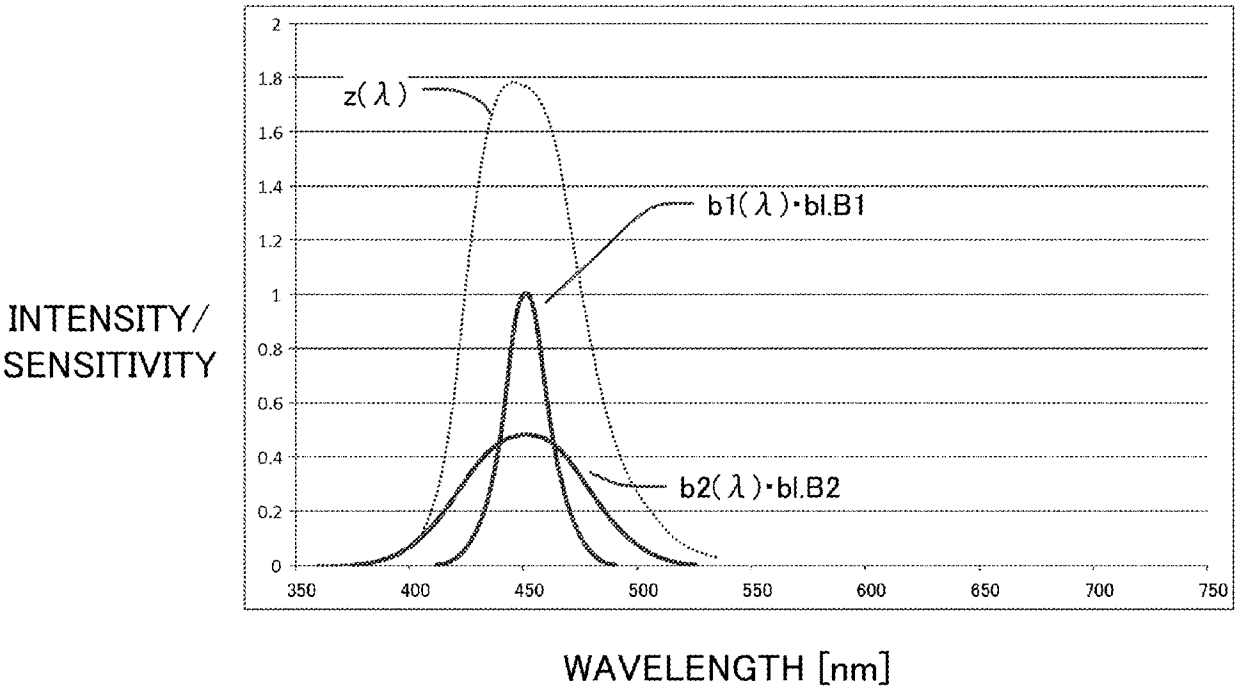
FIGS. 25A to 25C are diagrams showing relationships between emission characteristics of a phosphor layer and color matching functions according to the seventh embodiment.
Figure 25B:
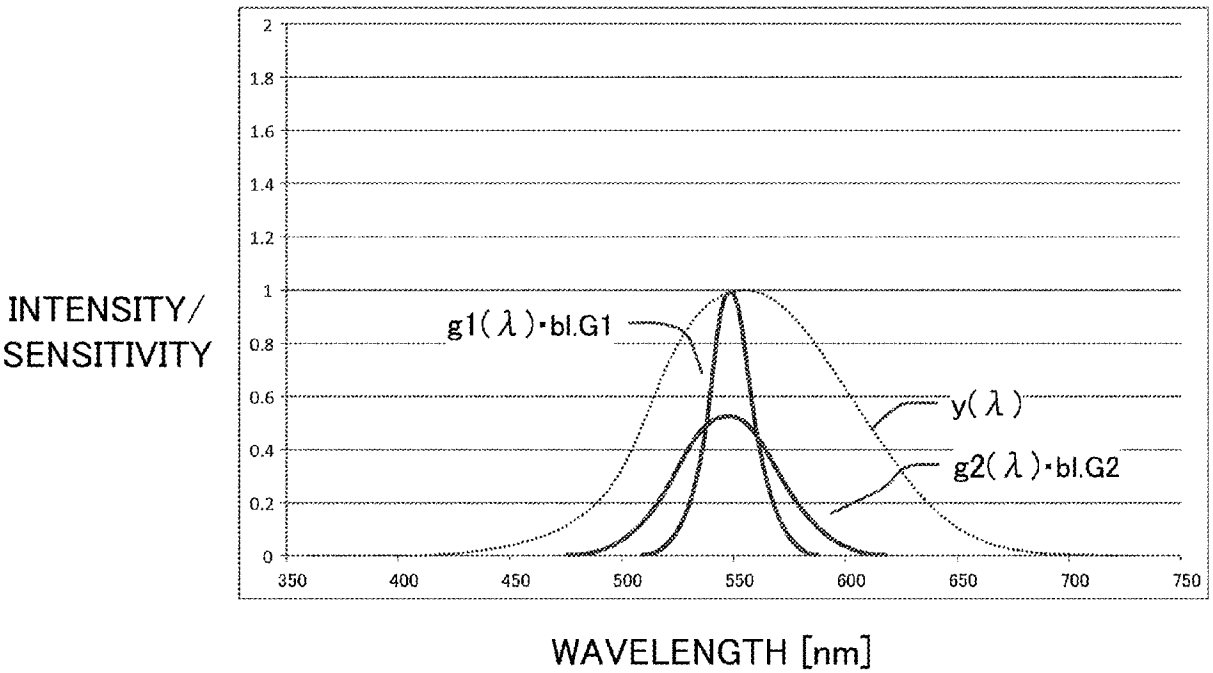
Figure 25C:
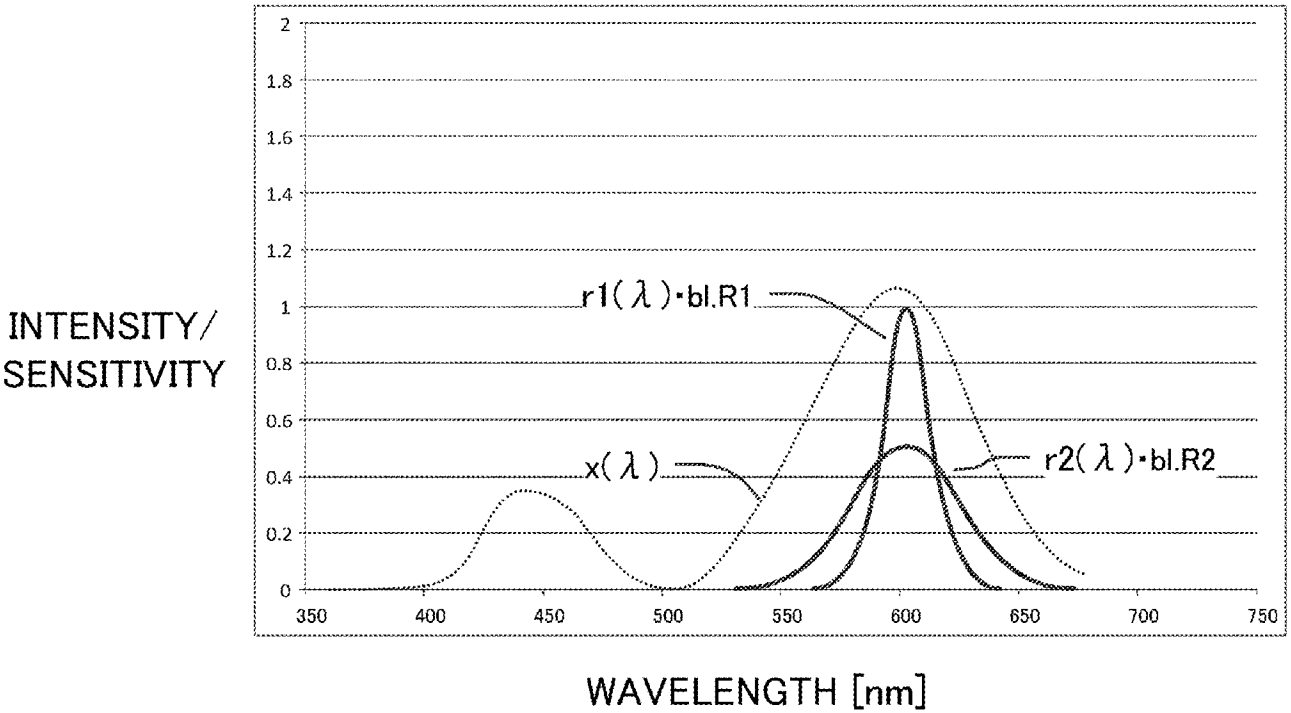

FIG. 25 shows a relationship between characteristics of emitted light from the phosphor layer 6013 selected in the seventh embodiment and color matching functions. FIG. 25A is a relationship diagram of emitted light characteristics of blue and color matching functions, FIG. 25B is a relationship diagram of emitted light characteristics of green and color matching functions, and FIG. 25C is a relationship diagram of emitted light characteristics of red and color matching functions. As shown in FIG. 25, the two light sources that constitute each primary color light source share the same peak wavelength but differ in spreads of spectra. Light sources R1, G1, and B1 are narrow light sources and light sources R2, G2, and B2 are broad light sources.

A region 6200 of the color wheel 6010 is coated with a phosphor that emits visible light having the characteristics of r1 (λ) when irradiated by ultraviolet light. In a similar manner, the regions 6201 to 6205 are coated with phosphors that emit visible light with the characteristics of r2 (λ), g1λ), g2 (λ), b1 (λ), and br2 (λ) when irradiated by ultraviolet light.

In the seventh embodiment, relative lighting intensities of emitted light from the phosphor layer 6013 in a normal state are set to NPb1=1.0,
NPb2=1.0,
NPg1=1.0,
NPg2=1.0,
NPr1=1.0, and
NPr2=1.0.

A method of calculating the light source lighting intensity 1021 according to the seventh embodiment will be described.

When it is determined that many white pixels are included in step S201 shown in FIG. 10, lighting intensities of light sources are set in step S202 so as to minimize individual variability in the appearance of color. Specifically, the light source lighting intensity 1021 is set to bl.R1=0.0,
bl.R2=1.0,
bl.G1=0.0,
bl.G2=1.0,
bl.B1=0.0, and
bl.B2=1.0 so that light with broad emission spectrum characteristics is emitted from the phosphor layer 6013.

When it is determined that many white pixels are not included in step S201 shown in FIG. 10, lighting intensities of light sources are set in steps S203, S204, and S205 so as to enable wide color gamut display. Specifically, the light source lighting intensity 1021 is set to bl.R1=1.0,
bl.R2=0.0,
bl.G1=1.0,
bl.G2=0.0,
bl.B1=1.0, and
bl.B2=0.0 so that light with narrow emission spectrum characteristics is emitted from the phosphor layer 6013. Other configurations and procedures are similar to those of the third embodiment.

FIG. 26 is a diagram showing a relationship between the light source lighting intensity 1021 and light source driving time when the light source 6000 is controlled according to the PWM modulation system in the seventh embodiment.

Figures 26A, 26B:
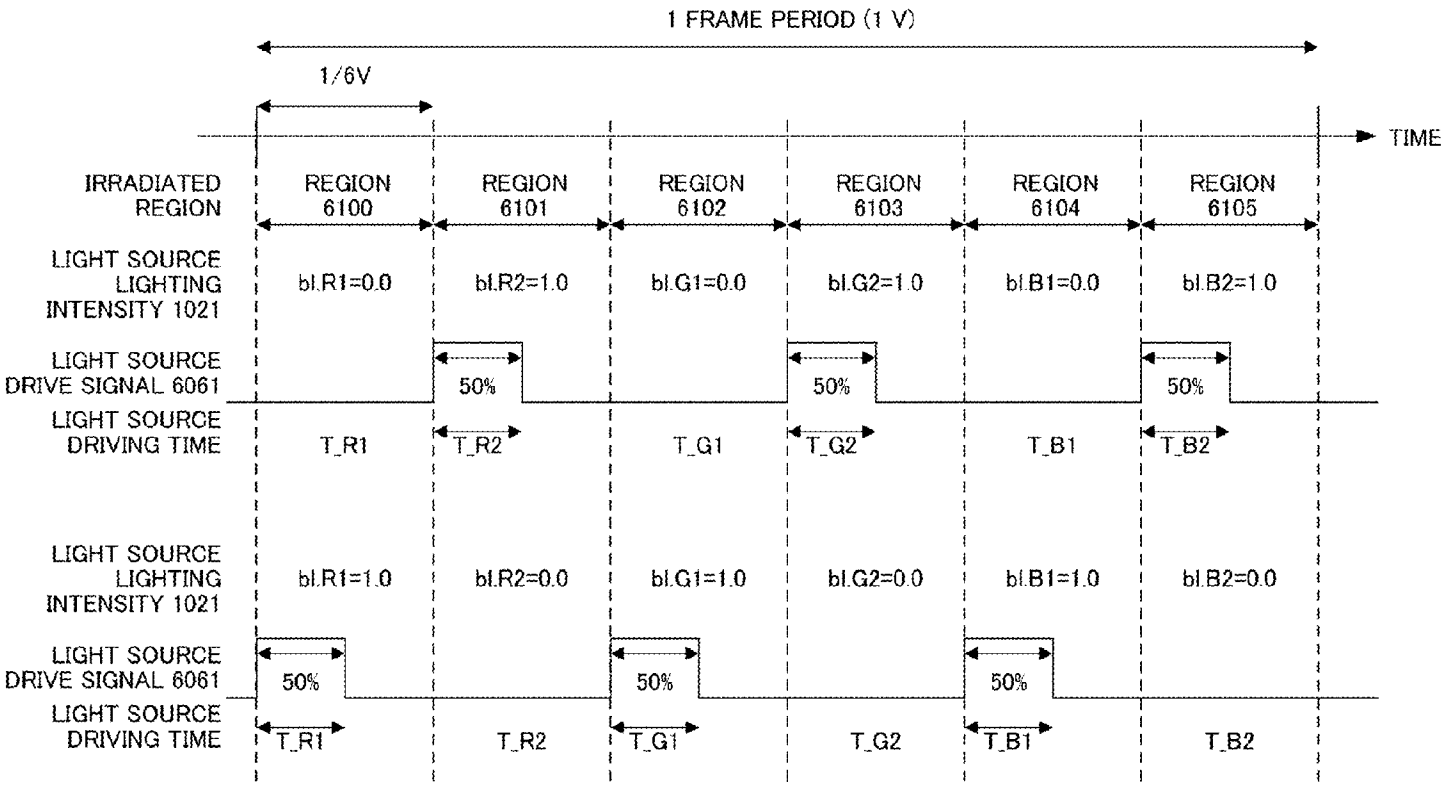
FIGS. 26A and 26B are diagrams showing relationships between light source lighting intensity and light source driving time according to the seventh embodiment.

FIG. 26A shows a case where it is determined that many white pixels are included in step S201 shown in FIG. 10. In this case, pulse widths of the light source drive signals 6081 of the regions 6101, 6103, and 6105 are 50% of a maximum pulse width, and pulse widths of the light source drive signals 6081 of the regions 6100, 6102, and 6104 are 0% of a maximum pulse width. Therefore, as shown in FIG. 26A, the periods over which the light source 6000 irradiates the regions 6101, 6103, and 6105 are respectively 1/12 V and the periods over which the light source 6000 irradiates the regions 6100, 6102, and 6104 are respectively 0 V.

FIG. 26B shows a case where it is determined that many white pixels are not included in step S201 shown in FIG. 10. In this case, pulse widths of the light source drive signals 6081 of the regions 6101, 6103, and 6105 are 0% of a maximum pulse width, and pulse widths of the light source drive signals 6081 of the regions 6100, 6102, and 6104 are 50% of a maximum pulse width. Therefore, as shown in FIG. 26B, the periods over which the light source 6000 irradiates the regions 6101, 6103, and 6105 are respectively 0 V and the periods over which the light source 6000 irradiates the regions 6100, 6102, and 6104 are respectively 1/12 V.

As described above, the present invention can also be applied to a projector in which a phosphor layer of the color wheel 6010 is configured so that the light source of each of the three RGB primary colors is constituted by a combination of a narrow light source with a narrow emission spectrum and a broad light source with a broad emission spectrum.

Moreover, a method of controlling the amount of light of the light source 6000 in the seventh embodiment may be any of the PWM system according to the fifth embodiment and the PAM system according to the sixth embodiment.

In the seventh embodiment, an example has been shown in which the light source lighting intensity 1021 is calculated so as to enable switching between using only light emitted from a phosphor with a broad spectrum and using only light emitted from a phosphor with a narrow spectrum depending on whether or not many white pixels are included in an input image. However, an intensity ratio of the intensity of emitted light with a broad spectrum and the intensity of emitted light with a narrow spectrum may be varied in stages or varied continuously in accordance with an inclusion ratio of white pixels. Alternatively, an intensity ratio of the intensity of emitted light with a broad spectrum and the intensity of emitted light with a narrow spectrum may be varied for each color depending on which color has high chroma.

Eighth Embodiment

Next, an eighth embodiment of the present invention will be described. While two light-emitting diodes with different emission wavelengths are used for each RGB primary color in the first embodiment, the eighth embodiment uses one light-emitting diode and realizes lighting at two different emission wavelengths by changing a current value that is applied to the light-emitting diode with respect to time.

Figure 27:
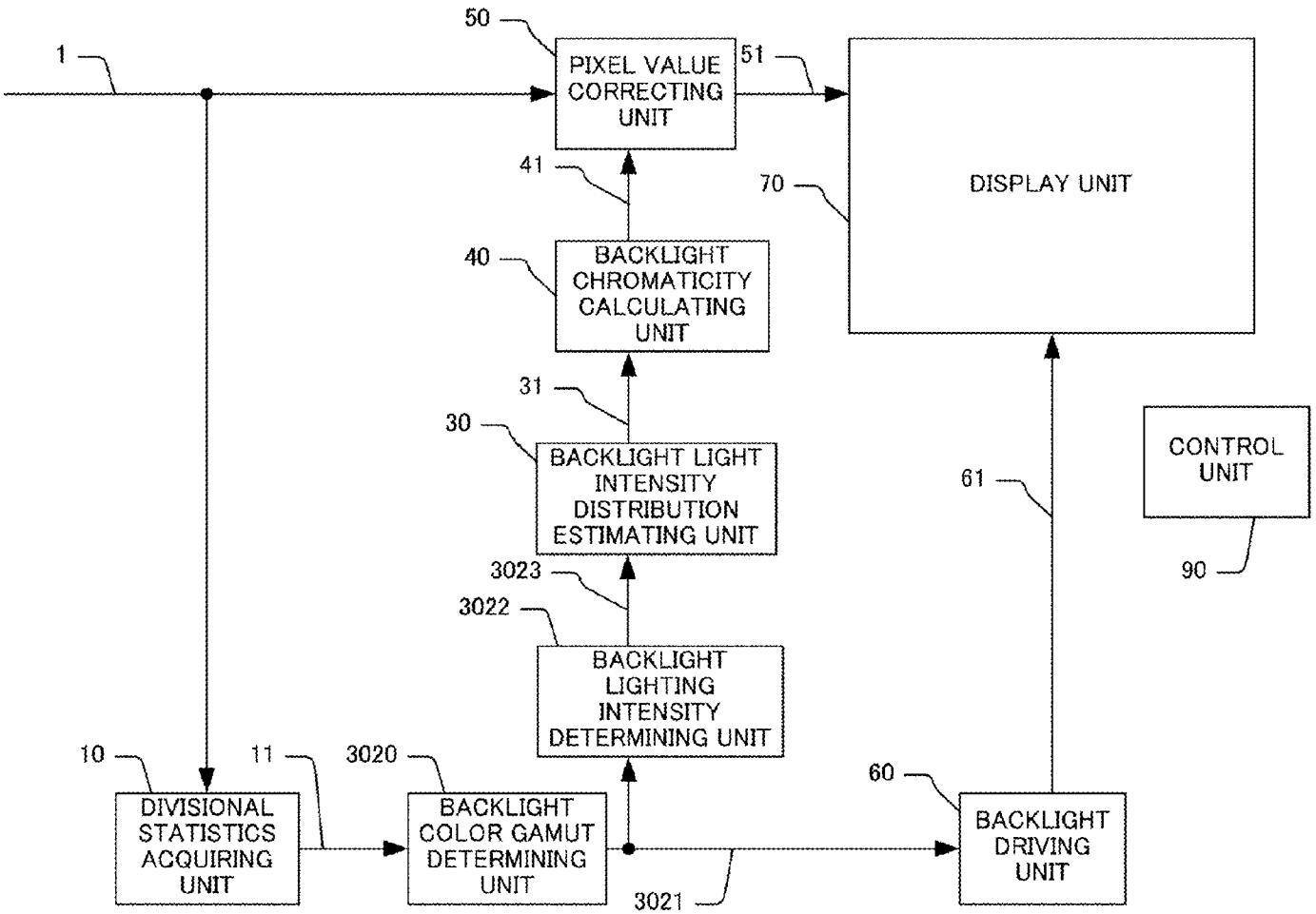
FIG. 27 is a configuration diagram of an image display device according to an eighth embodiment.

FIG. 27 shows a configuration diagram of an image display device according to the eighth embodiment of the present invention. The image display device according to the eighth embodiment differs from that of the first embodiment in that the image display device includes a backlight color gamut determining unit 3020 and a backlight lighting intensity determining unit 3022. Detailed descriptions of the respective units will be provided later. In addition, the same functional blocks and signals as the first embodiment described earlier will be assigned the same reference characters and a description thereof will be omitted.

Figure 28:
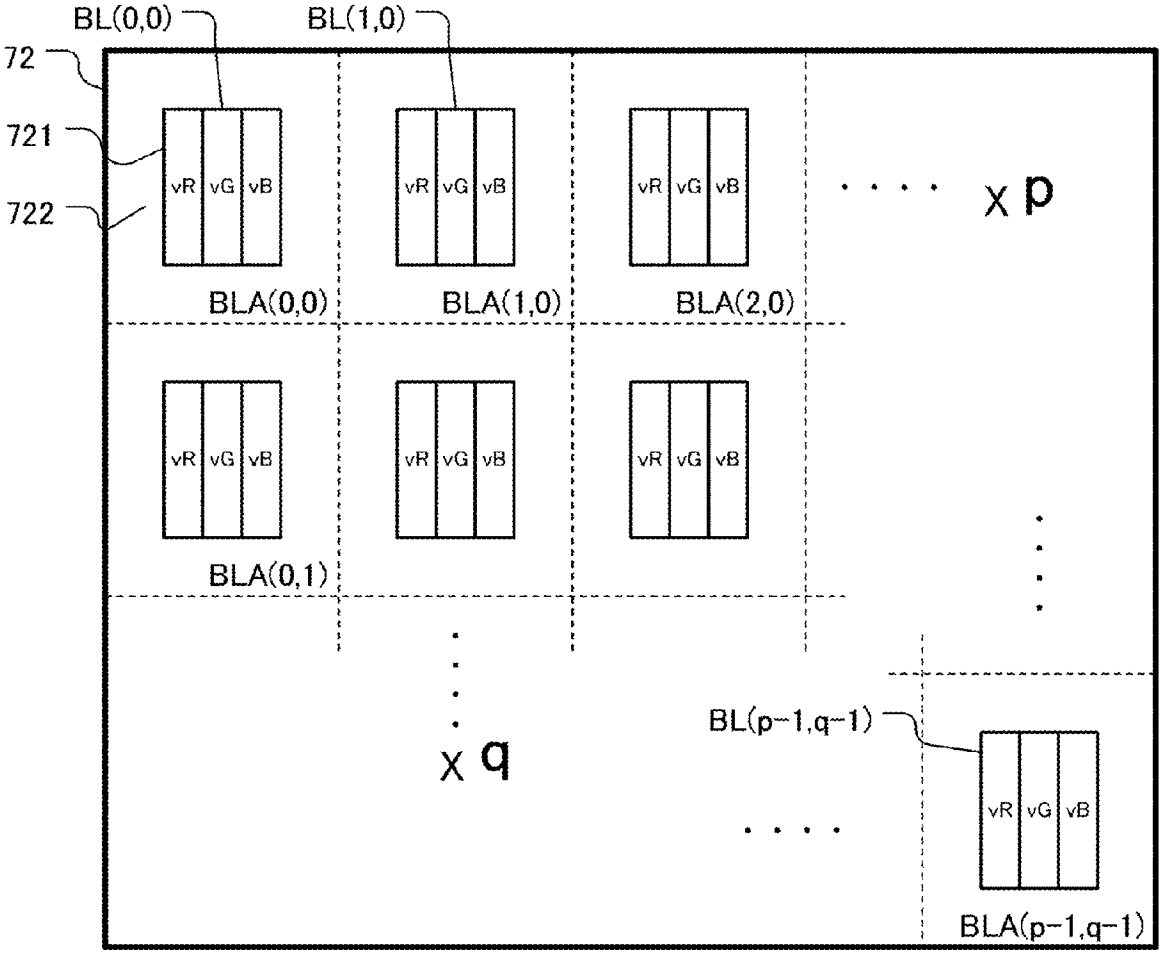
FIG. 28 is a conceptual diagram of a backlight unit according to the eighth embodiment.

First, the backlight unit 72 that constitutes the liquid crystal panel unit 71 of the display unit 70 will be described. FIG. 28 shows a configuration of the backlight unit 72 according to the eighth embodiment. In the first embodiment described earlier, a configuration in which the six light-emitting diodes R1, R2, G1, G2, B1, and B2 are arranged in each backlight area 722 has been shown. In contrast, in the eighth embodiment, three light-emitting diodes vR, vG, and vB are arranged in each backlight area 722. As the light-emitting diodes vR, vG, and vB, light-emitting diodes are used whose emission peak wavelengths vary depending on a driving current value as follows.

Light-emitting diode vB:
at current value IvB1, λvb1=420 nm
at current value IvB2, λvb2=470 nm
at current value IvB3, λvb3=432 nm
at current value IvB4, λvb4=458 nm
at current value IvB5, λvb5=445 nm
Light-emitting diode vG:
at current value IvG1, λvg1=545 nm
at current value IvG2, λvg2=565 nm
at current value IvG3, λvg3=550 nm
at current value IvG4, λvg4=560 nm
at current value IvG5, λvg5=555 nm
Light-emitting diode vR:
at current value IvR1, λvr1=590 nm
at current value IvR2, λvr2=620 nm
at current value IvR3, λvr3=595 nm
at current value IvR4, λvr4=610 nm In the eighth embodiment, one light-emitting diode is used by alternately lighting the light-emitting diode at two emission wavelengths. In doing so, by setting a sufficiently short lighting cycle, characteristics of the light source can be considered equal to lighting two light sources in a similar manner to the first embodiment.

In addition, in the eighth embodiment, a plurality of combinations of alternately lighted wavelengths can be adopted. A reduction in individual variability in color appearance in this case will be described using the light-emitting diode vB as an example.

Figure 29A:
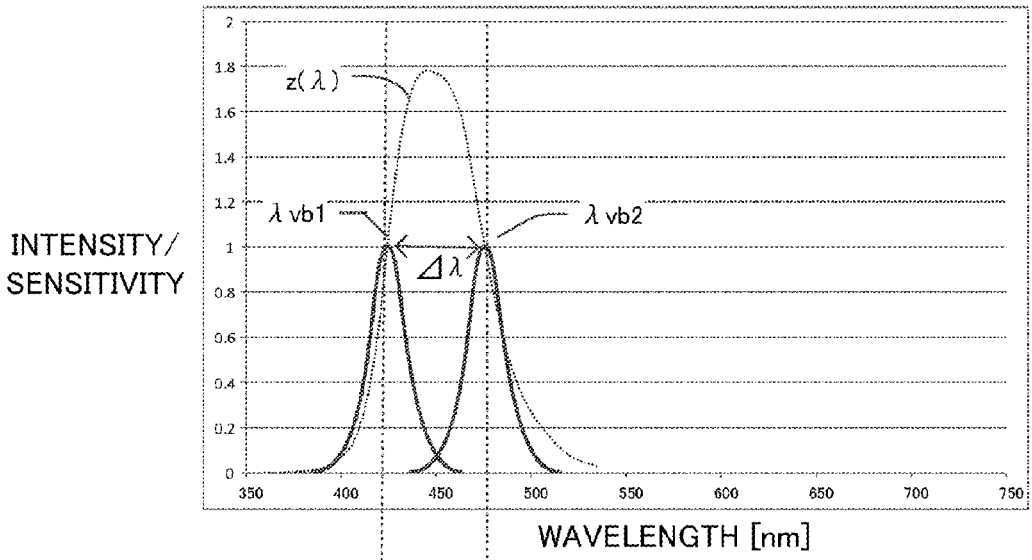
FIGS. 29A and 29B show examples of combinations of emission peak wavelengths that are alternately lighted in an individual variability reducing mode.
Figure 29B:
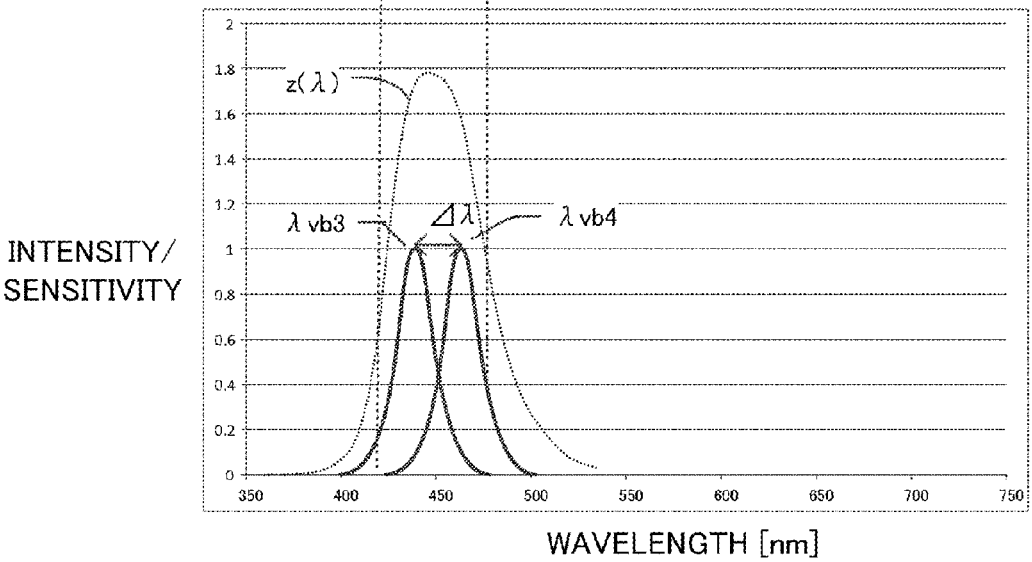

FIG. 29A shows an example of an emission spectrum when light is emitted from the light-emitting diode vB at peak wavelengths λvb1 and λvb2. In addition, FIG. 29B shows an example of an emission spectrum when light is emitted at peak wavelengths λvb3 and λvb4. If a color matching function that varies due to individual variability has a peak within a width Δλ between the peak wavelengths λvb1 and λvb2 in FIG. 29A, individual variability of color appearance can be favorably reduced. On the other hand, since Δλ of the emission spectrum shown in FIG. 29B is narrower than that of the emission spectrum shown in FIG. 29A, an effect of suppressing individual variability in the appearance of color is smaller than when light is emitted from the light-emitting diode vB as shown in FIG. 29A. However, since color purity is high, a color gamut of the backlight can be widened. While details will be provided later, in the eighth embodiment, the light-emitting diode is selectively used to emit light as shown in FIG. 29A or to emit light as shown in FIG. 29B based on statistics of an input image.

Next, the divisional statistics acquiring unit 10 according to the eighth embodiment will be described. A configuration of the divisional statistics acquiring unit 10 according to the eighth embodiment is similar to that of the first embodiment and is as shown in FIG. 1B. In the eighth embodiment, blocks which perform operations that differ from the first embodiment will be described.

The color gamut determining unit 120 determines whether or not the xy value 111 of each pixel is a value in the color gamut and outputs a color gamut determination result 121. In this case, the term color gamut refers to a color gamut of the backlight that is formed by the light-emitting diodes vB, vG, and vR. The color gamut is defined in plurality in advance. In addition, the term color gamut determination result 121 refers to a result of determining, for each of the color gamuts defined in advance, whether or not the xy value 111 is a value in the color gamut. Details will be described below.

Figure 30:
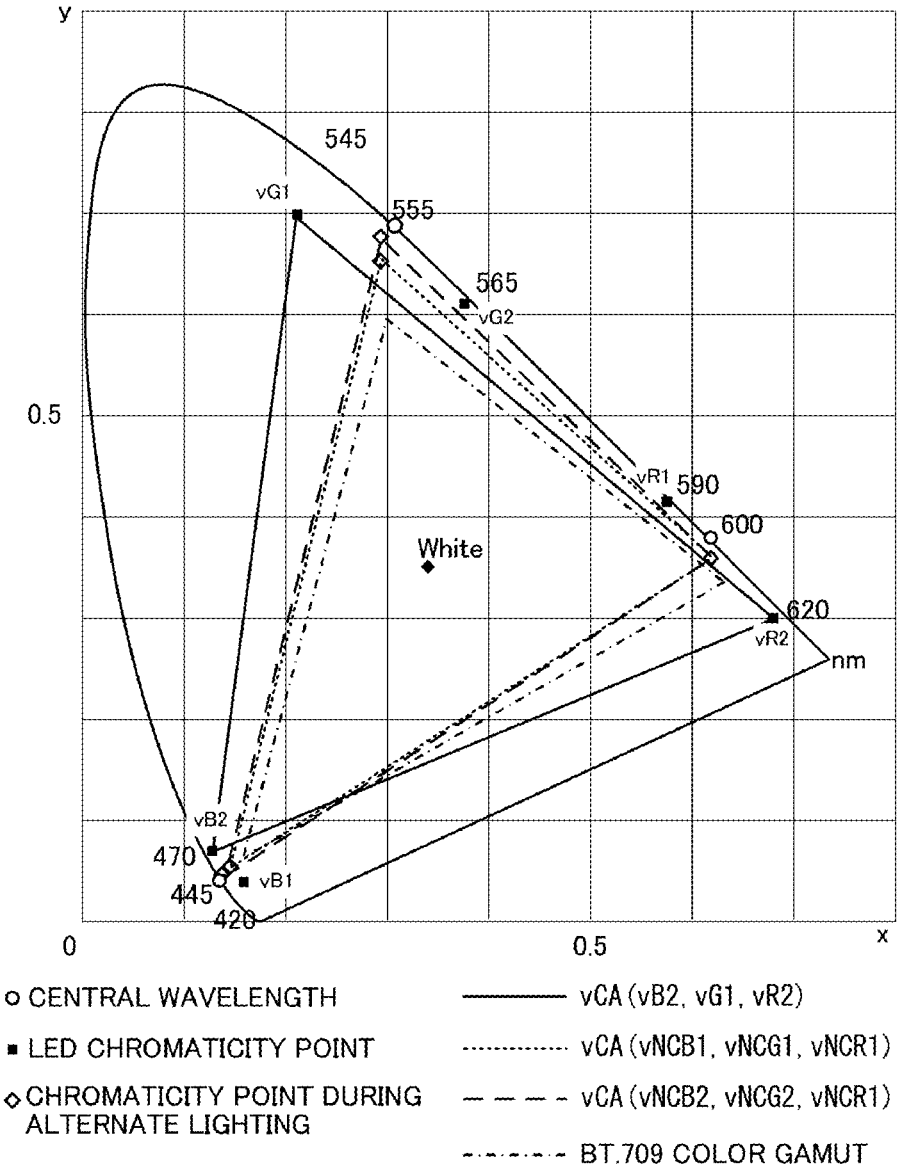
FIG. 30 is a conceptual diagram of a color gamut in a color gamut determining process according to the eighth embodiment.
Figure 31A:
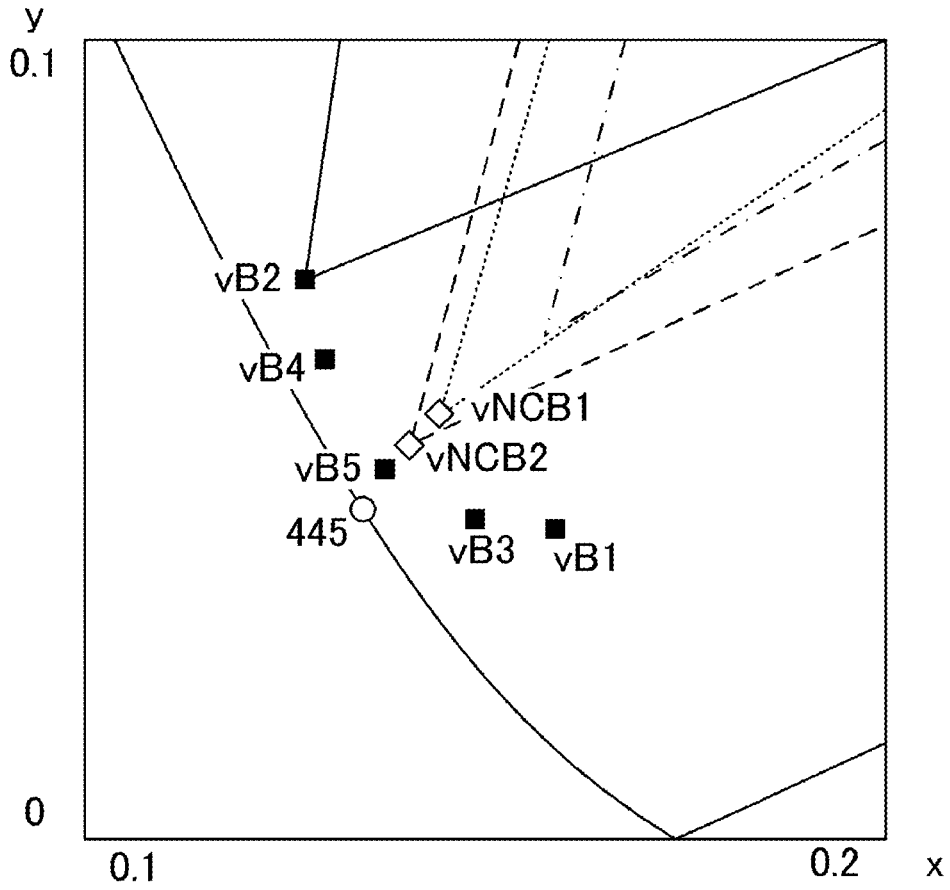
FIGS. 31A and 31B are diagrams of a vicinity of B and G primary colors in FIG. 30.
Figure 31B:
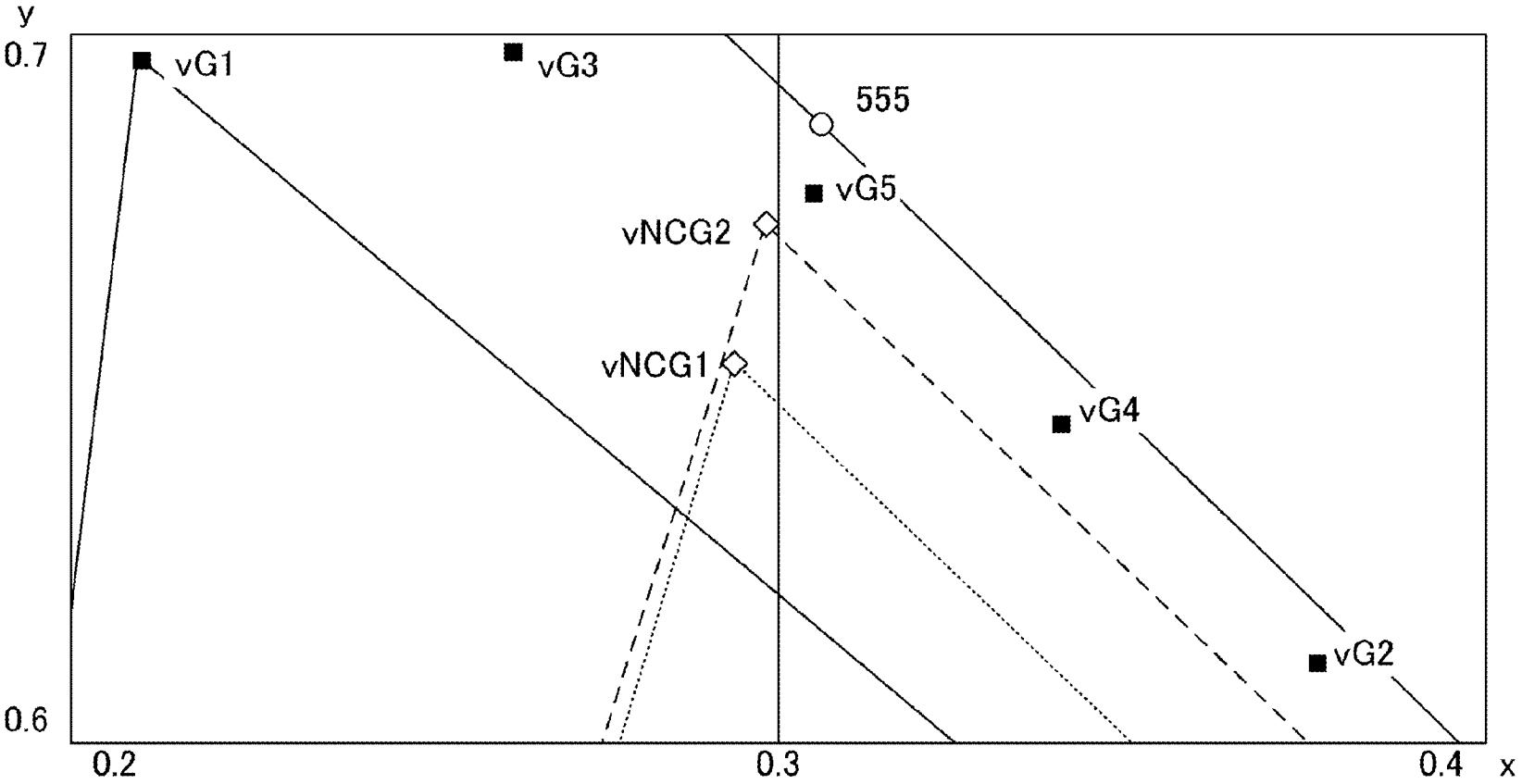
Figure 32:
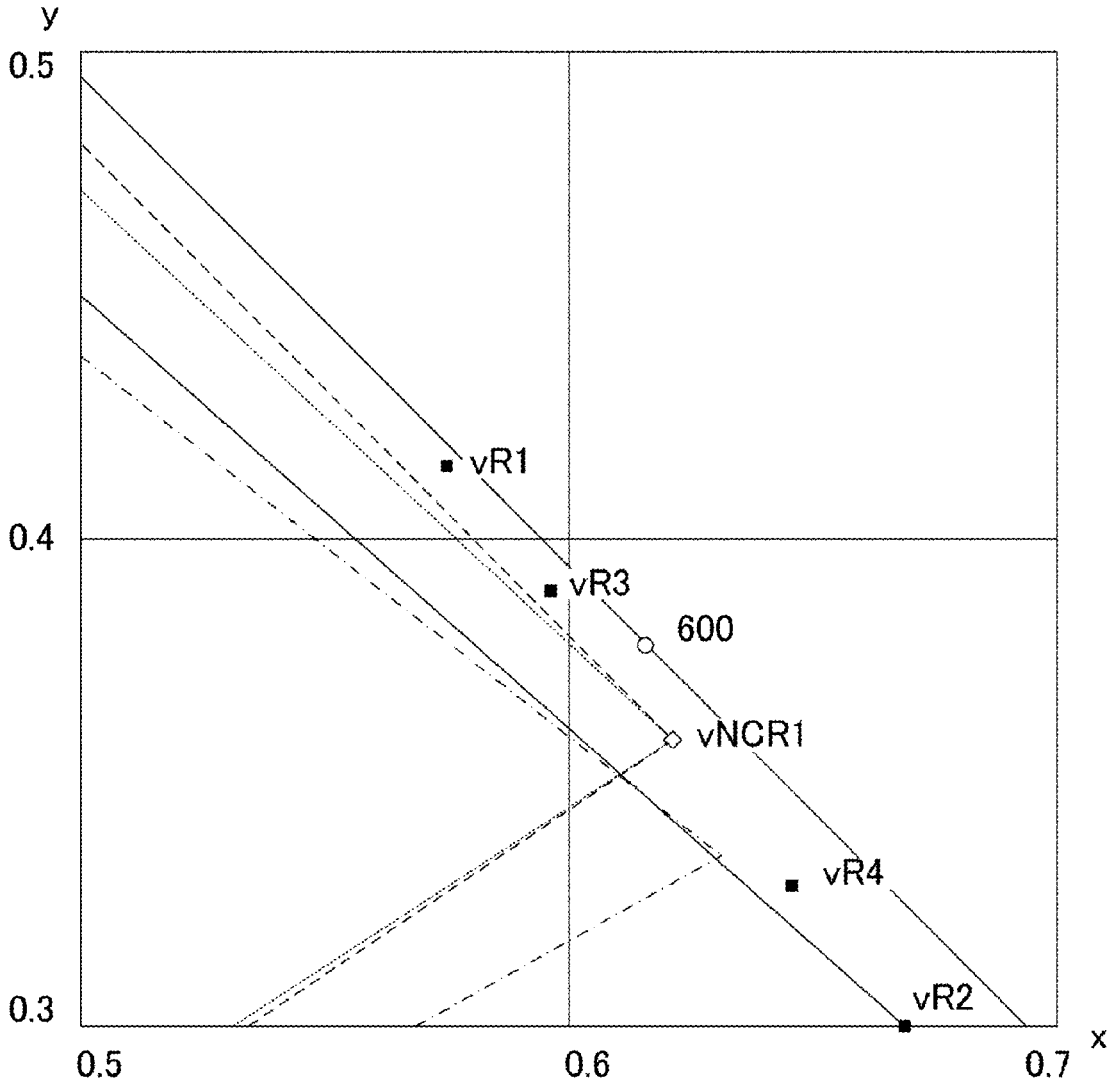
FIG. 32 is a diagram of a vicinity of an R primary color in FIG. 30.

FIG. 30 shows a conceptual diagram of the color gamut determining process according to the eighth embodiment. FIG. 30 illustrates chromaticities of the light-emitting diodes vB, vG, and vR. In addition, FIG. 31A shows an enlarged view of a vicinity of the B primary color shown in FIG. 30, FIG. 31B shows an enlarged view of a vicinity of the G primary color shown in FIG. 30, and FIG. 32 shows an enlarged view of a vicinity of the R primary color shown in FIG. 30.

The chromaticities of the light-emitting diodes vB, vG, and vR used in the eighth embodiment differ according to current values. Therefore, chromaticity points of the light-emitting diode vB at the current values IvB1 to IvB5 are defined as vB1 to vB5. In a similar manner, chromaticity points of the light-emitting diode vG at the current values IvG1 to IvG5 are defined as vG1 to vG5, and chromaticity points of the light-emitting diode vR at the current values IvR1 to IvR4 are defined as vR1 to vR4. Furthermore, the following five points are defined as chromaticity points when the light-emitting diodes are alternately lighted at different wavelengths.

vNCB1: chromaticity point when vB is alternately lighted at chromaticities of vB1 and vB2 vNCB2: chromaticity point when vB is alternately lighted at chromaticities of vB3 and vB4 vNCG1: chromaticity point when vG is alternately lighted at chromaticities of vG1 and vG2 vNCG2: chromaticity point when vG is alternately lighted at chromaticities of vG3 and vG4 vNCR1: chromaticity point when vR is alternately lighted at chromaticities of vR1 and vR2

Moreover, with respect to the light-emitting diode vR, a chromaticity point vR5 at a current value of IvR5 and a chromaticity point NCR2 when alternately lighting vR at chromaticities of vR3 and vR4 may be considered in a similar manner to vB and vG. However, since vNCR2 assumes chromaticity that is approximately the same as vR5 and vNCR1 in this case, these chromaticity points are not defined in the eighth embodiment.

Using these chromaticity points, a color region vCA (CBx, CGx, CRx) enclosed by three chromaticity points is defined. CBx, CGx, and CRx in vCA (CBx, CGx, CRx) represent chromaticity points of the three primary color points of the color region. In the eighth embodiment, CBx assumes any of the seven chromaticity points including vB1 to vB5, vNCB1, and vNCB2, CGx assumes any of the seven chromaticity points including vG1 to vG5, vNCG1, and vNCG2, and CRx assumes any of the five chromaticity points including vR1 to vR4 and vNCR1. Therefore, 7×7×5=245 color regions vCA are to be defined. For example, the color region vCA (vB2, vG1, vR2) is a triangular region enclosed by solid lines in FIGS. 30 to 32. In addition, the color region vCA (vNCB1, vNCG1, vNCR1) is a region enclosed by dotted lines, and the color region vCA (vNCB2, vNCG2, vNCR1) is a region enclosed by dashed lines.

As already described in the first embodiment, individual variability in tinge can be reduced by using light sources with different peak wavelengths. Therefore, in the eighth embodiment, color regions using the chromaticity points vNCB1, vNCB2, vNCG1, vNCG2, and vNCR1 are color regions that are likely to absorb individual variability in tinge. In addition, since vNCB1 uses two peak wavelengths that are further separated from a peak wavelength of a standard blue color matching function z (λ) than vNCB2, vNCB1 is more capable of reducing individual variability in tinge than vNCB2. On the other hand, since vNCB2 is a chromaticity that is further separated from a white point than vNCB1 as shown in FIG. 31A, vNCB2 is capable of constituting a wider color region than vNCB1. The same applies to vNCG1 and vNCG2 which represent green primary colors. In addition, as for the red primary color point, since a chromaticity point when alternately lighting vR1 and vR2 and a chromaticity point when alternately lighting vR3 and vR4 are approximately the same, only vNCR1 is defined as a chromaticity point that is more capable of reducing individual variability.

The color gamut determining unit 120 determines, for each of the 245 color regions described above, whether or not the xy value 111 is within the color region and sets a corresponding flag in a structure of the color gamut determination result 121. A construction of the structure of the color gamut determination result 121 is shown below.

```
{
BOOL vCA[7][7][5];
}CFLAG;
```

Indexes of vCA sequentially correspond to CBx, CGx, and CRx. In addition, TRUE is set to a color region that includes the xy value 111 while FALSE is set to other color regions. Since some of the respective color regions overlap each other, there may be cases where a TRUE flag is set for a plurality of color regions at the same time.

The accumulative adding unit 140 accumulates the color gamut determination result 121 and the region determination result 131 to calculate the divisional statistics 11. A construction of the structure of the divisional statistics 11 is shown below.

```
{
int vCA[7][7][5];
}CHIST(p, q);
```

Indexes of vCA sequentially correspond to CBx, CGx, and CRx.

In a similar manner to the first embodiment, a frequency of the color gamut determination result 121 is integrated for each backlight area. The divisional statistics 11 is outputted per frame. In addition, all frequencies are cleared per frame after being outputted.

Next, the backlight color gamut determining unit 3020 will be described.

The backlight color gamut determining unit 3020 determines a backlight color gamut 3021 based on the divisional statistics 11. A specific determination method is as follows.

The divisional statistics 11 provides the number of pixels in each color region vCA (CBx, CGx, CRx) for each backlight area. Based on the divisional statistics 11, for each backlight area, the backlight color gamut determining unit 3020 selects a color region that includes a threshold number or more pixels in the backlight area. In doing so, since pixels outside a color region causes color saturation, a color region capable of displaying approximately all of the pixels is desirably selected. In the eighth embodiment, it is assumed that the backlight color gamut determining unit 3020 selects, for each backlight area, a color region including 99.9% or more pixels in the backlight area among the respective color regions vCA (CBx, CGx, and CRx).

While there are cases where a plurality of color regions are selected as a result of the determination, in such cases, the backlight color gamut determining unit 3020 selects one color region according to a color region priority specified in advance. In the eighth embodiment, the color region vCA (vNCB1, vNCG1, vNCR1) having a high individual variability reduction effect is given the highest priority, and the color region vCA (vNCB2, vNCG2, vNCR1) is given the second highest priority. The other 243 color regions are prioritized in a descending order of narrowness of the color regions.

On the other hand, when no color region is selected, the backlight color gamut determining unit 3020 selects the color region vCA (vB5, vG5, vNCR1).

The backlight color gamut determining unit 3020 performs the processing described above on all backlight areas and outputs a color region selected for each backlight area as the backlight color gamut 3021.

Next, the backlight lighting intensity determining unit 3022 will be described.

The backlight lighting intensity determining unit 3022 determines a lighting intensity and chromaticity of the light-emitting diodes vB, vG, and vR of each backlight area based on the backlight color gamut 3021 and outputs the lighting intensity and the chromaticity as a backlight lighting intensity 3023.

In the eighth embodiment, relative lighting intensities of the light-emitting diodes vB, vG, and vR are assumed to be 1.0 regardless of the backlight area.

The backlight lighting intensity determining unit 3022 sets the chromaticities (CBx, CGx, and CRx) of the B, G, and R primary color points of the backlight color gamut 3021 determined for each backlight area as the chromaticities of the light-emitting diodes vB, vG, and vR.

Next, the backlight driving unit 60 will be described.

Figure 33A:
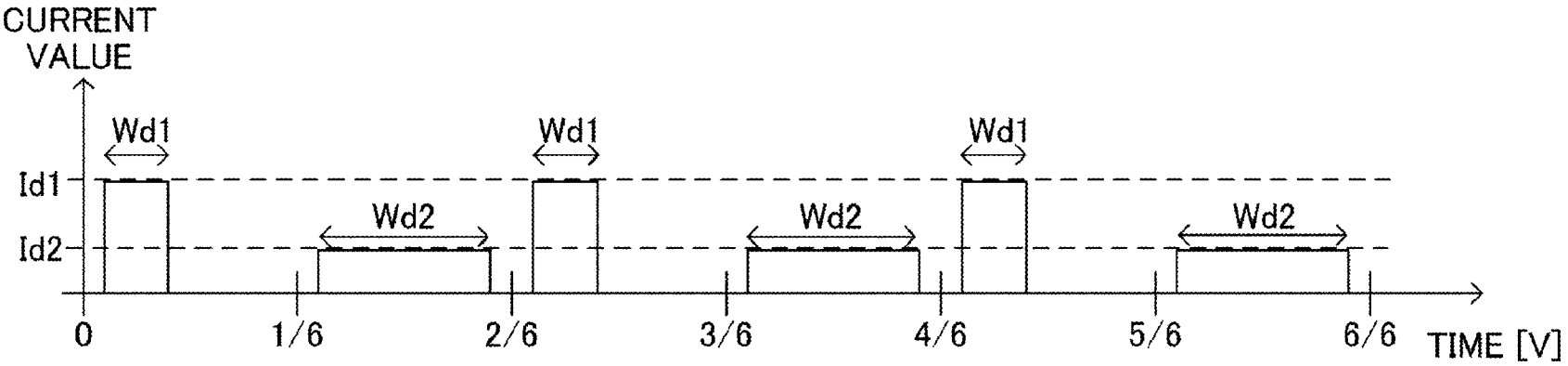
FIGS. 33A and 33B are conceptual diagrams of driving waveforms of a light-emitting diode.

Based on the backlight color gamut 3021, the backlight driving unit 60 determines respective driving waveforms of the light-emitting diodes vB, vG, and vR for each backlight area and outputs the backlight drive signal 61 that drives the backlight of the display unit 70. FIG. 33A shows driving waveforms.

In FIG. 33A, an abscissa represents time and an ordinate represents current values. V of the abscissa denotes one refresh rate period (one frame period) of the liquid crystal panel unit 71. Id1 and Id2 denote current values to be applied to the light-emitting diodes, and Wd1 and Wd2 denote pulse widths when currents having the current values Id1 and Id2 are applied to the light-emitting diodes. Flicker occurs when the time between one application of a current to the next is long. Therefore, in the eighth embodiment, a light-emitting diode is lighted six times in one refresh rate period of the liquid crystal panel unit 71. In addition, by alternately changing the current value that is applied to a light-emitting diode every ⅙ refresh rate period, a single light-emitting diode is lighted at different peak wavelengths. Furthermore, lighting timings are synchronized with a refresh cycle of the liquid crystal panel unit 71. In other words, in the eighth embodiment, by switching current values at regular intervals by time division in one frame period, a plurality of rays of light is emitted by one light-emitting diode.

The backlight driving unit 60 determines Id1, Id2, Wd1, and Wd2 based on the backlight color gamut 3021. Specifically, the backlight driving unit 60 has a correspondence table of chromaticity points of primary colors and values of Id1, Id2, Wd1, and Wd2 in advance, and determines Id1, Id2, Wd1, and Wd2 based on the correspondence table. In addition, since the relative lighting intensities of the light-emitting diodes are all assumed to be 1.0 in the eighth embodiment, the correspondence table is created so as to satisfy Id1×Wd1=Id2×Wd2. In the eighth embodiment, it is assumed that $$Id1 \times Wd1 = Id2 \times Wd2 = Pwr.$$

Figure 34A:
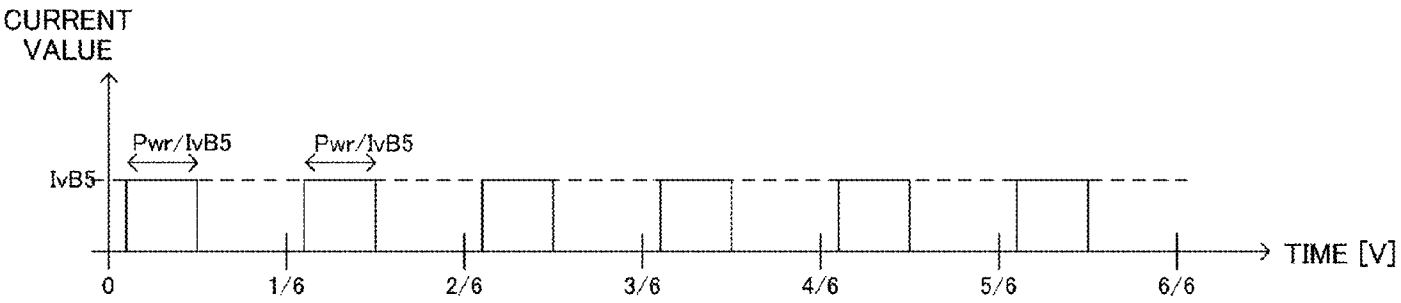
FIGS. 34A to 34C show examples of driving waveforms of a light-emitting diode.

The driving waveforms shown in FIG. 34 will be described as examples. FIG. 34A shows a driving waveform when the primary color point of blue of the backlight color gamut 3021 is vB5. In this case, since the light-emitting diode vB is not lighted at different wavelengths, Id1=Id2=IvB5 and wd1=wd2=Pwr/IvB5[V] are satisfied.

Figure 34B:
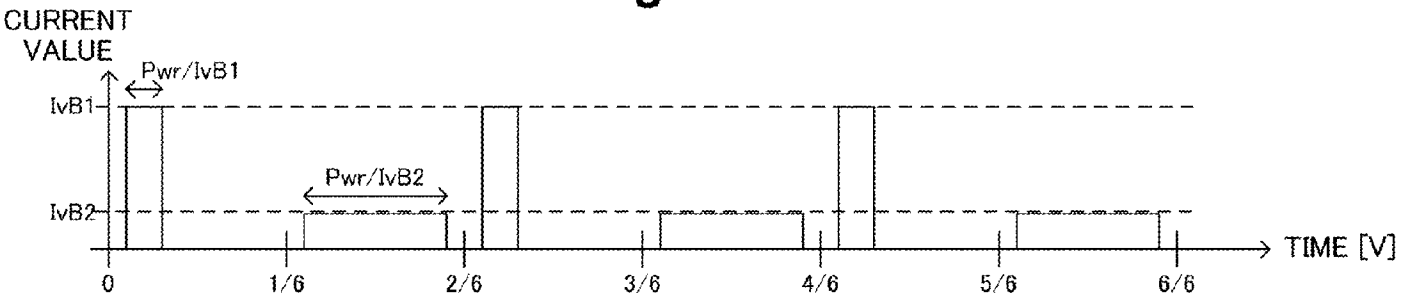

FIG. 34B shows a driving waveform when the primary color point of blue of the backlight color gamut 3021 is vNCB1. In this case, since the light-emitting diode vB is alternately lighted at current values vB1 and vB2, Id1=IvB1, Id2=IvB2, wd1=Pwr/IvB1[V], and wd2=Pwr/IvB2 [V] are satisfied.

Figure 34C:
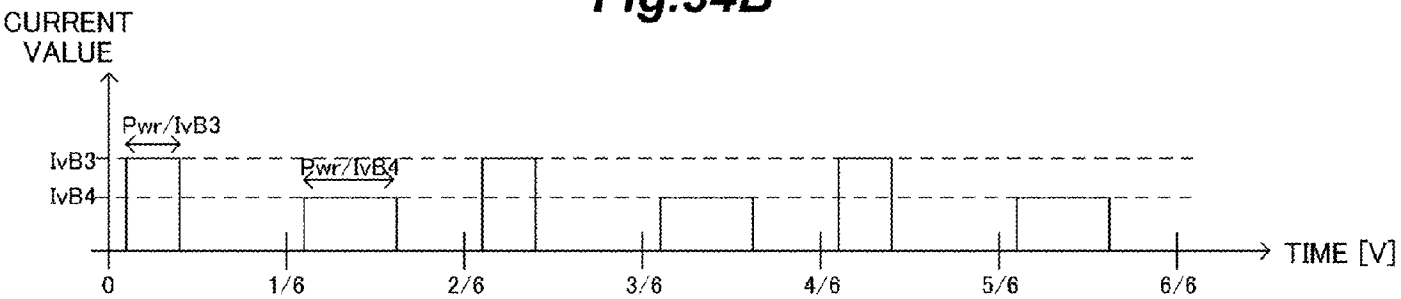

FIG. 34C shows a driving waveform when the primary color point of blue of the backlight color gamut 3021 is vNCB2. In this case, since the light-emitting diode vB is alternately lighted at current values vB3 and vB4, Id1=IvB3, Id2=IvB4, wd1=Pwr/IvB3 [V], and wd2=Pwr/IvB4[V] are satisfied.

Figure 35:
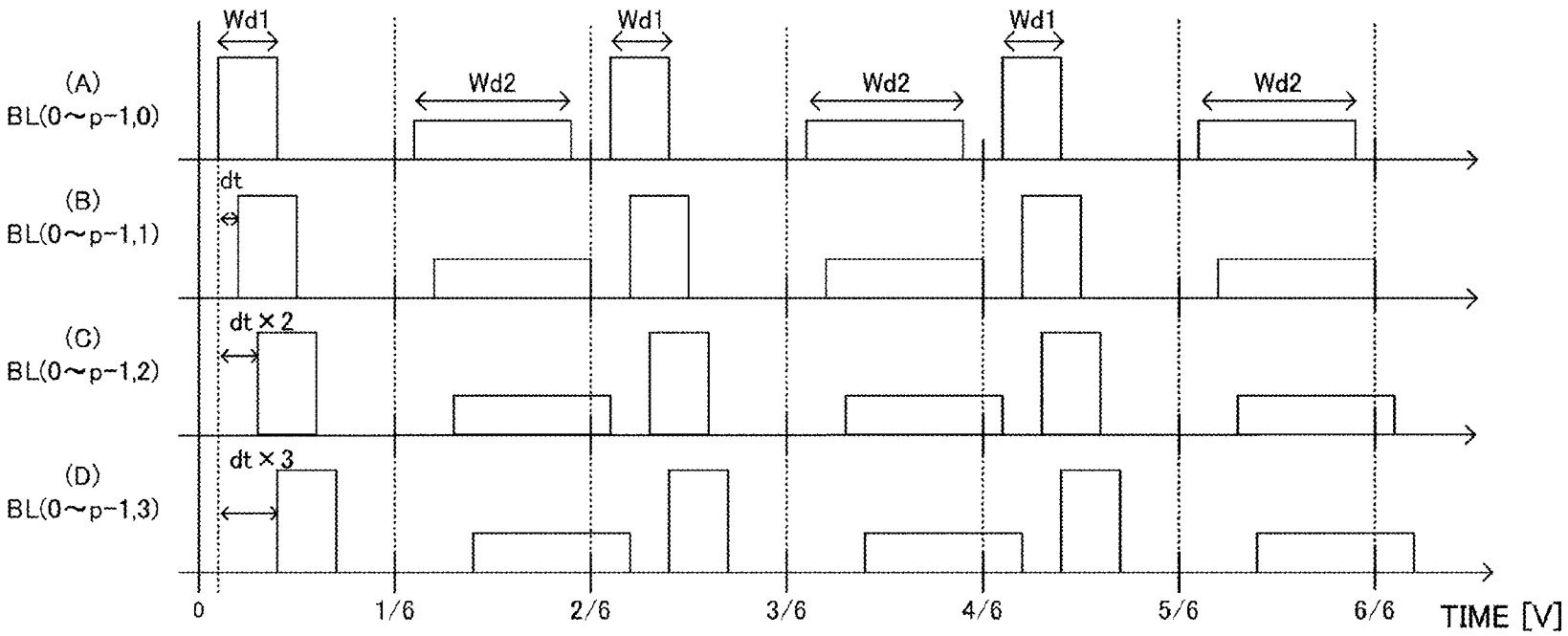
FIG. 35 is a diagram showing current applying timings of a light-emitting diode.

In addition, in the eighth embodiment, maximum power consumption is reduced by offsetting a timing of current application for each light-emitting diode. Specifically, as shown in FIG. 35, a light-emitting diode group BL (0 to p−1, 1) is lighted after a delay of dt[V] with respect to a light-emitting diode group BL (0 to p−1, 0). In a similar manner, the light-emitting diode group BL (0 to p−1, 2) is lighted after a delay of dt×2[V], the light-emitting diode group BL (0 to p−1, 3) is lighted after a delay of dt×3 [V], and so on. Although not illustrated, maximum power consumption is reduced by offsetting application timings of all light-emitting diode groups.

Figure 33B:
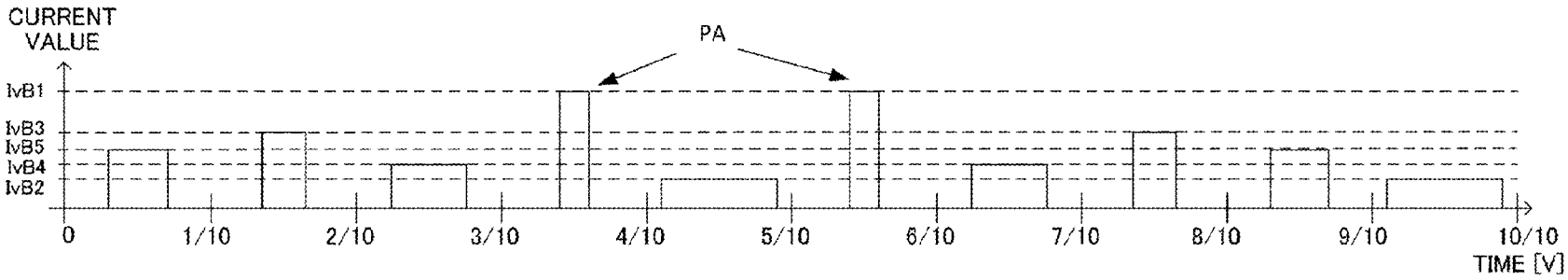

Furthermore, while light-emitting diodes are alternately lighted at two current values in the eighth embodiment, the number of current values may exceed two. For example, as in the case of the light-emitting diode driving waveform shown in FIG. 33B, the light-emitting diodes may be sequentially lighted at a plurality of (five) current values. In this case, since consecutive lighting of short pulse widths causes flicker, a driving waveform is preferably used in which a waveform with a long pulse width is arranged before and after a waveform with a short pulse width as depicted by PA in FIG. 33B.

According to the configurations and the procedures described above, an image display device that achieves both a reduction in individual variability in the appearance of color and an expansion of a display color gamut using a spatial modulator of three primary colors can be constructed.

In addition, since a driving current value of a single light-emitting diode is changed without increasing the number of colors, a decline in brightness of the backlight can be suppressed.

Furthermore, since the eighth embodiment is configured so that changing the driving current value of a single light-emitting diode enables the single light-emitting diode to emit light at a plurality of peak wavelengths, a light source need not be provided for each peak wavelength.

In addition, since a configuration is adopted in which a combination of emission peak wavelengths for alternate lighting is selected from a plurality of combinations in accordance with an image, both a reduction in individual variability in color appearance and an expansion of a display color gamut can be achieved in comparison to a case where there is only one combination of emission peak wavelengths for alternate lighting. Furthermore, since lighting and turning off are repeated a plurality of times in one refresh rate period of the liquid crystal panel, flicker can be reduced as compared to performing lighting once and turning off once in one refresh rate period.

In addition, since a lighting timing is offset for each light-emitting diode group, maximum power consumption can be reduced.

While the eighth embodiment has been described using light-emitting diodes as light sources, the light sources are not limited thereto. A laser light source, an organic EL, or the like capable of varying emission wavelengths may also be used.

Furthermore, while the backlight color gamut 3021 is determined in accordance with pixel values in the eighth embodiment, the backlight color gamut 3021 may be determined in accordance with chroma as in the first embodiment.

Ninth Embodiment

Next, a ninth embodiment of the present invention will be described. While the eighth embodiment selectively uses 245 backlight color gamuts, a ninth embodiment uses only two color gamuts, namely, a color gamut that reduces individual variability in color appearance and a color gamut capable of wide color gamut display (capable of displaying colors with high chroma). An image display device according to the ninth embodiment is approximately the same as that of the eighth embodiment. Only different portions will be described.

Figure 36A:
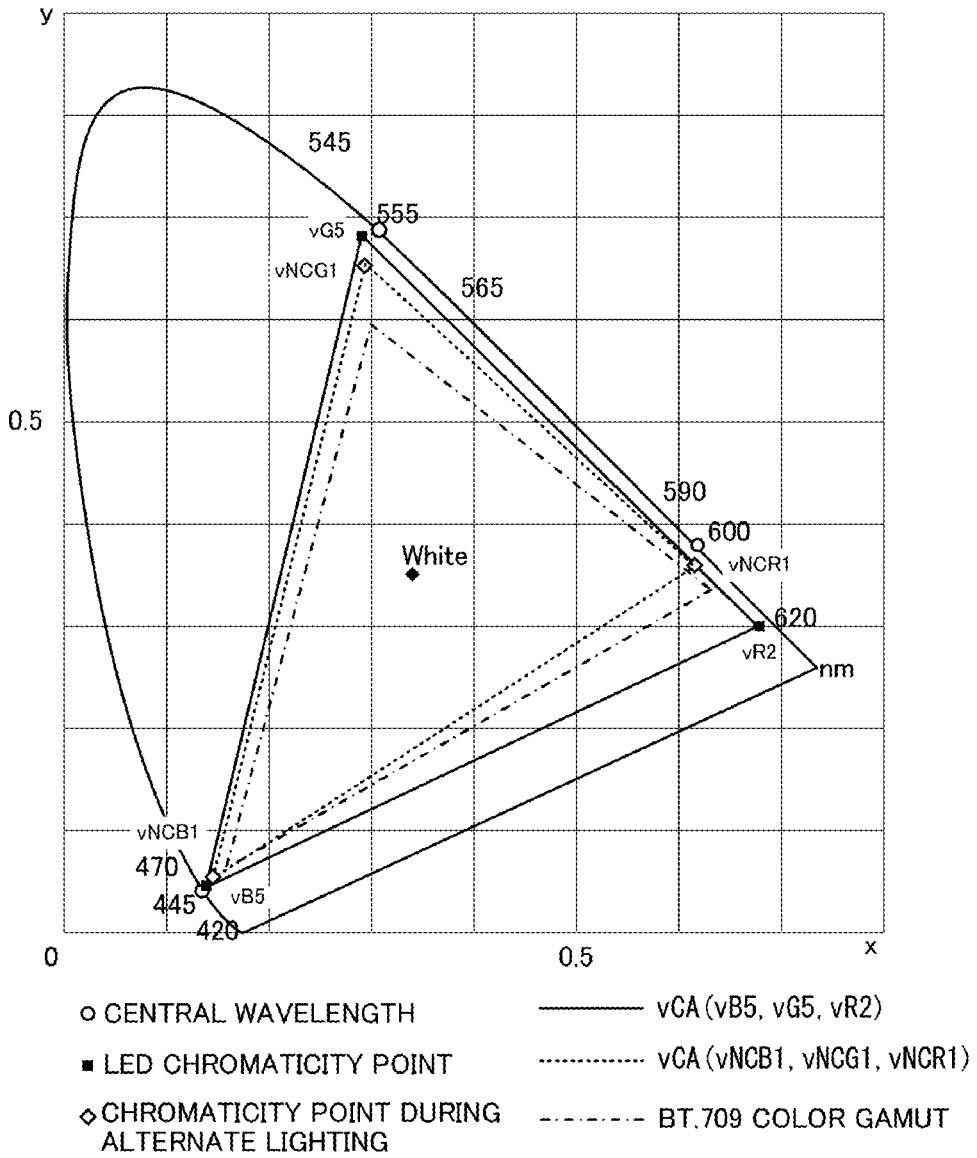
FIGS. 36A and 36B are conceptual diagrams of color gamuts in a color gamut determining process according to tenth and eleventh embodiments.

The color gamut determining unit 120 determines whether or not the xy value 111 of each pixel is a value in a color region and outputs a color gamut determination result 121. A color gamut determining process according to the ninth embodiment is the same as that of the eighth embodiment with the exception of using two color regions vCA (vNCB1, vNCG1, vNCR1) and vCA (vB5, vG5, vR2) as the color regions. FIG. 36A shows the color regions vCA (vNCB1, vNCG1, vNCR1) and vCA (vB5, vG5, vR2). vCA (vNCB1, vNCG1, vNCR1) represents a color gamut capable of reducing individual variability in color appearance, and vCA (vB5, vG5, vR2) represents a color gamut capable of wide color gamut display.

A construction of a structure of the color gamut determination result 121 according to the ninth embodiment is shown below.

```
{
BOOL vCA[2];
}CFLAG;
```

vCA [0] corresponds to vCA (vNCB1, vNCG1, vNCR1), and vCA [1] corresponds to vCA (vB5, vG5, vR2).

The accumulative adding unit 140 accumulates the color gamut determination result 121 and the region determination result 131 to calculate the divisional statistics 11. This process is similar to that of the accumulative adding unit 140 according to the eighth embodiment with the exception of using two color regions. A construction of the structure of the divisional statistics 11 is shown below.

```
{
int vCA[2];
}CHIST(p, q);
```

vCA[0] corresponds to vCA (vNCB1, vNCG1, vNCR1), and vCA[1] corresponds to vCA (vB5, vG5, vR2).

The backlight color gamut determining unit 3020 determines a backlight color gamut 3021 based on the divisional statistics 11. This process is similar to that of the backlight color gamut determining unit 3020 according to the eighth embodiment with the exception of using two color regions. In addition, when a plurality of color regions are selected as a result of the determination, color regions are prioritized in an order of vCA (vNCB1, vNCG1, vNCR1) and vCA (vB5, vG5, vR2). When no color region is selected, the backlight color gamut determining unit 3020 selects vCA (vB5, vG5, vR2).

As described above, even when there are only two color regions, an image display device that realizes both a reduction in individual variability in the appearance of color and an expansion of a display color gamut can be configured.

Tenth Embodiment

Next, a tenth embodiment of the present invention will be described. While the emission peak wavelengths of light-emitting diodes of all three primary colors are controlled in the eighth embodiment, in the tenth embodiment, only the emission peak wavelength of a blue light-emitting diode is controlled. When reducing individual variability in the appearance of color, it is empirically known that reducing individual variability in the appearance of blue is more effective than reducing individual variability in the appearance of red or green. A configuration of an image display device according to the tenth embodiment is approximately the same as that of the ninth embodiment. Only different portions will be described.

Figure 36B:
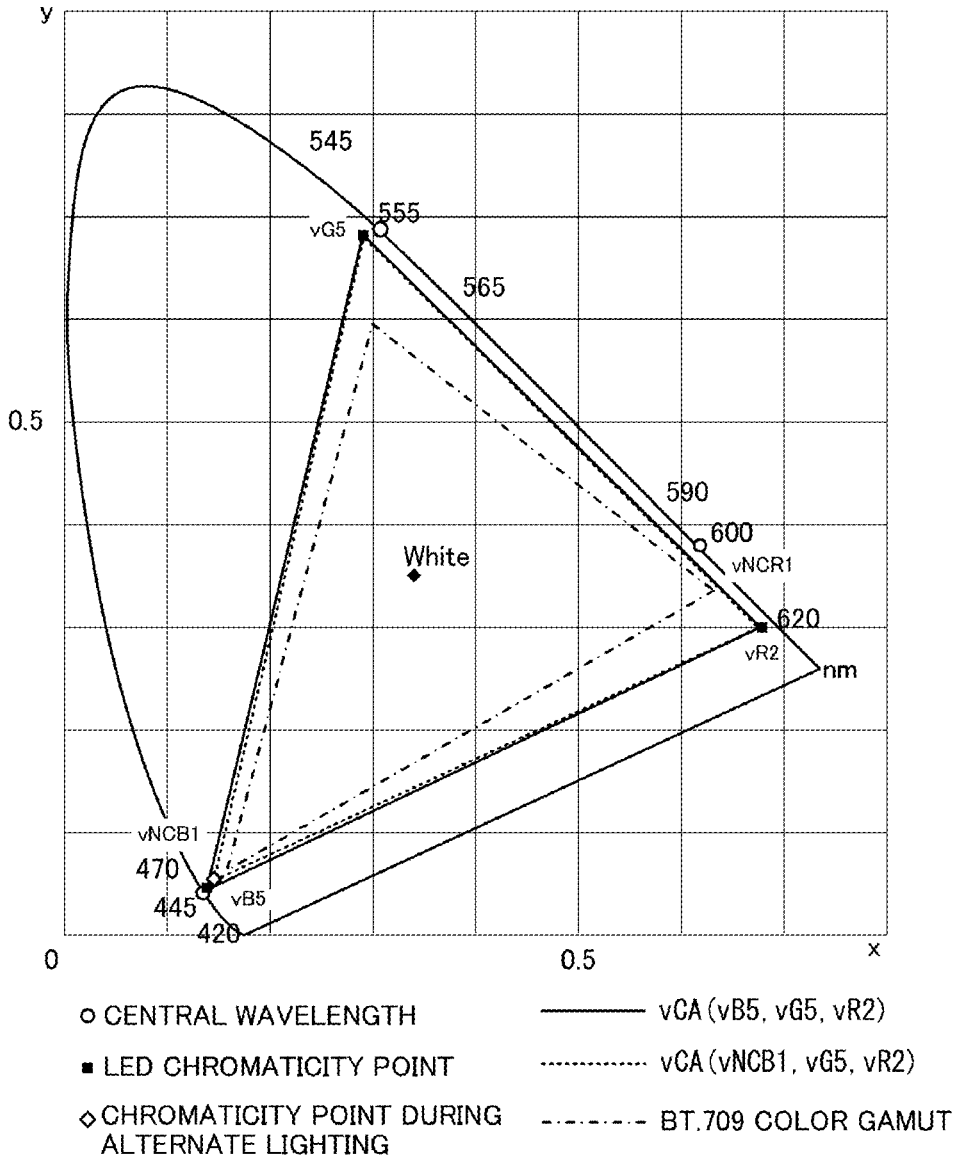

The color gamut determining unit 120 determines whether or not the xy value 111 of each pixel is a value in a color region and outputs a color gamut determination result 121. This process is similar to the color gamut determining process according to the ninth embodiment with the exception of using two color regions vCA (vNCB1, vG5, vR2) and vCA (vB5, vG5, vR2) as the color regions. FIG. 36B illustrates the color regions vCA (vNCB1, vG5, vR2) and vCA (vB5, vG5, vR2). vCA (vNCB1, vG5, vR2) represents a color gamut capable of reducing individual variability in color appearance, and vCA (vB5, vG5, vR2) represents a color gamut capable of wide color gamut display.

The backlight color gamut determining unit 3020 determines a backlight color gamut 3021 based on the divisional statistics 11. When a plurality of color regions are selected as a result of the determination, the color regions are prioritized in an order of vCA (vNCB1, vG5, vR2) and vCA (vB5, vG5, vR2). When no color region is selected, the backlight color gamut determining unit 3020 selects vCA (vB5, vG5, vR2).

As described above, by controlling the emission wavelength of only a part of the primary color light sources among the three RGB primary colors, individual variability in color appearance can be improved to an accuracy that is conceivably required for practical purposes at low cost.

Eleventh Embodiment

The present invention can also be applied to a projector device that projects video on a screen.

Figure 37:
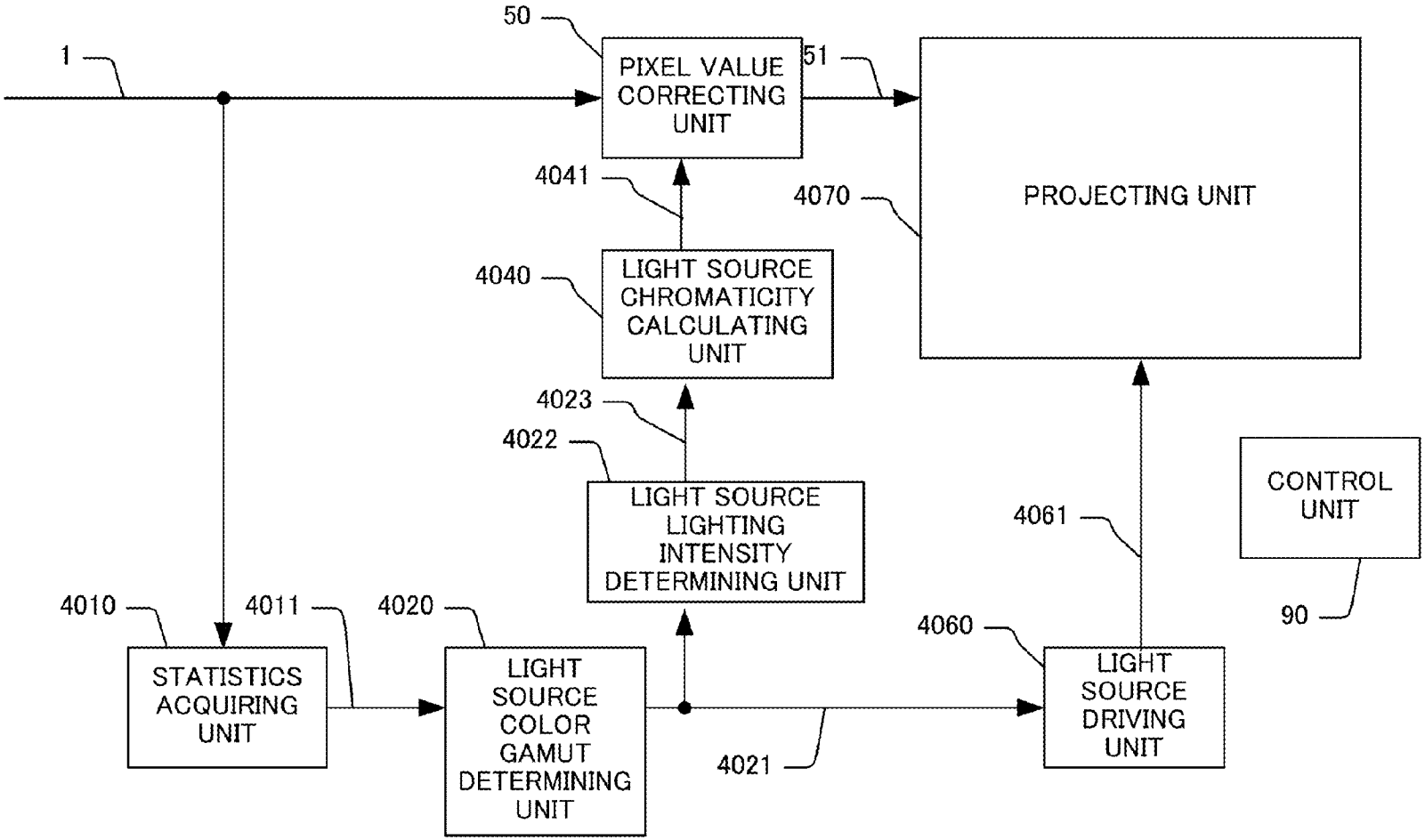
FIG. 37 is a configuration diagram of an image display device according to the eleventh embodiment.

FIG. 37 shows a configuration diagram of an image display device according to the eleventh embodiment of the present invention. With the image display device according to the eleventh embodiment, instead of performing region division lighting control of light sources, light sources are controlled in a uniform manner in a screen.

Figure 38:
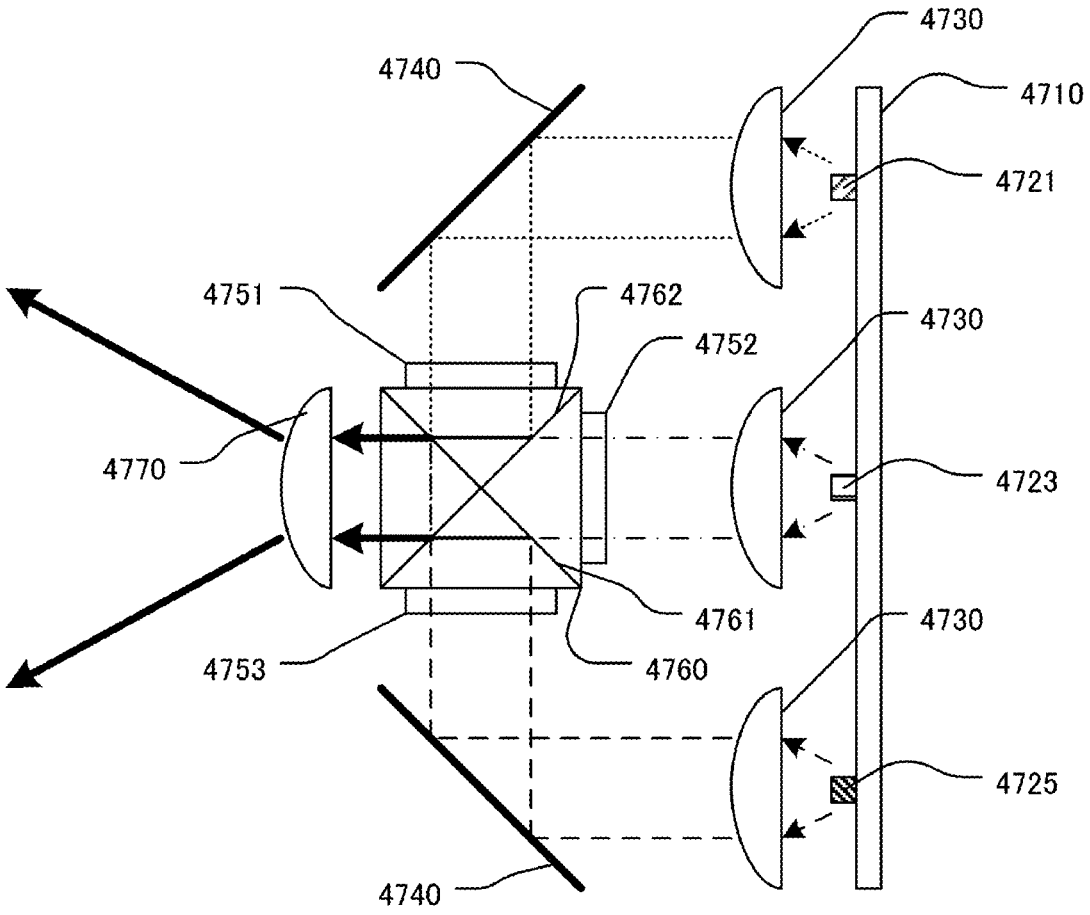
FIG. 38 is a configuration diagram of a projecting unit according to the eleventh embodiment.

A projecting unit 4070 projects an image according to a light source drive signal 4061 and the corrected pixel value 51. FIG. 38 shows a configuration diagram of the projecting unit 4070.

A light source substrate 4710 is a substrate on which light-emitting diodes that are light sources are mounted. A light-emitting diode R 4721 has the same emission characteristics as the light-emitting diode vR used in the eighth embodiment. Therefore, the light-emitting diode R 4721 is also capable of changing emission peak wavelengths depending on driving current values. In a similar manner, a light-emitting diode G 4723 and a light-emitting diode B 4725 have the same emission characteristics as the light-emitting diodes vG and vB according to the eighth embodiment.

A condensing lens 4730 is a lens that condenses light emitted from the light-emitting diode R 4721 to create parallel light.

A reflective mirror 4740 changes an optical path of the condensed light source light and causes the condensed light source light to enter an LCD panel (to be described later).

An LCD panel R 4751 forms a gradation of a red component of the corrected pixel value 51 in a plane and modulates red light source light emitted from the light-emitting diode R 4721.

An LCD panel G 4752 and an LCD panel B 4753 modulate green and blue light source light in a similar manner.

A dichroic prism 4760 composites light source light independently modulated for the three RGB primary colors into a single optical path. A B reflective surface 4761 reflects light in the blue wavelength region and transmits light in other wavelength regions. In addition, an R reflective surface 4762 reflects light in the red wavelength region and transmits light in other wavelength regions.

A projecting lens 4770 projects composite light of the respective modulated light of the three RGB primary colors on a screen.

A statistics acquiring unit 4010 analyzes the input image 1 and calculates statistics 4011. With the exception of an image region for which a histogram is accumulated being an entire region of the input image and therefore a single histogram is created, the statistics acquiring unit 4010 calculates the statistics 4011 using a configuration and a procedure approximately similar to those of the divisional statistics acquiring unit described in the eighth embodiment. A construction of the structure of the statistics 4011 is shown below. A histogram structure CHIST is a single structure and not a two-dimensional array.

```
{
int vCA[7][7][5];
}CHIST;
```

Indexes of vCA sequentially correspond to CBx, CGx, and CRx.

A light source color gamut determining unit 4020 determines a light source color gamut 4021 based on the statistics 4011. A determination method is similar to the method of determining a backlight color gamut described in the eighth embodiment with the exception of treating an entire screen as a single block.

A light source lighting intensity determining unit 4022 determines light source lighting intensity 4023 based on the light source color gamut 4021. The light source lighting intensity 4023 is constituted by information regarding lighting intensities and chromaticities of the light-emitting diode R 4721, the light-emitting diode G 4723, and the light-emitting diode B 4725. A determination method is similar to the method of determining backlight lighting intensity described in the eighth embodiment with the exception of treating an entire screen as a single block.

A light source chromaticity calculating unit 4040 calculates light source chromaticity 4041 based on the light source lighting intensity 4023. Since a chromaticity distribution of a light source is uniform in the eleventh embodiment, if the lighting intensity of the light-emitting diode R 4721 is denoted by bl.vR and an XYZ chromaticity coordinate by OrgXYZ[vR].X, OrgXYZ[vR].Y, OrgXYZ[vR].Z, then $$BlXYZ[R].X=bl.vR\cdot \mathrm{Org}XYZ[vR].X$$

$$BlXYZ[R].Y=bl.vR\cdot \mathrm{Org}XYZ[vR].Y$$

$$BlXYZ[R].Z=bl.vR\cdot \mathrm{Org}XYZ[vR].Z \quad \text{[Expression 16]}$$

(the same applies to G and B)
are obtained.

A method of pixel value correction by the pixel value correcting unit 50 is similar to the procedure according to the first embodiment with the exception of the pixel value correction being based on the light source chromaticity 4041 that is uniform in the screen.

A light source driving unit 4060 determines respective driving waveforms of the light-emitting diode R 4721, the light-emitting diode G 4723, and the light-emitting diode B 4725 of the projecting unit 4070 based on the light source color gamut 4021, and outputs a light source drive signal 4061 that drives the light source. This is the same as the operation of the backlight driving unit 60 described in the eighth embodiment with the exception of using a single light source.

According to the configurations and the procedures described above, an image display device that achieves both a reduction in individual variability in the appearance of color and an expansion of a display color gamut can also be constructed with a projector device that projects video on a screen.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-055091, filed on Mar. 18, 2013 which is hereby incorporated by reference herein in its entirety.

What is claimed is:

1. An image display device that displays an image, comprising:

a plurality of light transmitting units having transmission wavelength characteristics respectively corresponding to a plurality of colors including a green color;

an illuminating unit configured to emit light corresponding to each of the plurality of colors, the illuminating unit being configured to emit, with respect to at least the green color, light of a plurality of emission spectra including first light and second light (a) whose emission peak wavelengths are both within a range of the transmission wavelength characteristics of a light transmitting unit corresponding to the green color and (b) whose emission peak wavelengths differ from one another; and a control unit configured to control an intensity of light corresponding to the green color emitted by the illuminating unit in accordance with color characteristics of the image, wherein peak wavelengths and intensities of the first light and the second light are determined so as to reduce a fluctuation in stimulus of the green color when a color matching function corresponding to the green color fluctuates due to individual variability.

2. The image display device according to claim 1, wherein an emission peak wavelength of the first light is shorter than a peak wavelength of the color matching function corresponding to the green color, and wherein an emission peak wavelength of the second light is longer than the peak wavelength of the color matching function corresponding to the green color.

3. The image display device according to claim 1, wherein an emission peak wavelength of the first light is shorter than a peak wavelength of a color matching function that is furthest on a short wavelength side in a range of fluctuation due to individual variability of the color matching function corresponding to the green color, and wherein an emission peak wavelength of the second light is longer than a peak wavelength of a color matching function that is furthest on a long wavelength side in a range of fluctuation due to individual variability of the color matching function corresponding to the green color.

4. The image display device according to claim 1, wherein when another color among the plurality of colors is on a shorter wavelength side of the green color, an emission peak wavelength of the first light is longer than a predetermined wavelength between a peak wavelength of a color matching function corresponding to the another color and a peak wavelength of the color matching function corresponding to the green color, and wherein when another color among the plurality of colors is on a longer wavelength side of the green color, an emission peak wavelength of the second light is shorter than a predetermined wavelength between a peak wavelength of a color matching function corresponding to the another color and the peak wavelength of the color matching function corresponding to the green color.

5. The image display device according to claim 1, wherein when another color among the plurality of colors is on a shorter wavelength side of the green color, an emission peak wavelength of the first light is longer than a longer one of wavelengths corresponding to equally divided points that divide a wavelength range determined by a peak wavelength of a color matching function corresponding to the another color and a peak wavelength of the color matching function corresponding to the green color into three equal parts, and wherein when another color among the plurality of colors is on a longer wavelength side of the green color, an emission peak wavelength of the second light is shorter than a shorter one of wavelengths corresponding to equally divided points that divide a wavelength range determined by a peak wavelength of a color matching function corresponding to the another color and the peak wavelength of the color matching function corresponding to the green color into three equal parts.

6. The image display device according to claim 1, wherein an integration of a product of an emission spectrum of the first light and the color matching function corresponding to the green color and an integration of a product of an emission spectrum of the second light and the color matching function corresponding to the green color are approximately equal to each other.

7. The image display device according to claim 1, wherein the control unit controls intensities of the light of the plurality of emission spectra corresponding to the green color in accordance with the number of pixels whose chromaticity belongs to a predetermined color region of low chroma based on color characteristics of the image.

8. The image display device according to claim 1, wherein the control unit controls intensities of the light of the plurality of emission spectra corresponding to the green color so as to reduce a fluctuation in stimulus of the green color when the color matching function corresponding to the green color fluctuates due to individual variability when the number of pixels whose chromaticity belongs to a predetermined color region of low chroma, based on color characteristics of the image, exceeds a threshold.

9. The image display device according to claim 1, wherein the control unit controls intensities of the light of the plurality of emission spectra corresponding to the green color to be the same when the number of pixels whose chromaticity belongs to a predetermined color region of low chroma, based on color characteristics of the image, exceeds a threshold.

10. The image display device according to claim 1, wherein the illuminating unit is constituted by a plurality of illuminating regions and each of the illuminating regions emits light corresponding to each of the plurality of colors, and wherein the control unit controls, for each illuminating region, intensities of the light of the plurality of emission spectra corresponding to the green color emitted from the illuminating region in accordance with color characteristics of the image of a region corresponding to the illuminating region.

11. The image display device according to claim 1, wherein the illuminating unit includes a plurality of light-emitting elements, and wherein the control unit controls the intensity of light by changing an amount of light of each of the light-emitting elements.

12. The image display device according to claim 1, wherein the illuminating unit includes a light source that emits ultraviolet light and a plurality of wavelength converting units configured to convert ultraviolet light from the light source, and wherein the control unit controls intensity of light by controlling an amount of ultraviolet light that is irradiated on each of the wavelength converting units.

13. The image display device according to claim 1, wherein the illuminating unit includes a plurality of light-emitting elements which are provided in respective correspondence to the plurality of colors and which are capable of changing an emission peak wavelength by changing a current value, and wherein the control unit switches a current value that is applied to a light-emitting element corresponding to the green color to a plurality of current values that correspond to emission peak wavelengths of the light of the plurality of emission spectra corresponding to the green color in order to cause the light-emitting element to emit the light of the plurality of emission spectra.

14. The image display device according to claim 1, wherein the plurality of colors are all primary colors.

15. The image display device according to claim 1, wherein the plurality of colors are red, green, and blue.

16. The image display device according to claim 1, further comprising:

a light modulating unit configured to modulate light transmitted through the plurality of light transmitting units on the basis of an image signal, wherein the image display device is a direct-view-type image display device in which an image formed in the light modulating unit is directly viewed.

17. The image display device according to claim 1, further comprising:

a light modulating unit configured to modulate light transmitted through the plurality of light transmitting units on the basis of an image signal, wherein the image display device is a projection-type image display device in which an image formed in the light modulating unit is projected on a screen.

18. The image display device according to claim 1, wherein the plurality of colors includes a blue color, and wherein the illuminating unit is configured to emit, with respect to the blue color, light of a plurality of emission spectra including third light and fourth light (a) whose emission peak wavelengths are both within a range of the transmission wavelength characteristics of a light transmitting unit corresponding to the blue color and (b) whose emission peak wavelengths differ from one another.

19. The image display device according to claim 1, wherein the plurality of colors includes a red color, and wherein the illuminating unit is configured to emit, with respect to the red color, light of a plurality of emission spectra including fifth light and sixth light (a) whose emission peak wavelengths are both within a range of the transmission wavelength characteristics of a light transmitting unit corresponding to the red color and (b) whose emission peak wavelengths differ from one another.

20. An image display device that displays an image, the image display device comprising:

an illuminating unit configured to emit light corresponding to each of a plurality of colors including a green color, the illuminating unit being configured to emit, with respect to at least the green color, light of a plurality of emission spectra including (a) first light whose emission peak wavelength is shorter than a peak wavelength of a color matching function corresponding to the green color and (b) second light whose emission peak wavelength is longer than the peak wavelength of the color matching function corresponding to the green color; and a control unit configured to control an intensity of light corresponding to the green color emitted by the illuminating unit in accordance with color characteristics of the image, wherein peak wavelengths and intensities of the first light and the second light are determined so as to reduce a fluctuation in stimulus of the green color when the color matching function corresponding to the green color fluctuates due to individual variability.

21. An image display device that displays an image, the image display device comprising:

a plurality of light transmitting units having transmission wavelength characteristics respectively corresponding to a plurality of colors including a green color;

an illuminating unit configured to emit light corresponding to each of the plurality of colors, the illuminating unit being configured to emit, with respect to at least the green color, light of a plurality of emission spectra including first light and second light (a) whose emission peak wavelengths are both within a range of the transmission wavelength characteristics of a light transmitting unit corresponding to the green color and (b) whose emission spectra differ from one another with respect to degrees of wideness; and a control unit configured to control an intensity of light corresponding to the green color emitted by the illuminating unit in accordance with color characteristics of the image, wherein peak wavelengths and intensities of the first light and the second light are determined so as to reduce a fluctuation in stimulus of the green color when a color matching function corresponding to the green color fluctuates due to individual variability.

22. An image display device that displays an image, comprising:

a plurality of light transmitting units having transmission wavelength characteristics respectively corresponding to a plurality of colors including a green color; and an illuminating unit configured to emit light corresponding to each of the plurality of colors, the illuminating unit being configured to emit, with respect to at least the green color, light of a plurality of emission spectra including first light and second light (a) whose emission peak wavelengths are both within a range of the transmission wavelength characteristics of a light transmitting unit corresponding to the green color and (b) whose emission peak wavelengths differ from one another, wherein peak wavelengths and intensities of the first light and the second light are determined so as to reduce a fluctuation in stimulus of the green color when a color matching function corresponding to the green color fluctuates due to individual variability.

23. An image display device that displays an image, the image display device comprising:

an illuminating unit configured to emit light corresponding to each of a plurality of colors including a green color, the illuminating unit being configured to emit, with respect to at least the green color, light of a plurality of emission spectra including (a) first light whose emission peak wavelength is shorter than a peak wavelength of a color matching function corresponding to the green color and (b) second light whose emission peak wavelength is longer than the peak wavelength of the color matching function corresponding to the green color, wherein peak wavelengths and intensities of the first light and the second light are determined so as to reduce a fluctuation in stimulus of the green color when the color matching function corresponding to the green color fluctuates due to individual variability.

24. An image display device that displays an image, the image display device comprising:

a plurality of light transmitting units having transmission wavelength characteristics respectively corresponding to a plurality of colors including a green color; and an illuminating unit configured to emit light corresponding to each of the plurality of colors, the illuminating unit being configured to emit, with respect to at least the green color, light of a plurality of emission spectra including first light and second light (a) whose emission peak wavelengths are both within a range of the transmission wavelength characteristics of a light transmitting unit corresponding to the green color and (b) whose emission spectra differ from one another with respect to degrees of wideness, wherein peak wavelengths and intensities of the first light and the second light are determined so as to reduce a fluctuation in stimulus of the green color when a color matching function corresponding to the green color fluctuates due to individual variability.

25. An image display device that displays an image, comprising:

a plurality of light transmitting units having transmission wavelength characteristics respectively corresponding to a plurality of colors;

an illuminating unit configured to emit light corresponding to each of the plurality of colors, the illuminating unit being configured to emit, with respect to at least one predetermined color among the plurality of colors, light of a plurality of emission spectra including first light and second light (a) whose emission peak wavelengths are both within a range of the transmission wavelength characteristics of a light transmitting unit of the plurality of light transmitting units corresponding to the predetermined color and (b) whose emission peak wavelengths differ from one another; and a control unit configured to control emission of light by the illuminating unit in accordance with a color distribution of the image, wherein when another color among the plurality of colors is on a shorter wavelength side of the predetermined color, an emission peak wavelength of the first light is longer than a predetermined wavelength between a peak wavelength of a color matching function corresponding to the another color and a peak wavelength of the color matching function corresponding to the predetermined color, and wherein when another color among the plurality of colors is on a longer wavelength side of the predetermined color, an emission peak wavelength of the second light is shorter than a predetermined wavelength between a peak wavelength of a color matching function corresponding to the another color and the peak wavelength of the color matching function corresponding to the predetermined color.

26. An image display device that displays an image, comprising:

a plurality of light transmitting units having transmission wavelength characteristics respectively corresponding to a plurality of colors; and an illuminating unit configured to emit light corresponding to each of the plurality of colors, the illuminating unit being configured to emit, with respect to at least one predetermined color among the plurality of colors, light of a plurality of emission spectra including first light and second light (a) whose emission peak wavelengths are both within a range of the transmission wavelength characteristics of a light transmitting unit of the plurality of light transmitting units corresponding to the predetermined color and (b) whose emission peak wavelengths differ from one another, wherein when another color among the plurality of colors is on a shorter wavelength side of the predetermined color, an emission peak wavelength of the first light is longer than a predetermined wavelength between a peak wavelength of a color matching function corresponding to the another color and a peak wavelength of the color matching function corresponding to the predetermined color, and wherein when another color among the plurality of colors is on a longer wavelength side of the predetermined color, an emission peak wavelength of the second light is shorter than a predetermined wavelength between a peak wavelength of a color matching function corresponding to the another color and the peak wavelength of the color matching function corresponding to the predetermined color.

* * * * *